US010024128B2

(12) United States Patent
Minnock et al.

(10) Patent No.: US 10,024,128 B2
(45) Date of Patent: Jul. 17, 2018

(54) LOW SHEAR TRIM

(71) Applicant: Cameron International Corporation, Houston, TX (US)

(72) Inventors: Kevin Peter Minnock, Houston, TX (US); Abinesh Gnanavelu, Longford Town (IE); David Francis Anthony Quin, Killoe (IE)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 14/675,505

(22) Filed: Mar. 31, 2015

(65) Prior Publication Data

US 2015/0275614 A1 Oct. 1, 2015

Related U.S. Application Data

(63) Continuation of application No. PCT/US2015/012765, filed on Jan. 23, 2015.

(60) Provisional application No. 61/931,518, filed on Jan. 24, 2014.

(51) Int. Cl.

| | |
|---|---|
| ***E21B 33/076*** | (2006.01) |
| ***E21B 43/20*** | (2006.01) |
| ***E21B 33/035*** | (2006.01) |

(52) U.S. Cl.

CPC ..... *E21B 33/076* (2013.01); *E21B 33/0355* (2013.01); *E21B 43/20* (2013.01)

(58) Field of Classification Search

CPC .... E21B 33/0355; E21B 33/076; E21B 34/02; E21B 34/04; E21B 43/16; E21B 43/20

USPC ..... 166/368

See application file for complete search history.

(56) References Cited

U.S. PATENT DOCUMENTS

| | | | | | |
|---|---|---|---|---|---|
| 1,342,955 | A | * | 6/1920 | Gebhardt | F16K 47/04 251/333 |
| RE17,824 | E | * | 10/1930 | Lee | F16K 47/04 251/122 |
| 1,947,586 | A | * | 2/1934 | Fletcher | E21B 34/02 138/42 |
| 2,402,729 | A | * | 6/1946 | Buchanan | F16L 55/02772 138/43 |
| 3,131,717 | A | * | 5/1964 | Gratzmuller | G05D 16/0647 137/505.18 |

(Continued)

FOREIGN PATENT DOCUMENTS

| | | |
|---|---|---|
| EP | 2042684 | 4/2009 |
| WO | 2012001671 | 1/2012 |
| WO | 2014178723 | 11/2014 |

OTHER PUBLICATIONS

International Search Report & Written Opinion for PCT Application No. PCT/US2015/012765 dated Sep. 22, 2015, 11 pages.

(Continued)

*Primary Examiner* — Matthew R Buck

(74) *Attorney, Agent, or Firm* — Fletcher Yoder P.C.

(57) ABSTRACT

A system includes a subsea chemical injection system configured to inject a chemical into a well, wherein the choke trim comprises a first cylinder comprising a first plurality of spiral flow paths, a second cylinder comprising a second plurality of spiral flow paths, wherein the first cylinder is disposed within the second cylinder, and an outer portion comprising a plurality of axial passages, wherein the second cylinder is disposed within the outer portion.

15 Claims, 32 Drawing Sheets

(56) References Cited

U.S. PATENT DOCUMENTS 3,200,842 A * 8/1965 Wilson ..... F16K 1/20 137/614.11
3,371,714 A * 3/1968 Katzer ..... C08J 3/00 137/1
3,813,079 A * 5/1974 Baumann ..... F16K 47/08 137/270
3,826,281 A * 7/1974 Clark ..... F16K 5/0605 137/625.31
3,894,716 A 7/1975 Barb
3,954,124 A * 5/1976 Self ..... F16K 3/34 137/625.3
3,971,411 A * 7/1976 Baumann ..... F16K 1/54 137/625.3
4,041,982 A * 8/1977 Lindner ..... F16K 47/08 137/625.3
4,083,380 A * 4/1978 Huber ..... F16K 3/26 137/505.25
4,106,525 A * 8/1978 Currie ..... F15C 4/00 138/42
4,149,563 A 4/1979 Seger
4,180,100 A * 12/1979 Kolb ..... F16K 3/34 137/625.3
4,212,321 A * 7/1980 Hulsey ..... F16K 5/0615 137/625.32
4,240,609 A * 12/1980 Hahn ..... F16K 39/022 251/282
4,276,904 A * 7/1981 Jackson ..... B01J 4/02 137/599.01
4,279,274 A 7/1981 Seger
4,326,554 A * 4/1982 Gongwer ..... F16K 25/04 137/14
4,473,210 A * 9/1984 Brighton ..... F16K 47/045 137/625.3
4,506,423 A * 3/1985 Nakamura ..... B21D 26/14 138/149
4,569,370 A * 2/1986 Witt ..... F16K 3/26 137/625.3
4,671,321 A * 6/1987 Paetzel ..... F16K 3/26 137/625.3
4,762,146 A * 8/1988 Ewbank ..... F16K 47/08 137/625.3
4,887,628 A 12/1989 Bowe et al.
4,938,450 A * 7/1990 Tripp ..... F16K 47/08 137/625.3
5,431,188 A * 7/1995 Cove ..... E21B 34/02 137/625.3
5,738,172 A * 4/1998 van Mook ..... E21B 34/10 166/205
5,769,388 A 6/1998 Welker
5,803,119 A * 9/1998 Steinke ..... F16K 47/04 137/625.37
5,971,604 A 10/1999 Linga et al.
6,244,297 B1 * 6/2001 Baumann ..... F16K 47/08 137/625.3
6,701,957 B2 * 3/2004 McCarty ..... F16K 47/04 137/625.3
6,766,826 B2 7/2004 Baumann
6,782,920 B2 * 8/2004 Steinke ..... F16K 47/08 137/625.3
6,973,941 B2 12/2005 Baumann
7,104,281 B2 * 9/2006 Stares ..... F16K 3/246 137/625.33
7,363,982 B2 4/2008 Hopper
7,802,583 B2 9/2010 Harman
8,381,870 B2 2/2013 Harman
8,607,869 B2 12/2013 Soucy
8,770,228 B2 7/2014 Husveg
9,151,430 B2 * 10/2015 Wium ..... F16K 47/06
9,297,458 B1 * 3/2016 Corte, Jr. ..... F16K 1/32
2004/0050433 A1 * 3/2004 Nawaz ..... F16K 47/04 137/625.39
2010/0314325 A1 12/2010 Lean et al.
2011/0029399 A1 2/2011 Asher et al.
2011/0094607 A1 * 4/2011 Elliott ..... F16K 47/08 137/511
2011/0226480 A1 * 9/2011 Jeronimo ..... E21B 21/062 166/308.3
2011/0297399 A1 12/2011 Dyck
2012/0090467 A1 * 4/2012 Betting ..... B01D 45/16 95/256
2012/0174993 A1 * 7/2012 McHugh ..... E21B 34/04 137/511
2012/0227813 A1 * 9/2012 Meek ..... B01D 17/0217 137/1
2012/0319025 A1 * 12/2012 Shu ..... F16K 47/04 251/328
2013/0098620 A1 * 4/2013 Chauveteau ..... E21B 34/14 166/305.1
2013/0255802 A1 10/2013 Minnock
2013/0256570 A1 10/2013 McHugh et al.
2015/0041690 A1 * 2/2015 McCaskill ..... E21B 34/02 251/127

OTHER PUBLICATIONS

Mari Joo Mee Naug Stokka, Faculty of Science and Technology Master's Thesis, Jun. 15, 2013, University of Stavanger, 167 pages.

* cited by examiner

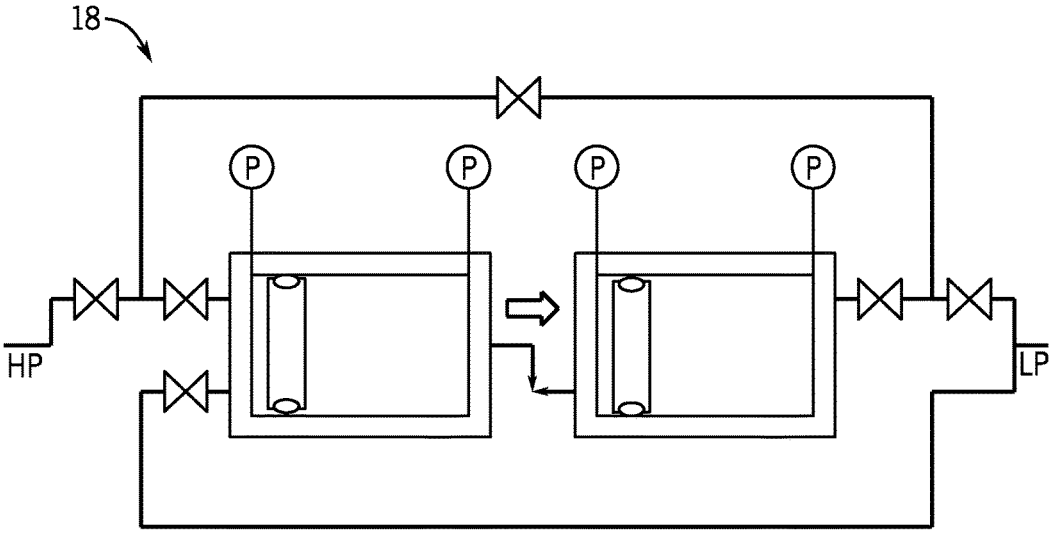
FIG. 37
FIG. 38
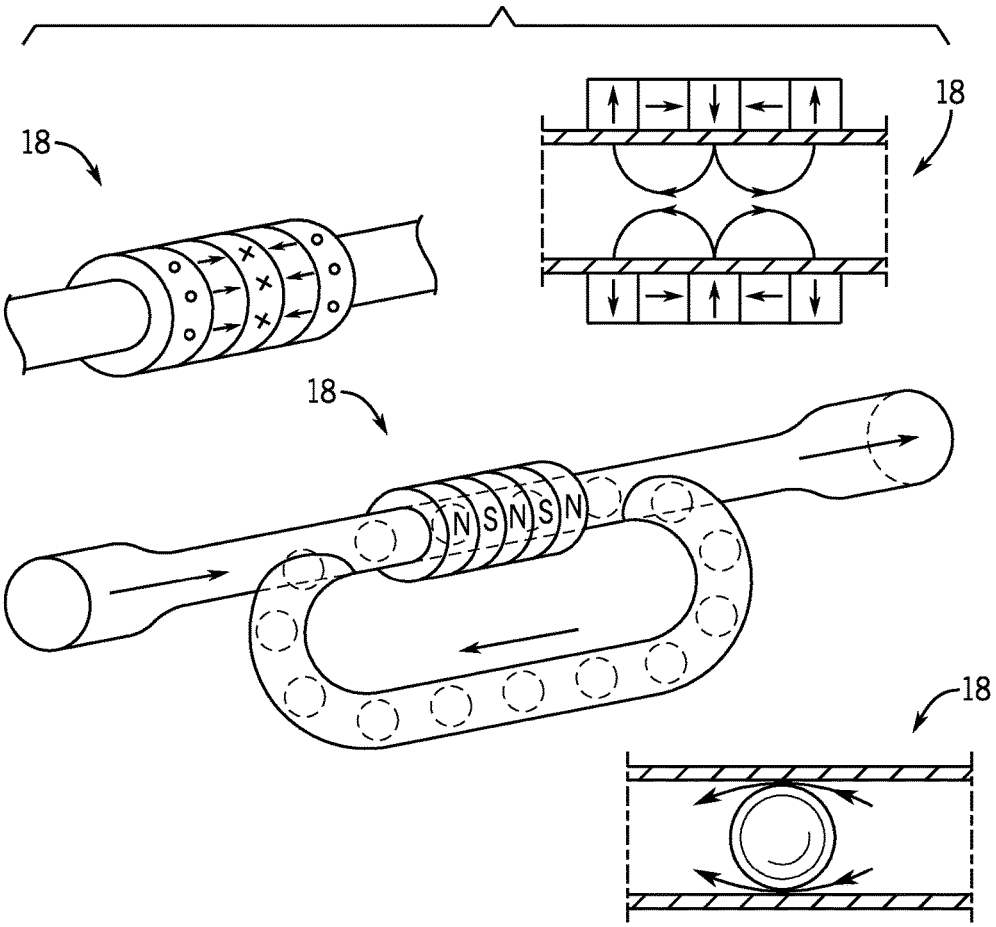

LOW SHEAR TRIM

CROSS-REFERENCE TO RELATED APPLICATION

This application is a continuation of International Application No. PCT/US2015/012765, entitled "SYSTEMS AND METHODS FOR POLYMER DEGRADATION REDUCTION," filed Jan. 23, 2015, which claims priority to and benefit of U.S. Provisional Patent Application No. 61/931,518, entitled "LOW SHEAR TRIM" filed Jan. 24, 2014, each of which is herein incorporated by reference in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Wells are often used to access resources below the surface of the earth. For instance, oil, natural gas, and water are often extracted via a well. Some wells are used to inject materials below the surface of the earth, e.g., to sequester carbon dioxide, to store natural gas for later use, or to inject steam or other substances near an oil well to enhance recovery. Due to the value of these subsurface resources, wells are often drilled at great expense, and great care is typically taken to extend their useful life.

Chemical injection management systems are often used to maintain a well and/or enhance well output. For example, chemical injection management systems may inject chemicals to extend the life of a well or increase the rate at which resources are extracted from a well. One type of injection employs long-chain polymers, which often are expensive to produce and transport to the well location, within the injected water, to improve the water's viscosity and, as a result, increase yield. However, the polymer may degrade if subject to fluid shear and/or fluid acceleration during the injection process, reducing the efficacy of the polymer and potentially requiring more polymer to produce a desired result.

BRIEF DESCRIPTION OF THE DISCLOSURE

Certain embodiments commensurate in scope with the originally claimed embodiments are summarized below. These embodiments are not intended to limit the scope of the claimed embodiments, but rather these embodiments are intended only to provide a brief summary of possible forms of the disclosure. Indeed, the present disclosure may encompass a variety of forms that may be similar to or different from the embodiments set forth below.

In one embodiment, a system includes a subsea chemical injection system configured to inject a chemical into a well, wherein the subsea chemical injection system includes a subsea choke configured to flow the chemical and a choke trim of the subsea choke, wherein the choke trim comprises a flow path having a cross-sectional area and a length, and the cross-sectional area and length are each adjustable independent from one another.

In another embodiment, a system includes a choke trim of a subsea choke configured to flow a chemical for injection into a subsea well, wherein the choke trim comprises a flow path having a cross-sectional area and a length, wherein the cross-sectional area and length are each adjustable independent from one another.

In a further embodiment, a method includes adjusting a first position of a first component of a choke trim relative to a second component of the choke trim to adjust a cross-sectional area of a flow path of the choke trim and adjusting a second position of a third component of the choke trim relative to a fourth component of the choke trim to adjust a length of the flow path of the choke trim, wherein the cross-sectional area and length are each adjustable independent from one another.

In another embodiment, a system includes a subsea chemical injection system configured to inject a chemical into a well, wherein the subsea chemical injection system includes a subsea choke configured to flow the chemical and a choke trim of the subsea choke, wherein the choke trim comprises a flow path having a length, the length is adjustable, and the flow path comprises a gradually decreasing cross-sectional area along at least a portion of the length.

In another embodiment, a system includes a choke trim of a subsea choke configured to flow a chemical for injection into a subsea well, wherein the choke trim includes a flow path having a length, and the length is adjustable.

In a further embodiment, a method includes adjusting a position of a first component of a choke trim relative to a second component of the choke trim to adjust a length of a flow path of the choke trim.

In a further embodiment, a system includes a subsea chemical injection system configured to inject a chemical into a well, wherein the subsea chemical injection system comprises a subsea choke configured to flow the chemical and a choke trim of the subsea choke. The choke trim comprises a first plurality of spiral flow paths, wherein each of the first plurality of spiral flow paths comprises a decreasing cross-sectional area from a respective inlet to a respective outlet of each of the first plurality of spiral flow paths.

In another embodiment, a method includes directing a flow of a polymer solution through an inlet of a choke body, directing the flow of the polymer solution through a first plurality of spiral flow paths of a choke trim, and directing the flow of the polymer solution through a second plurality of spiral flow paths of the choke trim, wherein the second plurality of flow paths extend about the first plurality of spiral flow paths, wherein each of the first and second pluralities of spiral flow paths comprises a gradually decreasing cross-sectional area along a respective length of each of the first and second pluralities of spiral flow paths.

In a further embodiment, a system includes a choke trim of a subsea choke configured to flow a chemical for injection into a subsea well, wherein the choke trim comprises a first cylinder comprising a first plurality of spiral flow paths, a second cylinder comprising a second plurality of spiral flow paths, wherein the first cylinder is disposed within the second cylinder, and an outer portion comprising a plurality of axial passages, wherein the second cylinder is disposed within the outer portion.

In another embodiment, a system includes a subsea chemical injection system configured to inject a chemical into a well, wherein the subsea chemical injection system includes a subsea choke configured to flow the chemical and a choke trim of the subsea choke, wherein the choke trim comprises a porous material.

In another embodiment, a method includes directing a flow of a polymer solution through an inlet of a choke body, directing the flow of the polymer solution through a porous element of a choke trim disposed within the choke body, wherein the porous element comprises a sintered material, and directing the flow of the polymer solution through an outlet of the choke body.

In a further embodiment, a system includes a choke trim of a subsea choke configured to flow a chemical for injection into a subsea well, wherein the choke trim comprises a porous material, and the porous material is formed from a sintering process.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein:

FIG. 37 is a schematic of an embodiment of a low shear choke trim, in accordance with aspects of the present disclosure;

FIG. 38 is a schematic of an embodiment of a low shear choke trim, in accordance with aspects of the present disclosure;

DETAILED DESCRIPTION OF SPECIFIC EMBODIMENTS

Figure 1:
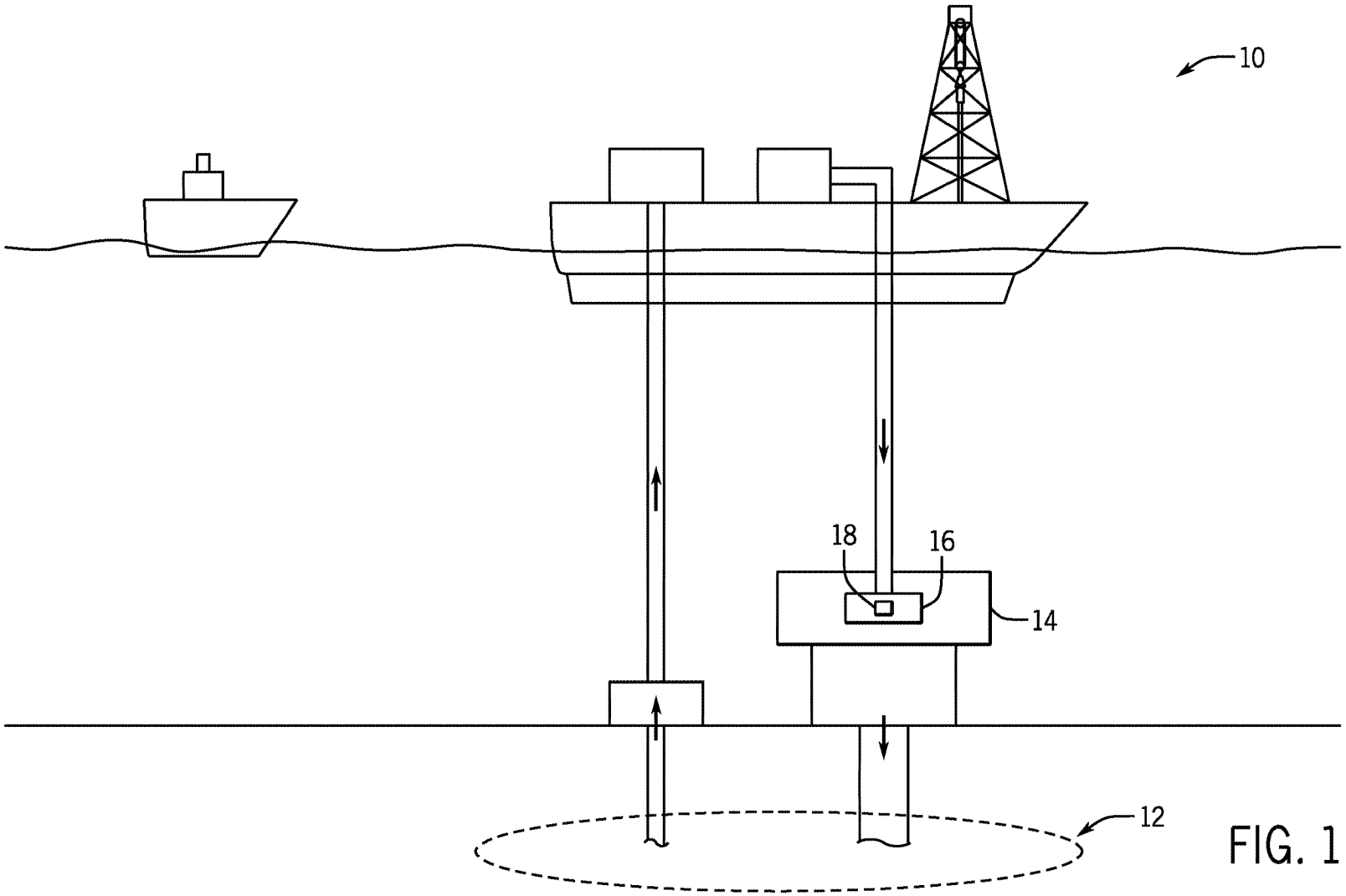
FIG. 1 is a schematic of an embodiment of a polymer injection system, in accordance with aspects of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments are directed to a choke trim for a choke, which may be used to control a fluid flow. For example, a choke may be used with a mineral extraction system (e.g., a surface mineral extraction system and/or a subsea mineral extraction system) for control of fluid flow into a wellhead, well bore, and/or mineral formation. The fluid flow may be an injection fluid, such as water, fracking fluid, a chemical, such as a polymer, or other fluid, alone or in combination. The disclosed embodiments include a choke trim configured to reduce polymer degradation by lowering the overall shear forces and acceleration forces acting on a fluid (e.g., a polymer) flowing through the choke. For example, the polymer may be a liquid or powder long-chain polymer or other polymer that is mixed with water to be injected into the wellbore and mineral formation. The polymer may increase the viscosity of the water, and therefore improve flow of production fluids in the mineral formation. As will be appreciated, a polymer may be delivered to a site (e.g., a floating production storage and offloading (FPSO) unit or a surface wellhead) as an emulsion product. That is, the polymer (e.g., long-chain polymer) may be tightly coiled within water droplets and may have a low viscosity. It may be desirable to invert the polymer (e.g., invert the emulsion) to uncoil the polymer chains into a ribbon form before injecting it into the well, because the uncoiled polymer may provide a higher viscosity to the injected fluid. But polymer in ribbon form is believed to be more susceptible to shear forces and acceleration forces that can cause the polymer chain to degrade and be less viscous, and, therefore, less effective.

Passing the injected fluid through a choke, as well as other flow components and mechanisms, can subject the fluid to shear forces and acceleration forces. A choke with a low shear choke trim (e.g., low shear choke trim and/or low acceleration choke trim) is believed to reduce polymer degradation. The low shear choke trim can be used to adjust (e.g., increase or decrease) a flow rate of the polymer through the choke trim and/or a pressure drop of the polymer. For example, in certain embodiments, a cross-sectional area of the flow path of the choke trim may be adjusted (e.g., increased or decreased) and/or a length of the flow path of the choke trim may be adjusted (e.g., increased or decreased). (As used herein, any adjustability of the length and/or cross-sectional area of the flow path refers to increases and/or decreases.) In certain embodiments, the cross-sectional area and the length of the flow path of the choke trim may be adjustable independent of one another. In other embodiments, the cross-sectional area and the length of the flow path of the choke trim may be adjustable dependent on one another (e.g., in some predefined ratio or functional relationship between length and cross-sectional area). Adjusting the cross-sectional area of the flow path can adjust the flow rate of the polymer through the choke trim, and adjusting the length of the flow path can adjust the pressure drop of the polymer as the polymer flows through the choke trim. The inlet section of each individual flow path, or the flow path itself, may be gradually tapered to allow for gradual acceleration of fluid in the flow path, for overall reduction of shear and acceleration forces on the fluid and hence a reduction in the overall polymer degradation. The tapered section may be up to a certain length and the remaining part of the flow path may be of uniform cross-sectional area. Furthermore, in certain embodiments, other components may be used to control flow of polymer prior to injection to reduce fluid shear and/or fluid acceleration forces on the polymer during flow. For example, certain embodiments may include various components such as pumps, pistons, magnetic resistance fluid brakes, generators, gate valves, and so forth.

The disclosed embodiments also include additional methods that may be used to reduce polymer degradation during supply and injection of the polymer to the well bore and mineral formation. For example, in certain embodiments, the polymer may be injected directly upstream of the choke or directly at the choke, thereby enabling use of the choke to mix and/or invert the polymer prior to injection. In such embodiments, the choke may or may not include a low shear choke trim. Furthermore, in other embodiments, the polymer may be partially inverted prior to injection into the choke, and the polymer may then flow through the choke to be completely inverted upon being injected into the well bore and mineral formation.

FIG. 1 is a schematic illustrating an embodiment of a subsea polymer injection system. It should be noted that while certain embodiments discussed below are described in a subsea mineral extraction system, the chokes and choke trims discussed below may be used with other mineral extraction systems, such as surface or top side mineral extraction systems. As shown, a floating production storage and offloading (FPSO) unit 10 (e.g., a chemical injection system), may supply one or more injection fluids (e.g., water, polymer, polymer solution, etc.) to a subsea mineral formation 12. The injection fluid may be supplied through a supply line to a well head 14 having a choke 16 configured to regulate flow of the polymer and/or polymer solution through the well head 14. It should be noted that the present discussion describes the choke 16 used for polymer and/or polymer solution injection, but the choke 16 may be used for the injection of any other fluid. The choke 16 may be a part of a subsea chemical injection system that may include the FPSO unit. In other embodiments, the choke 16 may be used with a surface mineral extraction system or a top side mineral extraction system. As mentioned above, the choke 16 may include a low shear choke trim 18, which is configured to reduce polymer degradation by reducing fluid shear (elongational and extensional) and/or fluid acceleration acting on the polymer and/or polymer solution as the polymer is flowing through the choke 16. As discussed in detail below, the choke trim 18 may be configured to adjust a cross-sectional area of a flow path of the choke trim and/or a length of the choke trim 18. In some embodiments, the choke trim 18 may be configured to adjust the cross-sectional area and the length of the flow path independently of one another. Again, the adjustments in length and/or cross-sectional area of the flow path through the choke trim 18 may help to control a flow rate, a pressure drop, reduce polymer degradation, or any combination thereof, associated with the polymer flowing through the choke trim 18.

Figure 2:
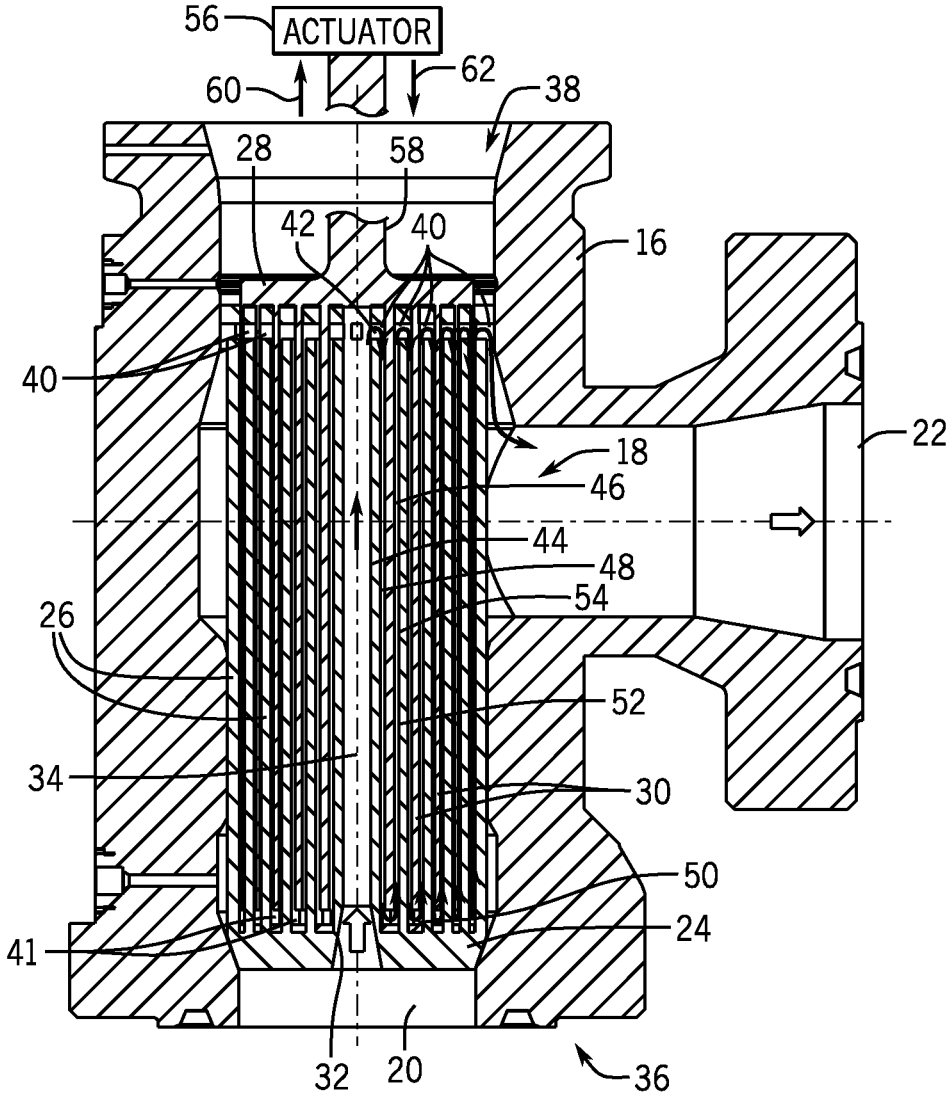
FIG. 2 is a cross-sectional side view of an embodiment of a low shear choke trim disposed within a choke of a polymer injection system, in accordance with aspects of the present disclosure.

FIG. 2 is an embodiment of the low shear choke trim 18 disposed within the choke 16. In the illustrated embodiment, the choke trim 18 is configured to enable adjustment of a total length of a flow path of the choke trim 18 as well as a cross-sectional area of the flow path. Furthermore, the total length of the flow path and the cross-sectional area of the flow path are independently adjustable, to enable improved configuration and customization of the flow path, as desired. By independently adjusting the length of the flow path and the cross-sectional area of the flow path, a pressure drop of the fluid (e.g., a polymer) flowing through the choke 18 may be adjusted.

The choke 16 includes an inlet 20 and an outlet 22. Liquid (e.g., a polymer) enters the choke 16 through the inlet 20 and subsequently flows through the choke trim 18 before exiting the choke 16 through the outlet 22. In the illustrated embodiment, the choke trim 18 includes a first portion 24 having a first set of concentric cylinders 26 (e.g., annular walls, tubes, or sleeves) and a second portion 28 having a second set of concentric cylinders 30 (e.g., annular walls, tubes, or sleeves). The concentric cylinders 26 and 30 of the first and second portions 24 and 28 of the choke trim 18 are nested within one another and have a telescopic arrangement. In the manner described below, the axial position of the second portion 28 relative to the first portion 24 may be adjusted to adjust the length of the flow path of the choke trim 18.

After fluid enters the choke 16 through the inlet 20, the fluid will enter the choke trim 18 through an inlet 32 of the first portion 24. The inlet 32 has a tapered configuration, which may increase the velocity of the fluid while reducing fluid shear and/or fluid acceleration on the fluid. The reduced fluid shear and/or fluid acceleration is believed to reduce polymer degradation. The fluid flows through the inlet 32 to enter a central passage 34 of the first portion 24 of the choke trim 18 and flows from a first end 36 of the choke trim 18 to a second end 38 of the choke trim 18.

At the second end 38 of the choke trim 18, the concentric cylinders 26 of the first portion 24 of the choke trim 18 include flow ports 40 (e.g., radial ports) to enable the fluid (e.g., polymer) to flow from the central passage 34 into annular spaces or passages radially and in between the concentric cylinders 26 and 30 of the first and second portions 24 and 28. Similarly, the concentric cylinders 30 of the second portion 28 include flow ports 41 (e.g., radial ports) at the first end 26 to enable the fluid to continue to flow into annular spaces or passages radially and in between the concentric cylinders 26 and 30 of the first and second portions 24 and 28. For example, from the central passage 34, the fluid will flow through a first flow port 42 formed in a first concentric cylinder 44 of the first portion 24 and into a first passage 46 between the first concentric cylinder 44 of the first portion 24 and a first concentric cylinder 48 of the second portion 28. The fluid flows through the first passage 46 from the second end 38 of the choke trim 18 to the first end 36 of the choke trim 18. At the first end 36 of the choke trim 18, the fluid will flow through a second flow port 50 formed in the first concentric cylinder 48 of the second portion 28 to enter a second passage 52 between the first concentric cylinder 48 of the second portion 28 and a second concentric cylinder 54 of the first portion 24. The fluid will continue to flow through the first and second portions 24 and 28 of the choke trim 18 until the fluid flows out of the choke trim 18 and through the outlet 22 of the choke 16. In other words, the fluid progressively or sequentially flows in a first axial direction, in a radial direction, in a second axial direction opposite the first axial direction, in the radial direction, in the first axial direction, and so forth, through the choke trim 18.

As mentioned above, the choke trim 18 may be configured to enable adjustment of a total length of the flow path of the choke trim 18 and/or a total cross-sectional area of the flow path of the choke trim 18. For example, in the illustrated embodiment, the first portion 24 and the second portion 28 of the choke trim 18 are configured to move axially relative to one another to enable a change in the total length of the flow path of the choke trim 18. Specifically, an axial position of the second portion 28 may be adjusted by an actuator 56, such as a mechanical actuator, electromechanical actuator, fluid (e.g., hydraulic or pneumatic) actuator, or other actuator. The actuator 56 is coupled to a stem 58 of the second portion 28. Alternatively, the position of the second portion 28 may be adjusted by manual mechanism (e.g., hand wheel or lever system).

When the actuator 56 actuates the second portion 28, the second portion 58 may be moved in an axial direction 60 or an axial direction 62. In this manner, the total length of the flow path of the choke trim 18 is adjusted. For example, when the second portion 58 is actuated in the direction 62, the total flow path distance of the choke trim 18 may be lengthened or increased. In the embodiment shown in FIG. 2, the second portions 58 is shown as fully actuated in the direction 62. In other words, the concentric cylinders 30 of the second portion 28 are fully nested within the concentric cylinders 26 of the first portion 24. As a result, the configuration of the choke trim 18 shown in FIG. 2 has a greatest total length, as the fluid will flow through the passages between the concentric cylinders 26 and 30 of the first and second portions 24 and 28 along a substantially entire length of the choke trim 18.

Figure 3:
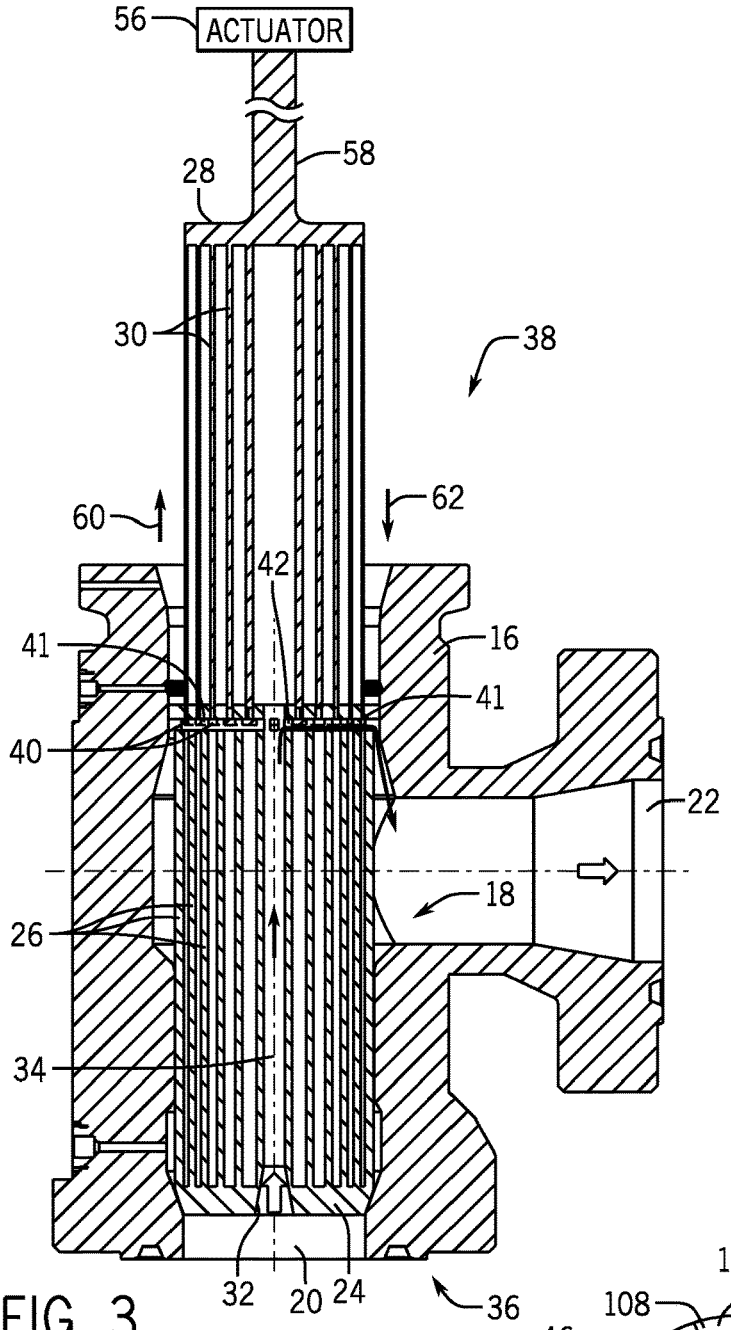
FIG. 3 is a cross-sectional side view of an embodiment of a low shear choke trim disposed within a choke of a polymer injection system, in accordance with aspects of the present disclosure.

To shorten the total length of the flow path, the second portion 28 is actuated in the direction 60. This causes the flow ports 41 of the concentric cylinders 30 of the second portion 28 to move closer to the flow ports 40 of the concentric cylinders 26 of the first portion 24. As a result, the passages (e.g., first passage 46 and second passage 52) between the concentric cylinders 26 and 30 are shortened in length. As shown in FIG. 3, which also illustrates the embodiment of the low shear choke trim 18 shown in FIG. 2, the second portion 58 may be actuated in the direction 60 to the point that the flow ports 41 of the concentric cylinders 30 of the second portion 28 may be aligned with the flow ports 40 of the of the concentric cylinders 26 of the first portion 24, thereby excluding the passages (e.g., first passage 46 and second passage 52) from the flow path of the choke trim 18. Arrow 64 in FIG. 3 shows that the flow of fluid (e.g., polymer) may flow the central passage 34, through the aligned flow ports 40 and 41, and through the outlet 22 of the choke 16. Indeed, the configuration of the choke trim 18 shown in FIG. 3 has a flow path with a shortest total length.

Figure 4:
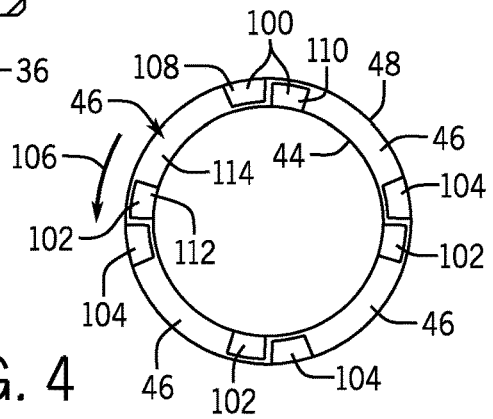
FIG. 4 is an schematic axial view of a cross-sectional side view of an embodiment of a low shear choke trim, in accordance with aspects of the present disclosure.

As mentioned above, the total flow path area (e.g., cross-sectional area) of the choke trim 18 illustrated in FIGS. 2 and 3 may be adjusted. FIG. 4 illustrates a partial axial schematic of the choke trim 18 of FIGS. 2 and 3, illustrating partitions 100 (e.g., splines) formed within the first passage 46 between the first concentric cylinder 44 of the first portion 24 and the first concentric cylinder 48 of the second portion 28. Specifically, the first concentric cylinder 44 of the first portion 24 has partitions 102 (e.g., axial partitions, protrusions, ribs, etc.) extending into the first passage 46 and engaging with the first concentric cylinder 48 of the second portion 28, and the first concentric cylinder 48 of the second portion 28 has partitions 104 (e.g., axial partitions, protrusions, ribs, etc.) extending into the first passage 46 and engaging with the first concentric cylinder 44 of the first portion 24. The other passages (e.g., second passage 52) between the concentric cylinders 26 and 30 of the first and second portions 24 and 28 may have similar partitions 100 extending therein.

The second portion 28 of the choke trim 18 may be rotated (e.g., via the actuator 56) relative to the first portion 24 of the choke trim 18 to change the cross-sectional area of the flow path of the choke trim 18. In the illustrated embodiment, the partitions 102 and 104 are shown adjacent to one another, thereby enabling a greatest cross-sectional flow area of the first passage 46. To reduce the cross-sectional flow area, the second portion 28 (e.g., the first concentric cylinder 48 of the second portion 28) of the choke trim 18 may be rotated, as indicated by arrow 106. When the second portion 28 is rotated, the partitions 104 of the second portion 28 also rotate to decrease the cross-sectional area of the first passage 46. For example, when the second portion 28 is rotated, a first protrusion 108 of the concentric cylinder 48 may rotate away from a first protrusion 110 of the concentric cylinder 44 in the direction 106. At the same time, the first protrusion 108 of the concentric cylinder 48 will rotate closer to a second protrusion 112 of the concentric cylinder 44. In this way, a section 114 of the first passage 46 will decrease in cross-sectional area. Furthermore, the partitions 108 and 110 may block fluid flow from entering a section or area that is created between the partitions 108 and 110 when the second portion 28 is rotated in the direction 106. For example, the partitions 108 and 110, or other components of the choke trim 18, may have coatings, seals, or other features that enable blocking of fluid flow between the partitions 108 and 110. As will be appreciated, the other partitions 102 and 104 of the concentric cylinders 44 and 48, as well as the other partitions 100 of the choke trim 18, may operate in similar manners. That is, during rotation of the second portion 28, the other partitions 100, 102, and 104 may similarly reduce the cross-sectional area of other sections of flow passages (e.g., passages 46 and 52) to reduce the total cross-sectional area of the flow path of the choke trim 18.

Figure 5:
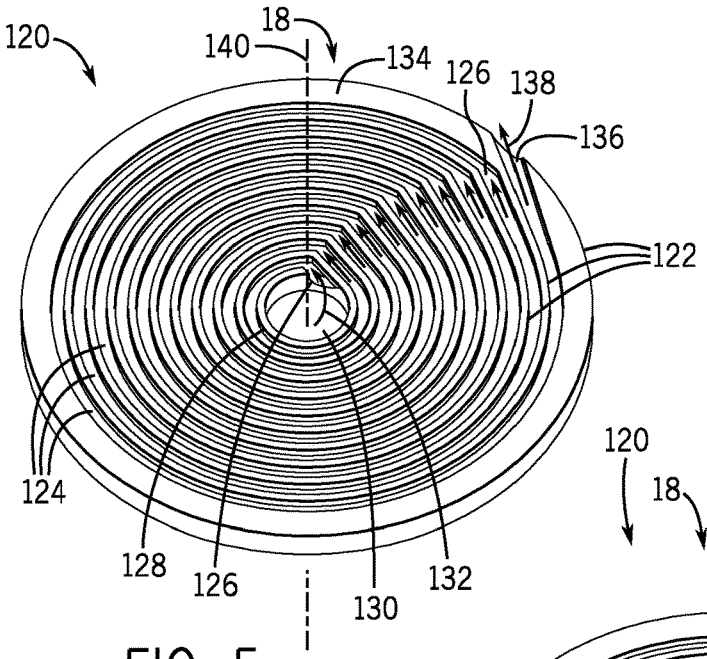
FIG. 5 is a perspective view of a plate of an embodiment of a low shear choke trim, in accordance with aspects of the present disclosure.
Figure 6:
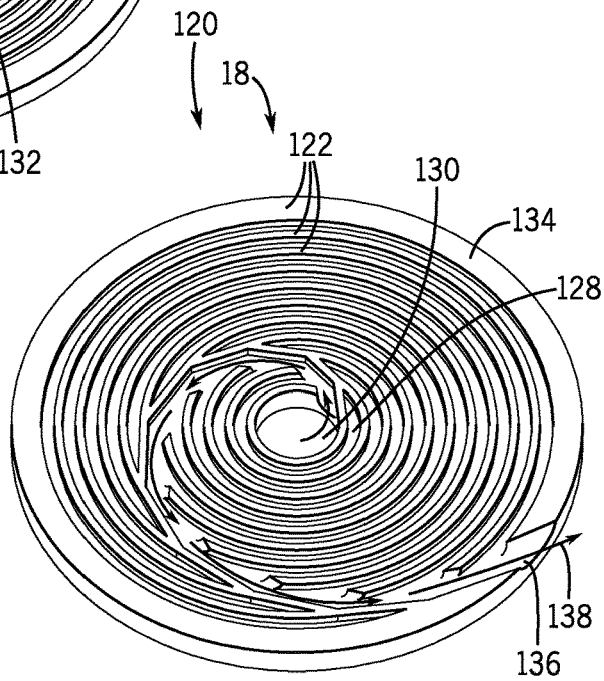
FIG. 6 is a perspective view of a plate of an embodiment of a low shear choke trim, in accordance with aspects of the present disclosure.
Figure 7:
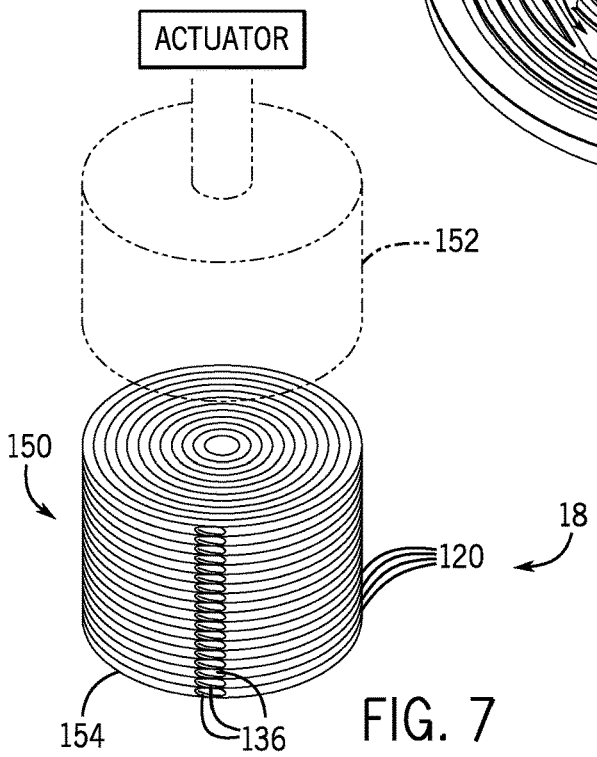
FIG. 7 is a perspective view of a stack of plates and an annular sheath of an embodiment of a low shear choke trim, in accordance with aspects of the present disclosure.

FIGS. 5-7 illustrate components of another embodiment of the choke trim 18. Specifically, FIG. 5 illustrates a plate 120 that may be used alone or in combination with similar plates 120 to create one or more flow paths of the choke trim 18. As discussed below, a stack of plates 120 (e.g., 1, 2, 5, 10, 15, 20, or more plates) may be positioned within the choke 16 to regulate flow of a fluid flowing through the choke 16. The plate 120 includes a plurality of concentric rings 122 (e.g., 1, 2, 5, 10, 15, 20, or more rings) that are each adjustable independent of one another. Each ring 122 also includes a flow path 124 through which a fluid (e.g., polymer) may flow. As shown, each flow path 124 is fluidly coupled to the flow paths 124 of adjacent rings 122. That is, each ring 122 includes a port 126 that extends from its flow path 124 to the flow path 124 of adjacent rings 122.

Fluid enters the flow path 124 of an innermost ring 128 via a central passage 130 of the plate 120, as indicated by arrow 132. Thereafter, the fluid may flow through the flow path 124 of the innermost ring 128 and into the flow path 124 of the next outermost ring 122 via the port 126 of the innermost ring 128. The fluid will continue to flow through each flow path 124 of each ring 122 via the ports 126 of each ring 122. In other words, the fluid will flow from the flow path 124 of the innermost ring 128 and through each flow path 124 of each subsequent, adjacent ring 122 until the fluid flows through the flow path 124 of an outermost ring 134 and exits the plate 120 through an exit port 136 of the outermost ring 134, as indicated by arrow 138. In this manner, the fluid flows through a sequence of annular flow paths progressively increasing in diameter, with each annular flow path followed by an annular flow path of a greater diameter.

As mentioned above, the rings 122 of the plate 120 may be adjustable independent of one another to adjust a total length of the flow path of the plate 120, which is the sum of the flow paths 124 of each ring 122. For example, the rings 122 may rotate relative to one another about a central axis 140 of the plate 120. For example, the rings 122 may have lubricant, ball bearings, or other substance/component disposed between one another to facilitate rotation of the rings 122 relative to one another. As each ring 122 rotates, the respective port 126 extending between the flow path 124 of the ring 122 to the flow path 124 of the subsequent, adjacent ring 122 also rotates.

As the position of the port 126 is adjusted, the length of the flow path 124 through which the fluid must flow is also adjusted. For example, in the embodiment shown in FIG. 5, each ring 122 is positioned such that a fluid (e.g., polymer) must flow through substantially an entire length (e.g., circumference) of the respective flow path 124 before the fluid reaches the respective port 126 of the ring 122. Once the fluid flows through substantially the entire flow path 124 of the respective ring 122, the fluid may flow through the respective port 126 of the ring 122 to enter the flow path 124 of the subsequent, adjacent ring 122.

FIG. 6, on the other hand, illustrates the plate 120 having a configuration where the rings 122 are positioned (e.g., rotated) relative to one another, such that the port 126 of each ring extends to the respective port 126 of the subsequent, adjacent ring 122 in the plate 120. As a result, a fluid flowing through the plate 120 will bypass a substantial portion of the flow path 124 of each ring 122, and the total length of the flow path of the plate 120 is shortened. As will be appreciated, each ring 122 may be individually positioned to select a desired total length of the flow path of the plate 120. Indeed, the total length of the flow path of the plate 120 may be as long as the total flow path shown in FIG. 5, as short as the total flow path shown in FIG. 6, or any length in between. For example, each ring 122 may be adjusted from between 0 to 360 degrees of a circumference of the ring 122. For example, the position of each ring 122 may be adjusted incrementally, such as 10 degrees, 20 degrees, 30 degrees, 40 degrees, etc.

To enable adjustment of a cross-sectional area of the choke trim 18, multiple plates 120 may be stacked on top of one another, as shown in FIG. 7, to create a plate stack 150. Then, using a cover 152, such as a sheath, case, tube, sleeve, annular wall, or other cover, a desired number of plates 120 may be covered or exposed. In other words, the cover 152 may cover or shield a desired number of exit ports 136 of the plate 120. As described above, fluid may flow into the stack 150 of plates 120 through a central passage 130 of the plates 120 and thereby enter the respective flow paths 124 of each plate 120. The cover 152 may be positioned over the stack 150 of plates 120 (e.g., 1, 2, 5, 10, 15, 20, or other suitable number of plates) to cover or expose the desired number of exit ports 136 (e.g., radial ports) of the plates 120. For example, to enable a maximum cross-sectional area of the total flow path of the choke trim 18, the cover 152 may be removed to expose the exit ports 136 of all plates 120. To enable a flow path with a minimum cross-sectional area, the cover 152 may cover all but one plate 120 (e.g., a bottom plate 154), and thereby expose only the exit port 136 of the bottom plate 154. In certain embodiments, the position of the cover 152 may be actuated by an actuator 156, such as a mechanical actuator, electromechanical actuator, fluid (e.g., hydraulic or pneumatic) actuator, or other actuator. Alternatively, the position of the cover 152 may be adjusted by manual mechanisms (e.g., hand wheel or lever system). At the entrance section of each individual flow path, the cross-sectional area of the flow path is gradually tapered down (reduced) to allow for gradual acceleration of fluid flow (e.g., polymer solution). This gradual reduction in flow path cross-section allows for reduction in overall polymer degradation. A section of the flow path may have a gradual reduction in cross-section area and the remaining part may be of uniform cross-section.

Figure 8:
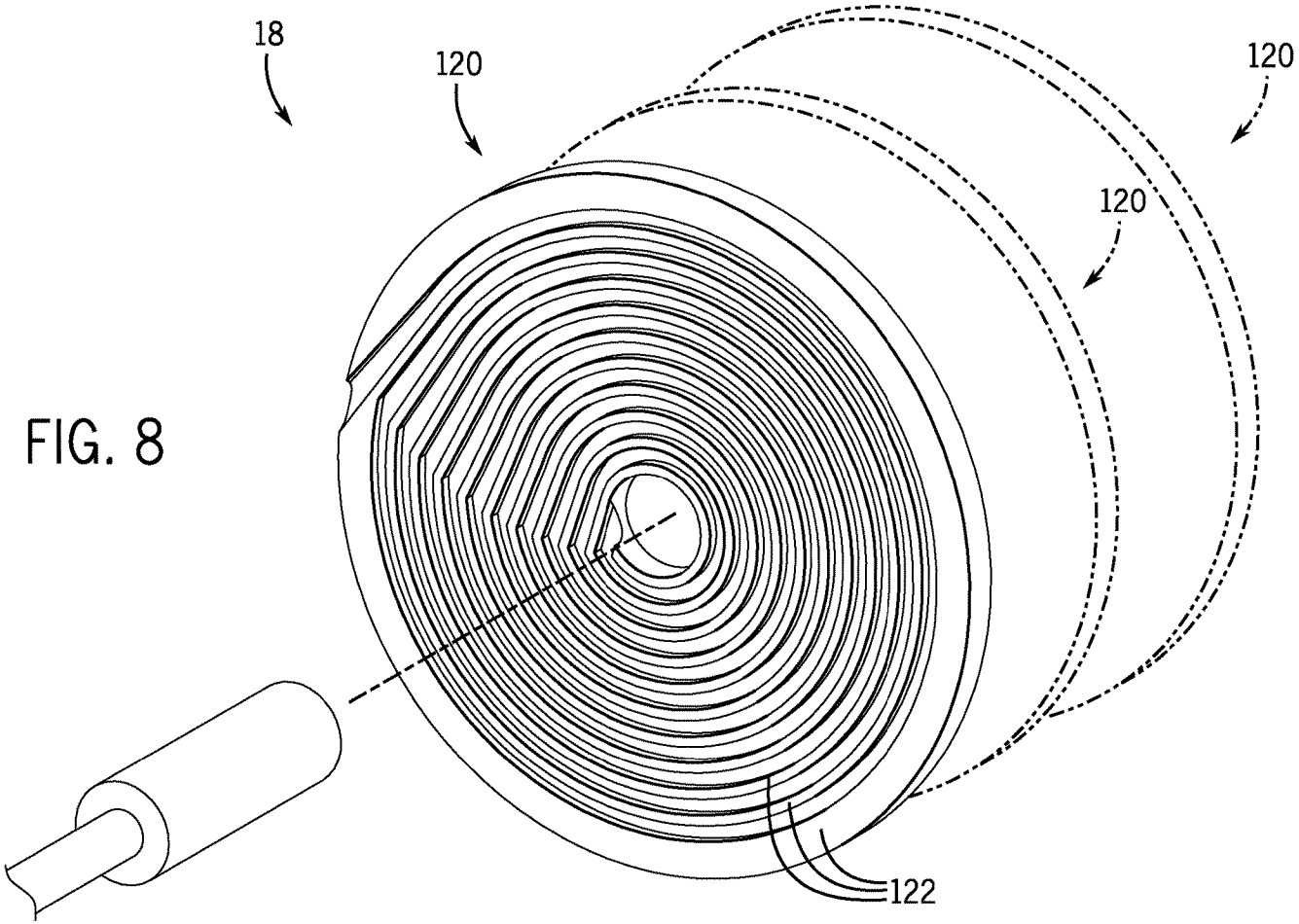
FIG. 8 is an exploded perspective view of an embodiment of a low shear choke trim, in accordance with aspects of the present disclosure.

FIG. 8 is an embodiment of the choke trim 18. In the illustrated embodiment, the choke trim 18 includes one or more plates having flow paths (e.g., grooves) formed therein. In the illustrated embodiment, the plate has spiral grooves. A fluid, such as polymer, may enter the flow paths through a center of the plate and exit the plate at a perimeter of the plate or vice versa. To enable a change in cross-sectional area of the total flow path of the choke trim, the choke trim includes a segmented plunger. For example, the number of segments of the plunger may be equal to the number of flow paths of the plate. The cross-sectional area of the flow path of the choke trim may be adjusted by positioning the plunger into the central passage of the plate and then removing the segments of the plunger to expose a desired number of flow paths of the plate. Indeed, to enable a maximum cross-sectional area of the choke trim, the plunger may not be inserted into the plate at all to allow all flow paths to be open. To enable adjustment of the total length of the flow path, multiple plates may be stacked on top of one another. In such an embodiment, polymer may enter the first plate through a center of the first plate, the polymer may flow through the spiral grooves to a perimeter of the first plate, and the polymer may flow through ports at the perimeter of the first plate that align with ports formed in the perimeter of a second plate. Thereafter, the polymer may flow through the spiral grooves of the second plate toward a center of the second plate. At the center of the second plate, the polymer may exit the second plate or the polymer may flow through ports at the center of the second plate that are aligned with ports at a center of a third plate, and the polymer may flow into the third plate, and so forth. In this manner, the length of the flow path of the choke trim may be adjusted as needed. At the entrance section of each individual flow path, the cross-sectional area of the flow path is gradually tapered down (reduced) to allow for gradual acceleration of fluid flow (e.g., polymer solution). This gradual reduction in flow path cross-section allows for reduction in overall polymer degradation. In certain embodiments, a section of the flow path may have a gradual reduction in cross-section area and the remaining part may be of uniform cross-section.

Figure 9:
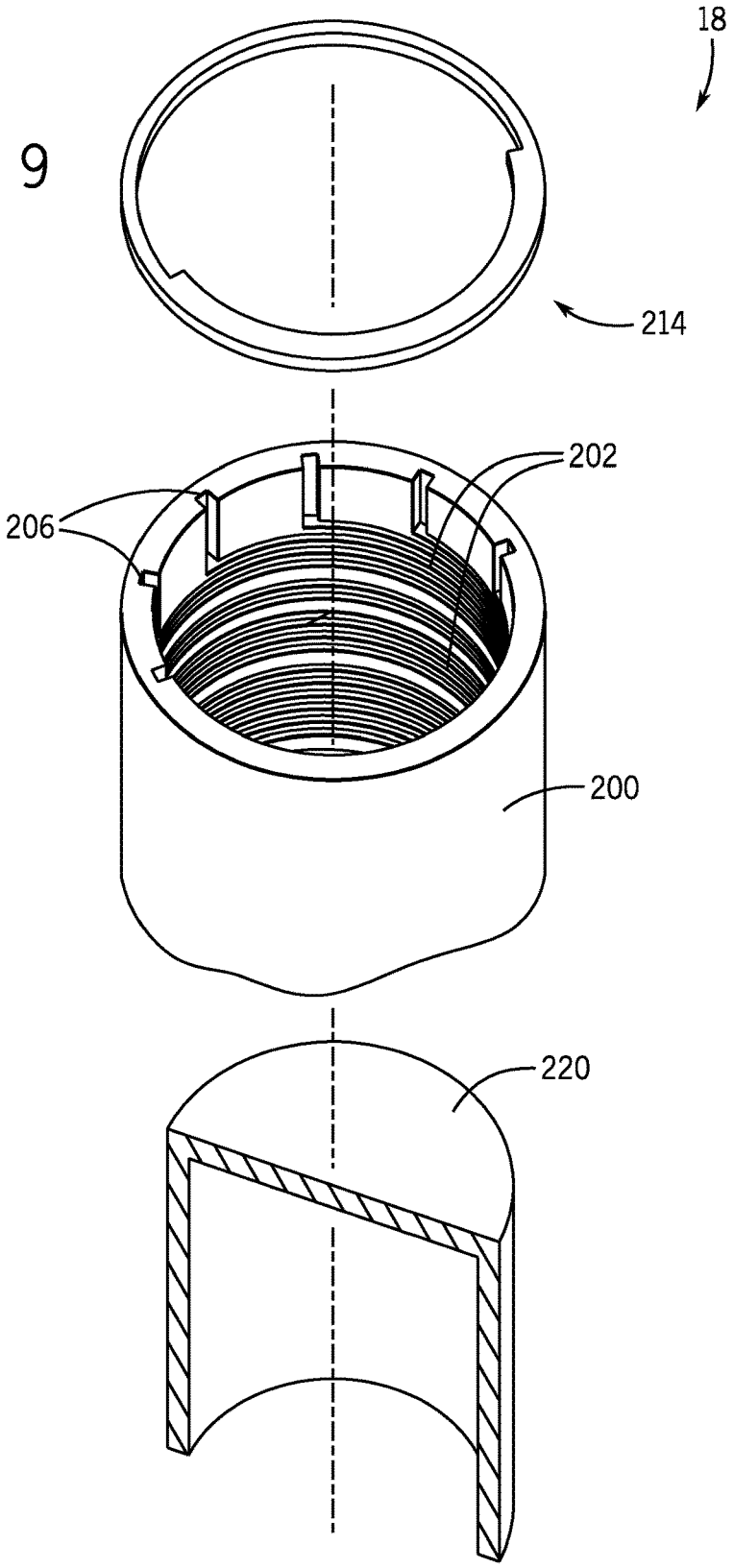
FIG. 9 is a perspective view of an embodiment of a low shear choke trim, in accordance with aspects of the present disclosure.
Figure 10:
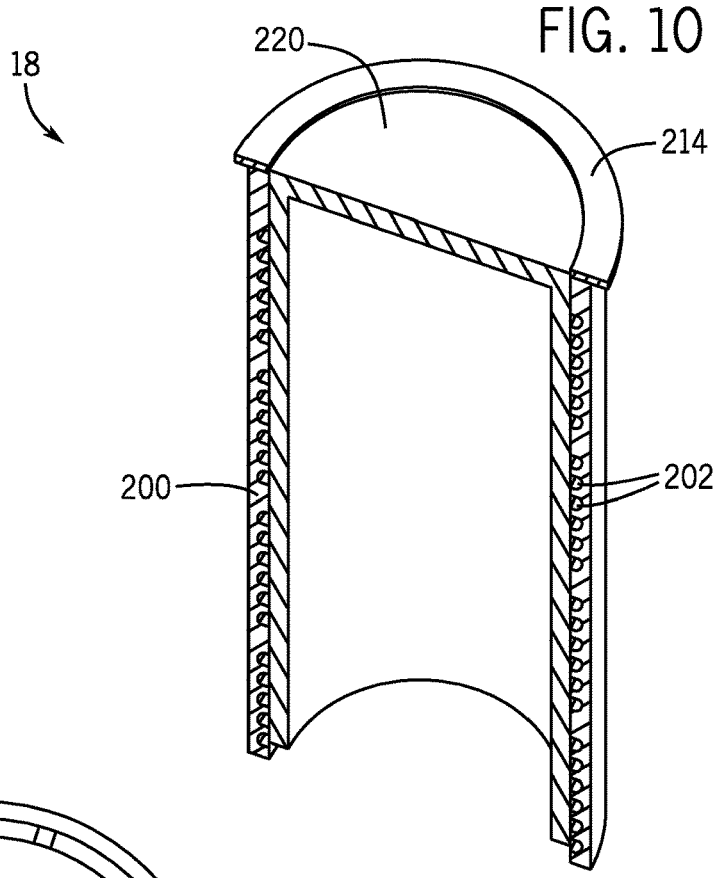
FIG. 10 is a cross-sectional perspective view of an embodiment of a low shear choke trim, in accordance with aspects of the present disclosure.
Figure 11:
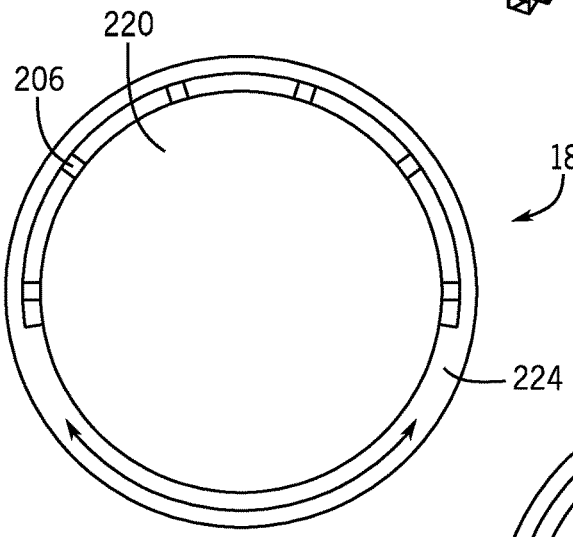
FIG. 11 is an axial view of an embodiment of a low shear choke trim, in accordance with aspects of the present disclosure.
Figure 12:
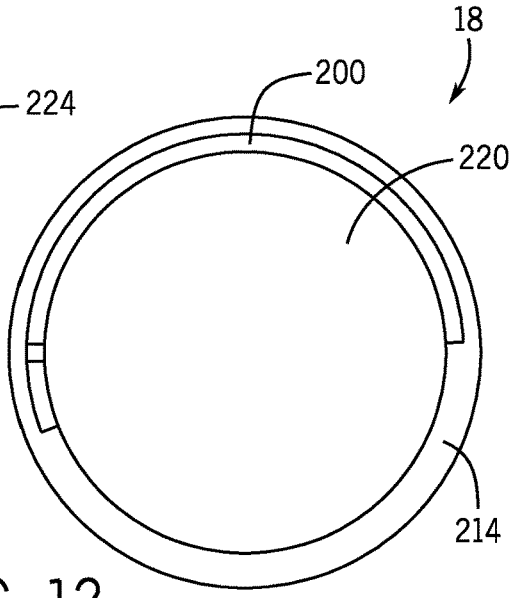
FIG. 12 is an axial view of an embodiment of a low shear choke trim, in accordance with aspects of the present disclosure.

FIGS. 9-12 illustrate various components of an embodiment of the choke trim 18. For example, FIG. 9 is an exploded perspective view of the components of the choke trim 18, including a retainer, a flow path cylinder (e.g., an annular cylinder), and a cap. The retainer fits within the flow path cylinder, which has a plurality of spiral flow path grooves formed on the inner diameter of the flow path cylinder. Each flow path is exposed to a respective inlet port at the top of the flow path cylinder. The flow path may have a gradual tapered section at the inlet to allow for reduction in overall fluid acceleration and hence reduce polymer degradation similar to previous embodiments. The tapered section of the flow path may extend over a certain length of the flow path, such as 20 to 90 percent of a length of the flow path. The cross-section of the remaining part of the flow path may remain uniform. The cap fits on the top of the flow path cylinder to cover or expose one or more of the flow inlet ports, as desired. FIG. 10 illustrates the assembled choke trim 18 of FIG. 9. The length of the flow path of the choke trim 18 is determined by the position of the retainer within the flow path cylinder. For example, in the embodiment shown in FIG. 10, the flow path of the choke trim 18 has a maximum length. That is, polymer will enter the choke trim 18 through the inlet ports at the top of the cylinder ring and will flow through the entire length of the spiral grooves formed in the inner diameter of the flow path cylinder. To reduce the length of the flow path, the retainer may be partially removed from the flow path cylinder, such that only portions of the spiral grooves are covered by the cylinder. As mentioned above, to adjust the total cross-sectional area of the flow path of the choke trim, the position of the cap may be adjusted to expose or block a desired number of inlet ports of the flow path cylinder. For example, FIG. 11 shows the cap positioned on the top of the flow path cylinder such that all inlet ports are exposed. As such, FIG. 11 shows a configuration of the choke trim having a maximum flow path cross-sectional area. FIG. 12 shows the cap positioned on the top of the flow path cylinder such that only one inlet port is exposed. As such, FIG. 12 shows a configuration of the choke trim having a minimum flow path cross-sectional area.

Figure 13:
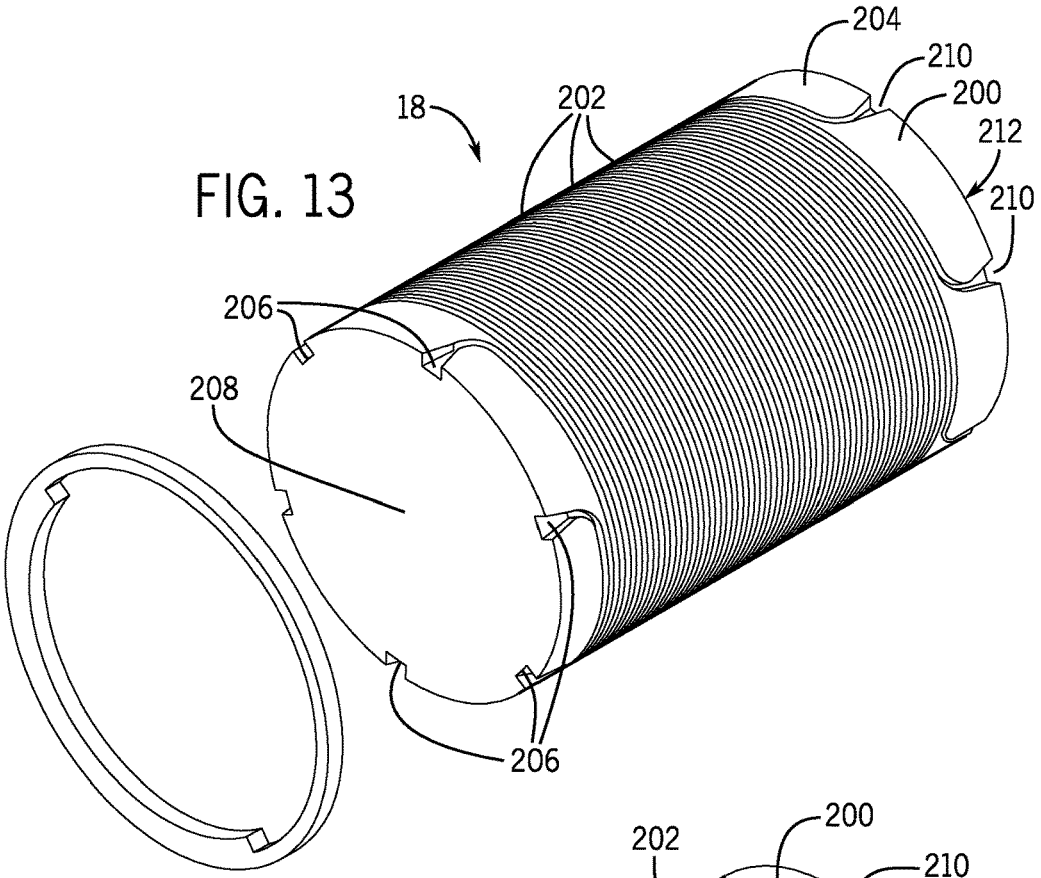
FIG. 13 is a perspective view of an embodiment of a low shear choke trim, in accordance with aspects of the present disclosure.
Figure 14:
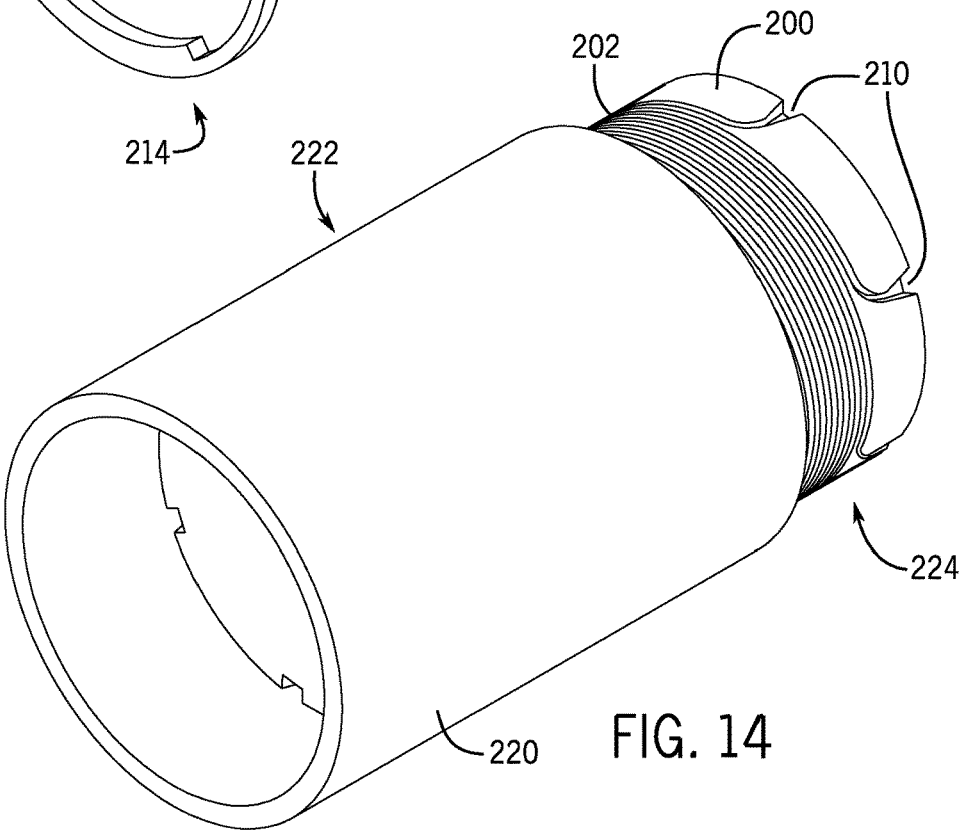
FIG. 14 is a perspective view of an embodiment of a low shear choke trim, in accordance with aspects of the present disclosure.

FIGS. 13 and 14 illustrate an embodiment of the choke trim 18. The embodiment shown in FIGS. 13 and 14 is similar to the embodiment shown in FIGS. 9-12. In the present embodiment, the choke trim 18 includes a flow path cylinder 200 that is solid. However, in other embodiments, the flow path cylinder 200 may not be solid. The flow path cylinder 200 includes a plurality of spiral flow path grooves 202 are formed on an external diameter or circumference 204 of the flow path cylinder 200. Each of the spiral flow path grooves 202 (e.g., 1, 2, 3, 4, 5, 6, 7, 8, 9, 10, or more grooves) includes an entry port 206 formed at a first axial end 208 of the flow path cylinder 200 and an exit port 210 formed at a second axial end 212 of the flow path cylinder 200. The entry section of each spiral flow path may be gradually tapered down to allow for gradual acceleration of fluid and hence reduce polymer degradation. The tapered section of the flow path may extend over a certain length of the flow path, such as 20 to 90 percent of a length of the flow path. The cross-section of the remaining part of the flow path may remain uniform. Fluid (e.g., polymer) may enter each of the spiral flow path grooves 202 through one of the entry ports 206 and may exit the respective spiral flow path groove 202 through its respective exit port 210. In certain embodiments, multiple flow path cylinders 200 having flow path grooves 202 may be stacked within one another.

To control a total cross-sectional flow path area of the choke trim 18 illustrated in FIGS. 13 and 14, the choke trim 18 may include a cap 214, as similarly described above with respect to FIGS. 9-12. The cap 214 (e.g., a ring or annular cap) may sit against the first axial end 208 of the flow path cylinder 200 and may be positioned to selectively cover up or expose one or more of the entry ports 206, as desired. In certain embodiments, the cap 214 may be designed to expose one entry port 206 while covering all other entry ports 206, expose all entry ports 206, or expose any number of entry ports 206 in between.

As shown in FIG. 14, an annular sheath or ring 220 (e.g., annular sleeve, tube, or wall) may be disposed about the flow path cylinder 200 (e.g., in a telescopic arrangement) to cover a desired portion of the spiral flow path grooves 202. As will be appreciated, the axial position of the annular sheath 220 may be adjusted (e.g., by an actuator) to adjust the total length of the spiral flow path grooves 202 through which a fluid (e.g., polymer) may flow. The length of the flow path of each spiral flow path groove 202 may be considered the portion (e.g., indicated by arrow 222) of the spiral flow path groove 202 that is covered by the annular sheath 220. For the portion 222 of the spiral flow path grooves 202 covered by the annular sheath 220, a fluid flow (e.g., polymer flow) entering the entry ports 206 may be forced to flow within the spiral flow path grooves 202. However, for a portion 224 of the spiral flow path grooves 202 that is uncovered by the annular sheath 220, the fluid flow may not be restricted and may be free to flow away from spiral flow path grooves 202 (e.g., and exit the choke trim 18). As such, a total length of the flow path for the illustrated choke trim 18 may be greatest when the annular sheath 220 fully covers the flow path cylinder 200 and the spiral flow path grooves 202, and the total length of the flow path may be shortened by progressively removing the annular sheath 220 from the flow path cylinder 200 to uncover more and more of the spiral flow path grooves 202. For example, the position of the annular sheath 220 about the flow path cylinder 200 may be adjusted or varied continuously or in incremental steps.

Figure 15:
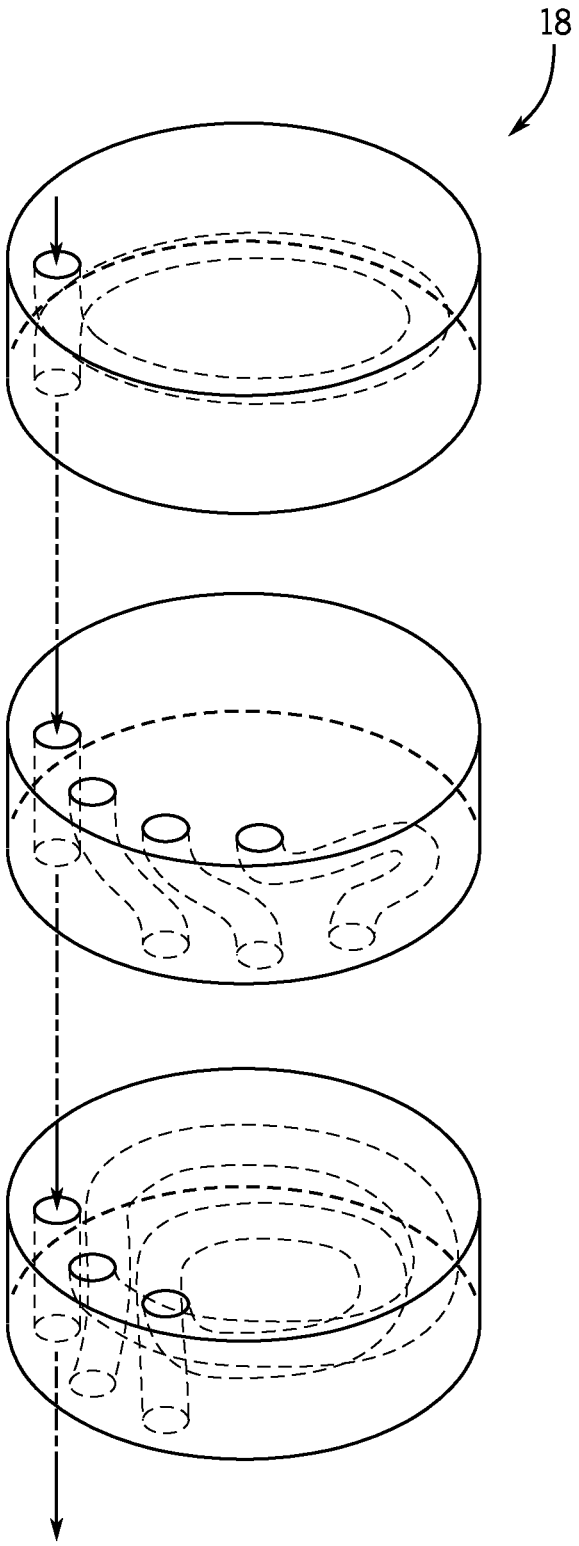
FIG. 15 is a perspective view of an embodiment of a low shear choke trim, in accordance with aspects of the present disclosure.

FIG. 15 illustrates another embodiment of the choke trim, which may be configured to adjust the length and/or cross-sectional area of the flow path of the choke trim. In the illustrated embodiment, the choke trim includes a plurality of disks, where each disk includes flow paths formed therein. For each disk, the flow paths formed therein may have varying lengths and/or cross-sectional areas. To adjust the cross-sectional area and/or length of the total flow path, the disks may be rotated relative to one another to align the desired respective flow paths of the disks with one another.

Figure 18:
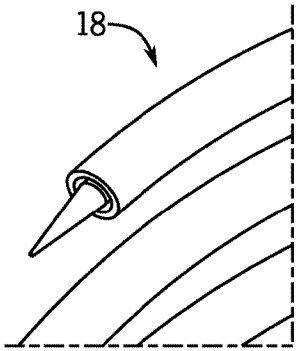
FIG. 18 is a partial perspective view of an embodiment of a low shear choke trim, in accordance with aspects of the present disclosure.
Figure 19:
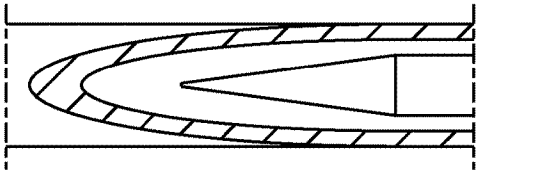
FIG. 19 is a partial cross-sectional view of an embodiment of a low shear choke trim, in accordance with aspects of the present disclosure.
Figure 20:
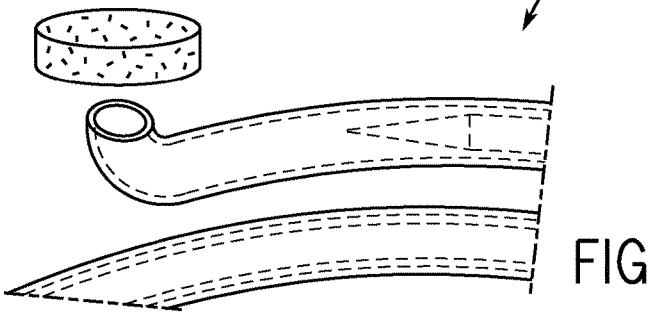
FIG. 20 is a partial perspective view of an embodiment of a low shear choke trim, in accordance with aspects of the present disclosure.
Figure 16:
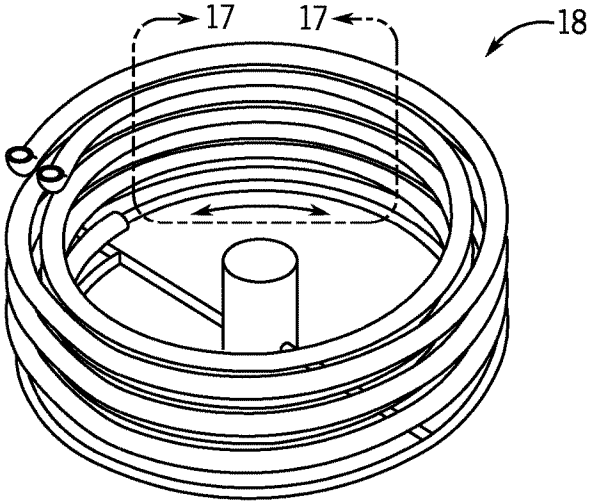
FIG. 16 is a perspective view of an embodiment of a low shear choke trim, in accordance with aspects of the present disclosure.
Figure 17:
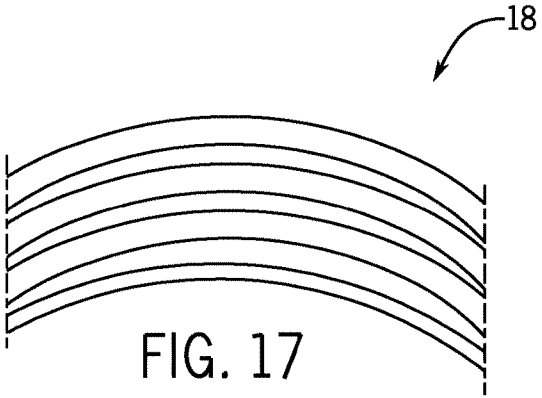
FIG. 17 is a partial perspective view of an embodiment of a low shear choke trim, in accordance with aspects of the present disclosure.

FIGS. 16-20 illustrate another embodiment of the choke trim. As shown in FIG. 16, the choke trim includes a plurality of spiral tubes through which a fluid, such as a polymer, may flow. As further shown, each spiral tube has a spiral rod disposed therein. The position of each rod within its respective spiral tube is adjustable by a wheel or shaft coupled to each spiral rod. As will be appreciated, the spiral rod disposed within the spiral tube creates an annulus through which a polymer or fluid may flow. As shown in FIG. 16, the position of the spiral rod within the spiral tube may be adjusted, such that the spiral tube has a portion where the spiral rod is positioned and a portion where the spiral rod is not positioned. When the polymer flows through a portion of the spiral tube where the spiral rod is positioned (e.g., when the polymer flows through the annulus between the spiral rod and spiral tube), a pressure drop may be realized or achieved. When the polymer flows through a portion of the spiral tube where the spiral rod is not positioned, the polymer may not flow through the annulus and the polymer may not achieve a pressure drop (e.g., due to insufficient frictional losses when flowing through the empty spiral tube). FIGS. 18 and 19 show partial views of a spiral tube with a spiral rod disposed therein. As shown, the spiral rod has a needle nose configuration, which may allow for gradual increase of polymer flow through the spiral tube when the polymer flows from a portion of the spiral tube without the spiral rod to a portion of the spiral tube with the spiral rod. For example, the needle nose configuration may reduce overall acceleration of the polymer flow, and thereby reduce degradation of the polymer. Furthermore, FIG. 20 illustrates a partial view of a spiral tube and spiral rod of the choke trim. As shown, the spiral tube includes a curved or arcuate inlet to improve flow of the polymer as the polymer enters the spiral tube. For example, the arcuate inlet may reduce acceleration of the polymer flow. Furthermore, FIG. 20 illustrates a cap which may be placed over the inlet of the spiral tube. As mentioned above, the choke trim may include a plurality of spiral tubes. As such, the total cross-sectional flow area of the choke trim may be adjusted by covering and/or uncovering a desired number of spiral tubes with respective caps.

Figure 21:
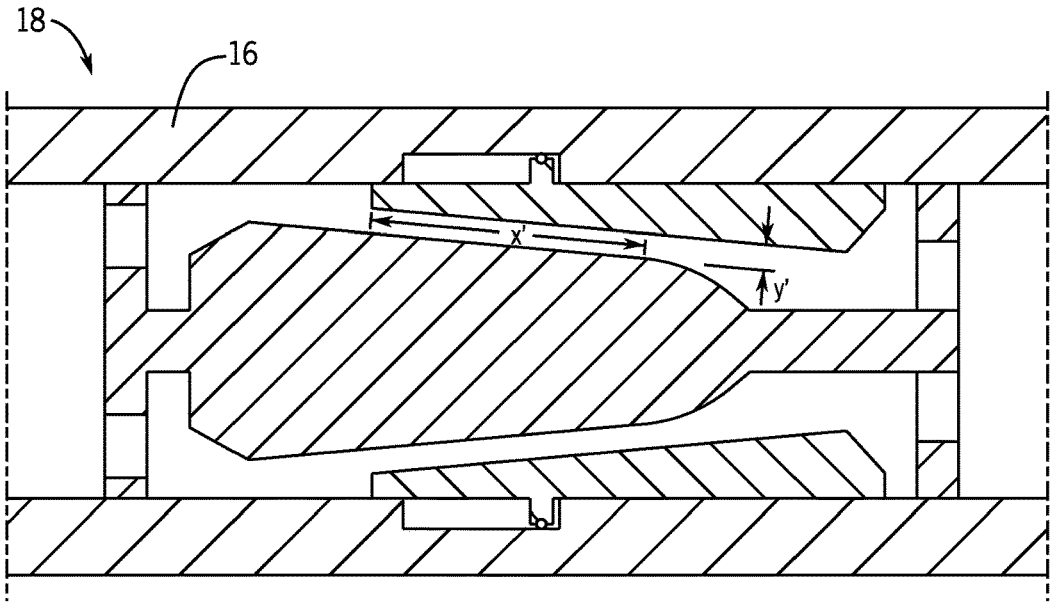
FIG. 21 is a schematic side view of an embodiment of a low shear choke trim, in accordance with aspects of the present disclosure.

FIG. 21 illustrates another embodiment of the choke trim 18. In the illustrated embodiment, the choke trim includes a central, stationary wedge body positioned within a case or tube. The inner diameter of the case also includes adjustable side wedge members positioned about the wedge body. Specifically, the adjustable side wedge members may be moved to adjust a flow path between the side wedge members and the wedge body. For example, the side wedge members may be adjusted by a mechanical or hydraulic mechanism. When the wedge members are adjusted, the length and/or the area of the flow path may be adjusted, depending on the geometries of the side wedge members and the central wedge body.

Figure 22:
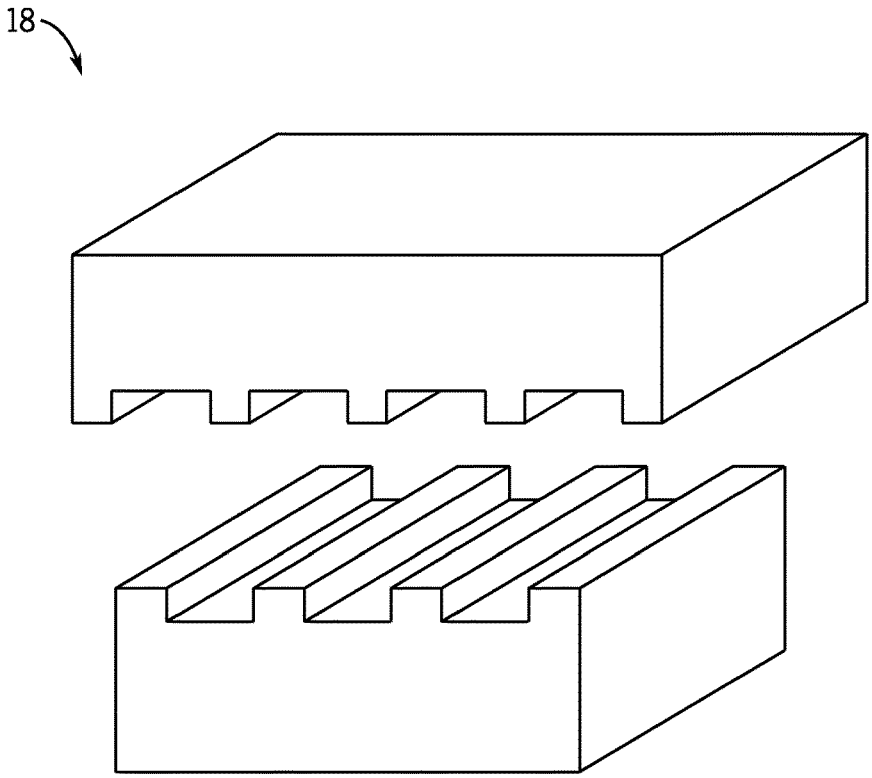
FIG. 22 is a partial perspective view of an embodiment of a low shear choke trim, in accordance with aspects of the present disclosure.
Figure 23:
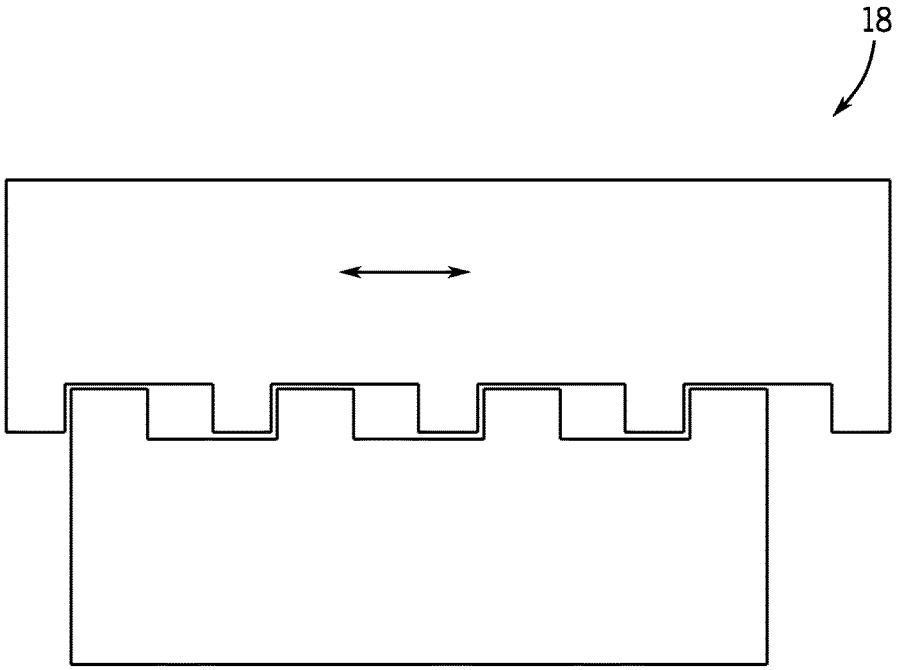
FIG. 23 is a schematic axial view of an embodiment of a low shear choke trim, in accordance with aspects of the present disclosure.
Figure 24:
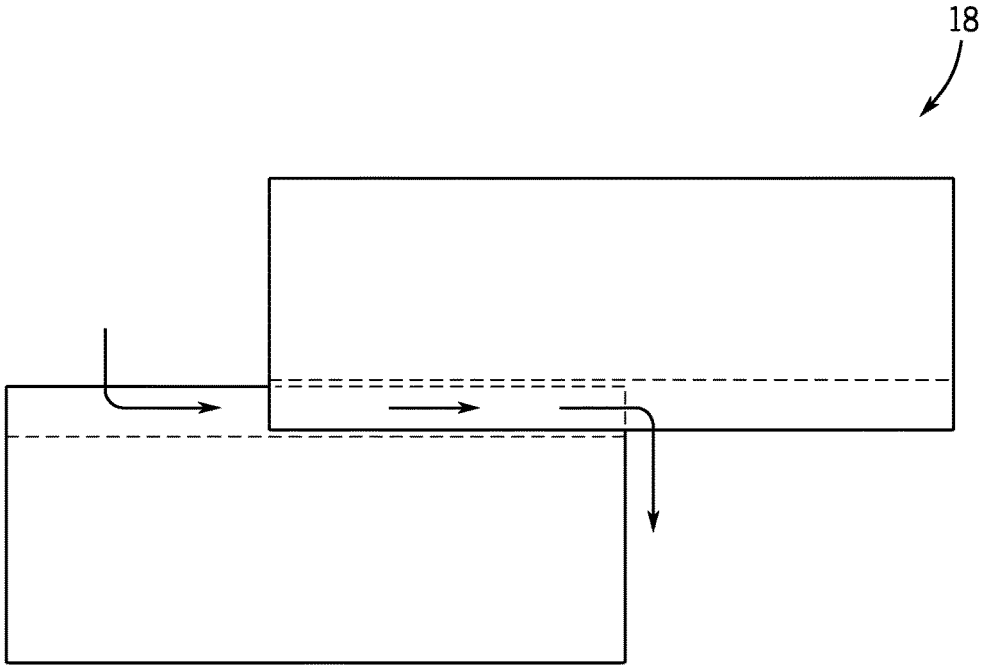
FIG. 24 is a schematic side view of an embodiment of a low shear choke trim, in accordance with aspects of the present disclosure.

FIGS. 22-24 illustrate another embodiment of the choke trim 18. In the illustrated embodiment, the choke trim includes two slotted plates or bars which may be moved relative to one another. As shown in FIG. 22, each slotted plate includes slots and teeth which are configured to engage with the respective slots and teeth of the other slotted plate to form flow paths between the teeth and slots. Adjustment of the respective positions of the slotted plates relative to one another may enable adjustment of the length and or cross-sectional area of the flow paths between the plates. For example, FIG. 23 is an axial view of the slotted plates, where the respective slots and teeth of the two plates are engaged with one another. As shown, the respective horizontal positions of the two plates may be adjusted to adjust the cross-sectional area of the flow paths between the two slotted plates. Similarly, as shown in FIG. 24, the respective axial positioned of the two plates may be adjusted to adjust the flow path length of the choke trim.

Figure 25:
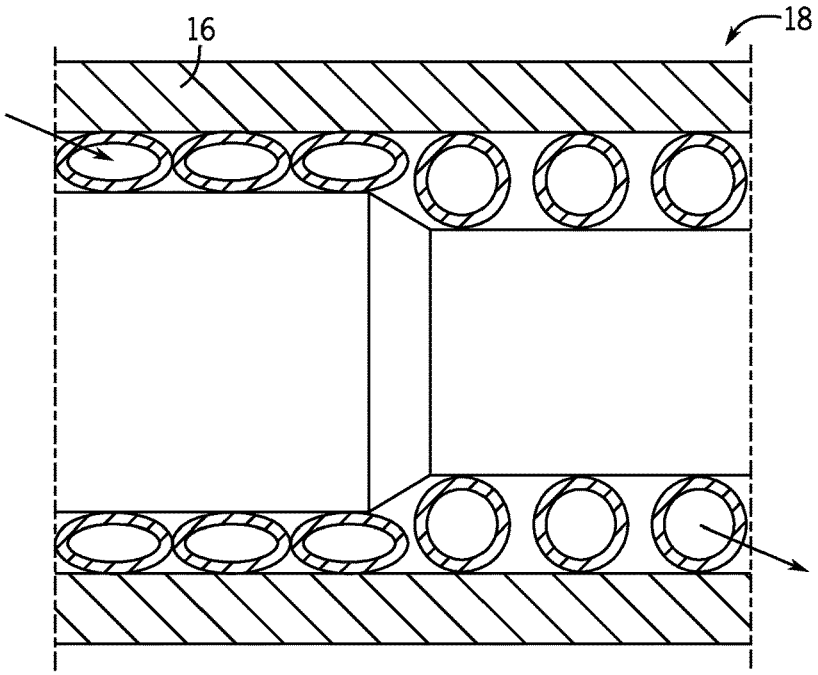
FIG. 25 is a schematic of an embodiment of a low shear choke trim, in accordance with aspects of the present disclosure.

FIG. 25 illustrates another embodiment of the choke trim 18. In the illustrated embodiment, the choke trim 18 includes an adjustable tubing, through which polymer may flow, coiled about a moveable piston or other central body. As shown, the piston has a varying external diameter, which engages with the adjustable tubing. The piston may be moved to engage with the adjustable tubing and compress the adjustable tubing, thereby decreasing the cross-sectional flow area of the tubing (and thus the flow path). Additionally, in certain embodiments, tubing may be added or removed to vary the length of the flow path of the choke trim. The flow path may have a gradual tapered section at the inlet to allow for reduction in overall fluid acceleration and hence reduce polymer degradation similar to previous embodiments. The tapered section of the flow path may extend over a certain length of the flow path, such as 20 to 90 percent of a length of the flow path, and the remaining section of the flow path may be of uniform cross-section.

Figure 27:
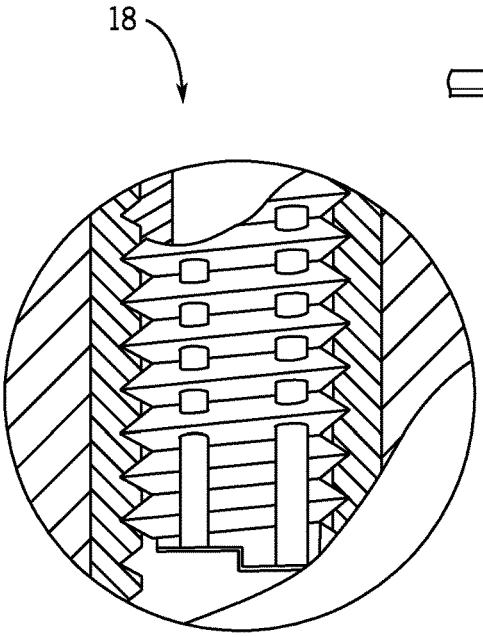
FIG. 27 is a partial cross-sectional side view of an embodiment of a low shear choke trim, in accordance with aspects of the present disclosure.
Figure 26:
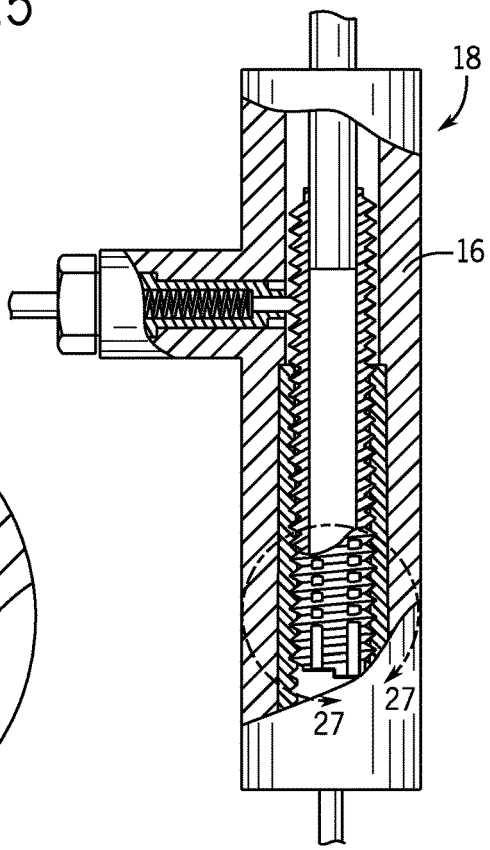
FIG. 26 is a cross-sectional side view of an embodiment of a low shear choke trim, in accordance with aspects of the present disclosure.

FIGS. 26 and 27 illustrate another embodiment of the choke trim 18, which is configured to vary the length of a flow path of the choke trim. In the illustrated embodiment, the choke trim includes a nut in threaded engagement with a bolt or screw. The amount of threaded engagement between the nut and bolt may be adjusted to adjust the length of the flow path of the choke trim. More specifically, as shown in FIG. 27, the flow path may be defined by a groove between the bolt and the nut. Therefore, the longer the portion on the bolt that is threaded with the nut, the longer the flow path of the polymer.

Figure 28:
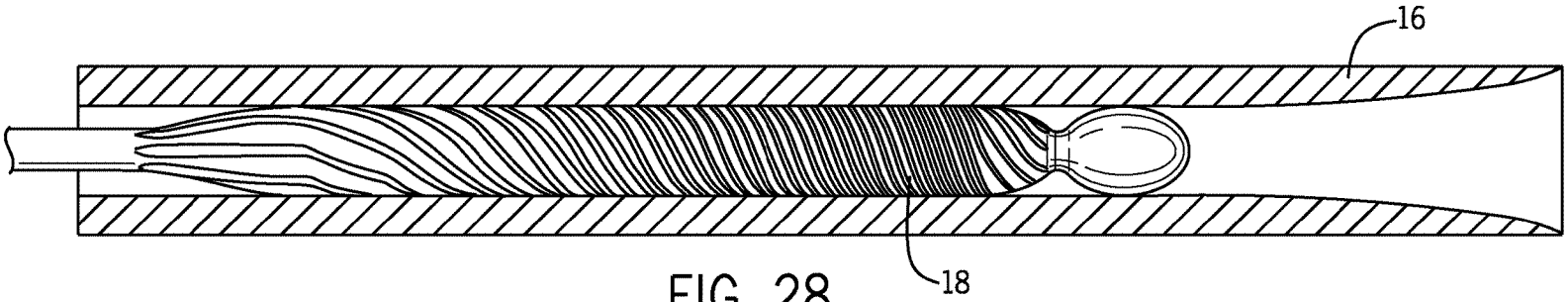
FIG. 28 is a cross-sectional side view of an embodiment of a low shear choke trim, in accordance with aspects of the present disclosure.

FIG. 28 illustrates another embodiment of the choke trim 18, which is configured to vary the length of a flow path of the choke trim. The illustrated embodiment includes a threaded rod disposed within a tube or other body with a central passage. The grooves or threads formed in the threaded rod define the flow path of the polymer. The length or amount of the threaded rod that is disposed within the tube may be adjusted to adjust the total length of the flow path of the choke trim. For example, the illustrated embodiment shows the entire threaded rod disposed within the tube, thereby producing a flow path with a maximum length.

Figure 29:
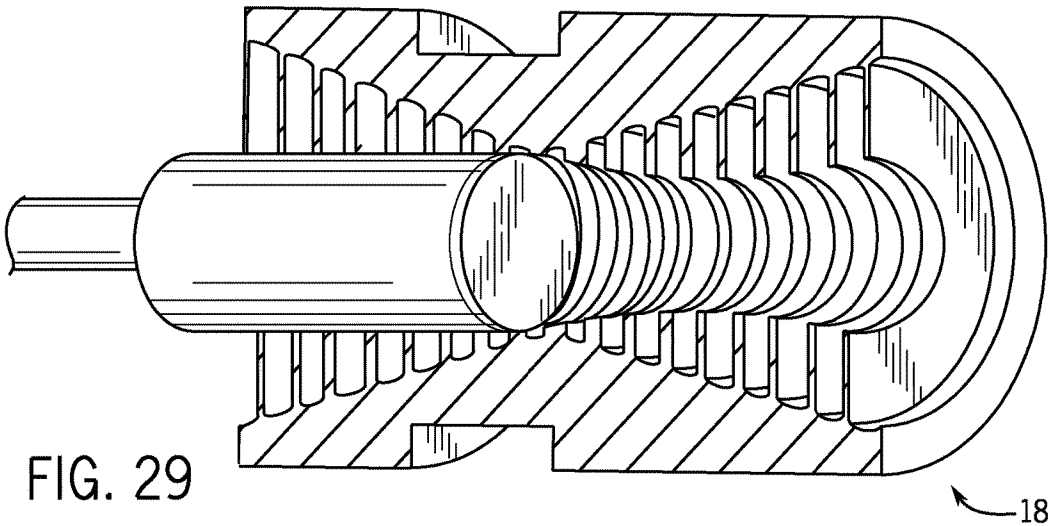
FIG. 29 is a cross-sectional perspective view of an embodiment of a low shear choke trim, in accordance with aspects of the present disclosure.

FIG. 29 illustrates another embodiment of the choke trim 18, which is configured to vary the length of a flow path of the choke trim. The illustrated embodiment includes a cylindrical body having a central passage with a plurality of radial slots cooperatively forming a spiral (e.g., helical) flow passage through the cylindrical body. The choke trim also includes a central plunger that may be positioned within the central passage. The position of the central plunger within the cylindrical body may be adjusted to adjust the length of the flow path. More specifically, the portion of the cylindrical body where the plunger is positioned within the central passage is the portion where the flow path is defined. In that portion, the polymer may flow about the central plunger and through the spiral (e.g., helical) passages formed by the radial slots of the cylindrical body.

Figure 30:
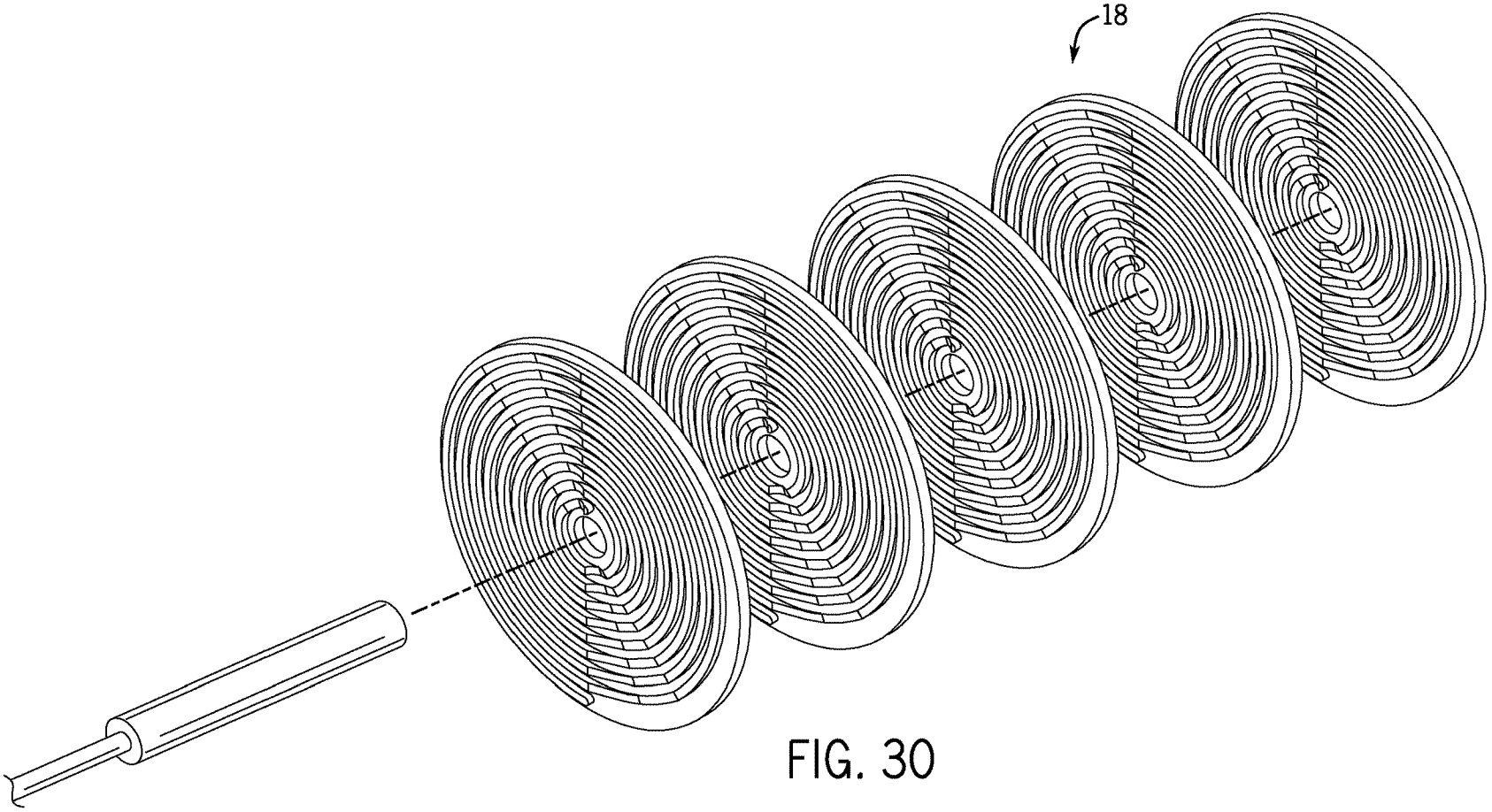
FIG. 30 is an exploded perspective view of an embodiment of a low shear choke trim, in accordance with aspects of the present disclosure.
Figure 31:
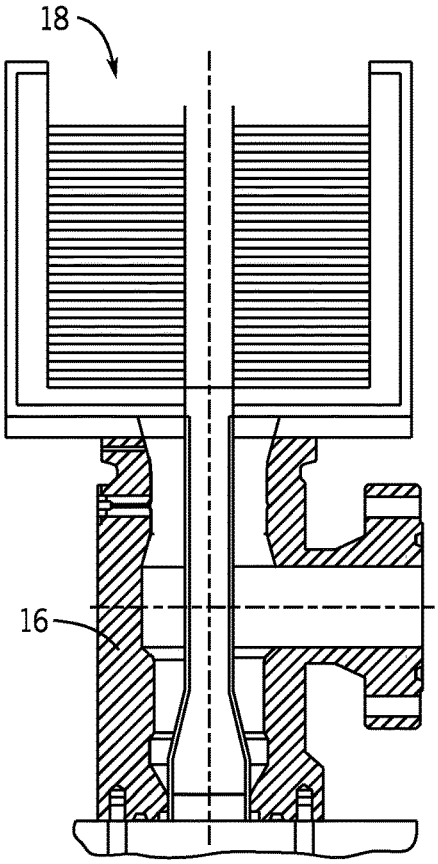
FIG. 31 is a cross-sectional schematic of an embodiment of a low shear choke trim, in accordance with aspects of the present disclosure.

FIG. 30 illustrates another embodiment of the choke trim 18, which is configured to vary the length of a flow path of the choke trim. The illustrated embodiment includes a plurality of plates, each having one or more spiral grooves formed therein to define a flow path. Each plate also includes flow ports at a center and a perimeter of the respective plate that are configured to communicate with respective ports of adjacent plates. To adjust the total length of the flow path, a central plunger may be disposed within a central opening of the plates. To increase the length of the flow path, the central plunger may be disposed fully in the central passage of each plate to force the polymer to flow through all the spiral grooves of each plate. To reduce the length of the flow path, the plunger may be removed from the central openings as desired to allow the polymer to enter the central openings and flow out of the choke trim. As shown in FIG. 31, multiple plates may be stacked on top of one another and positioned outside of the choke 16. At the inlet of each flow path, the flow path may be gradually tapered to allow for gradual acceleration of fluid and hence reduce polymer degradation. The tapered section of the flow path may extend over a certain length of the flow path, such as 20 to 90 percent of a length of the flow path. The cross-section of the remaining part of the flow path may remain uniform.

Figure 32:
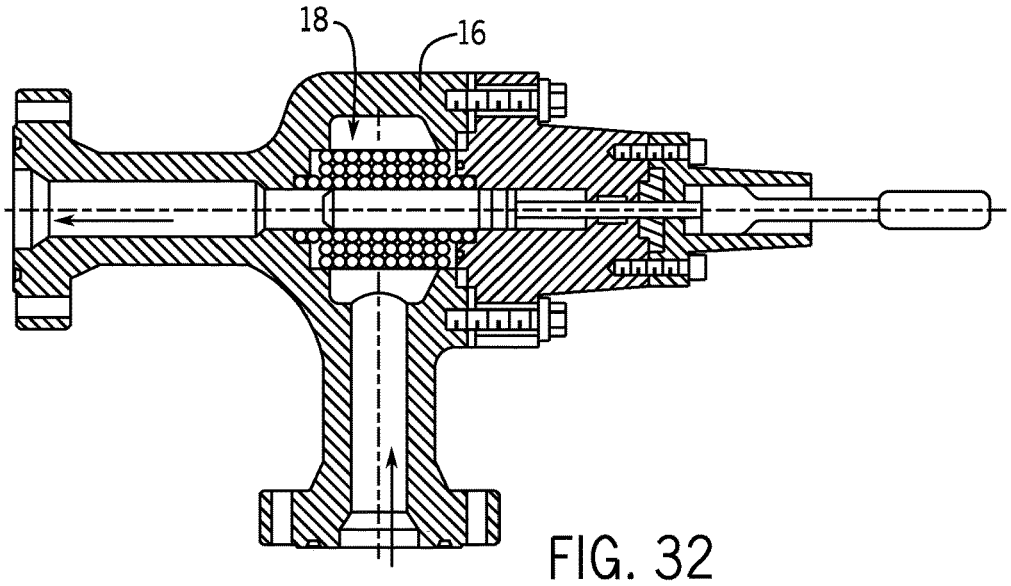
FIG. 32 is a cross-sectional schematic of an embodiment of a low shear choke trim, in accordance with aspects of the present disclosure.

FIG. 32 illustrates another embodiment of the choke trim, which includes a porous element. Specifically, the porous element of the choke trim may be positioned within the choke, and the polymer may be forced through small openings or pores of the porous element. The porous characteristics of the choke trim may be adjusted by adjusting the materials and/or processes used to form the porous element. For example, in certain embodiments, the porous element may be formed by sintering metal or ceramic powders or particles together. The size of the powders or particles may be selected to produce a porous element having pores or openings of a desired size.

Figure 33:
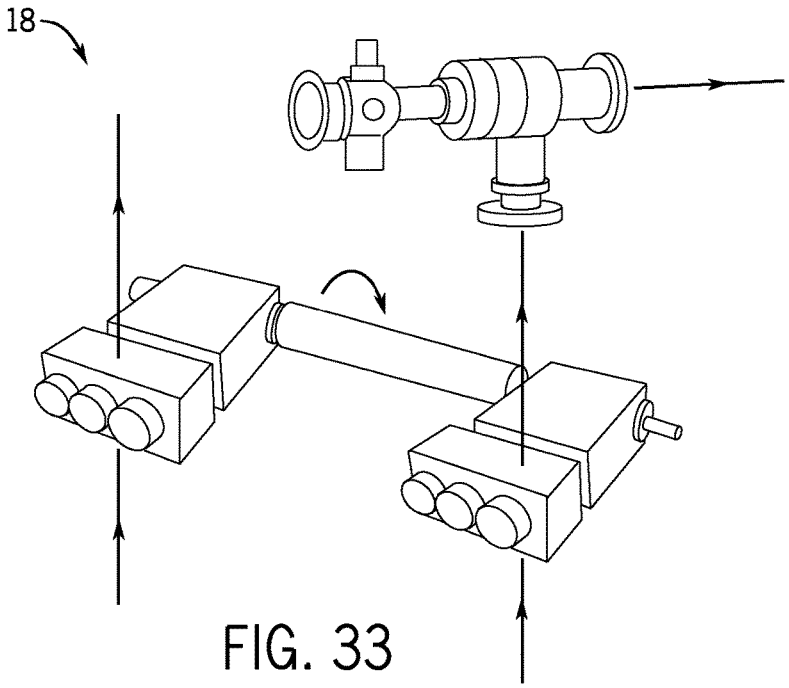
FIG. 33 is a schematic of an embodiment of a low shear choke trim, in accordance with aspects of the present disclosure.
Figure 34:
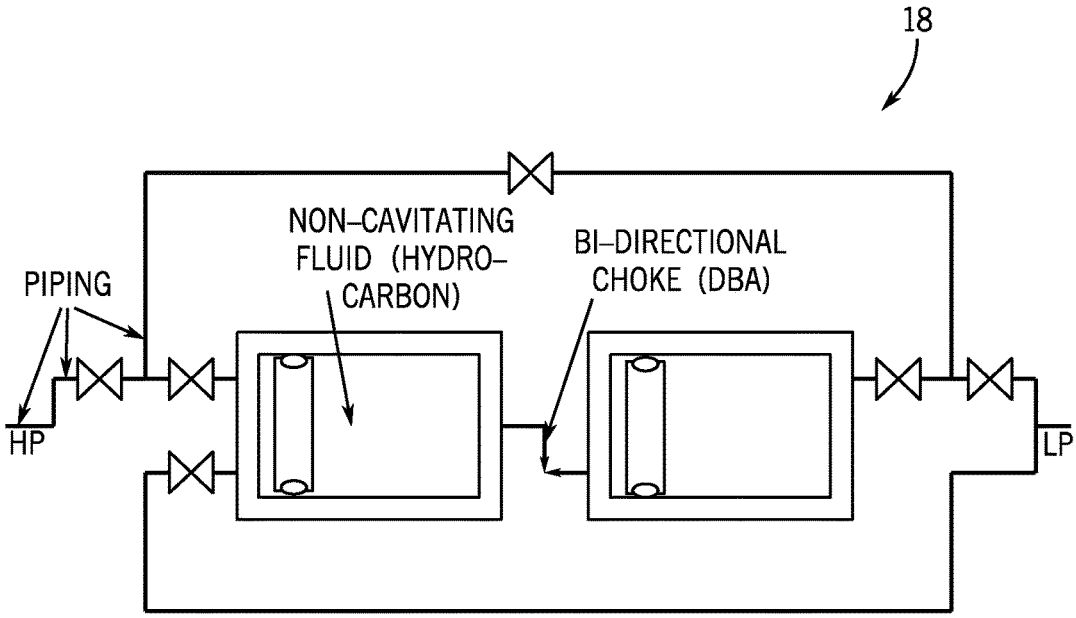
FIG. 34 is a schematic of an embodiment of a low shear choke trim, in accordance with aspects of the present disclosure.

FIG. 33 is an embodiment of a system configured to reduce shear forces on a polymer or other fluid for injection into a well bore and mineral formation. In the illustrated embodiment, the system includes two positive displacement pumps coupled to one another by a rotating shaft. One of the pumps flows a polymer with a differential pressure across the pump. The polymer flowing through the pump drives the pump, which further drives the second pump coupled to the first pump. The second pump pumps a sacrificial fluid, such as sea water, through a control choke. As will be appreciated, by controlling the control choke (e.g., controlling the sea water flowing through the control choke), the system may function as a liquid pump brake, thereby enabling the polymer to enter the first pump at a high pressure and exit the first pump at a low pressure. By controlling the control choke, the pressure differential of the polymer across the first pump may be regulated, and polymer degradation may be reduced.

Figure 35:
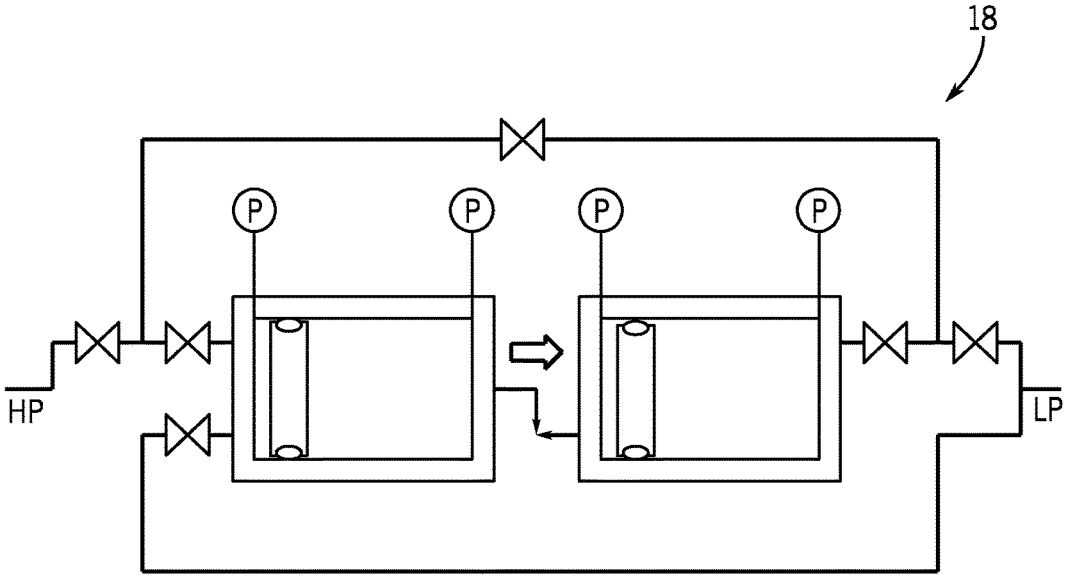
FIG. 35 is a schematic of an embodiment of a low shear choke trim, in accordance with aspects of the present disclosure.
Figure 36:
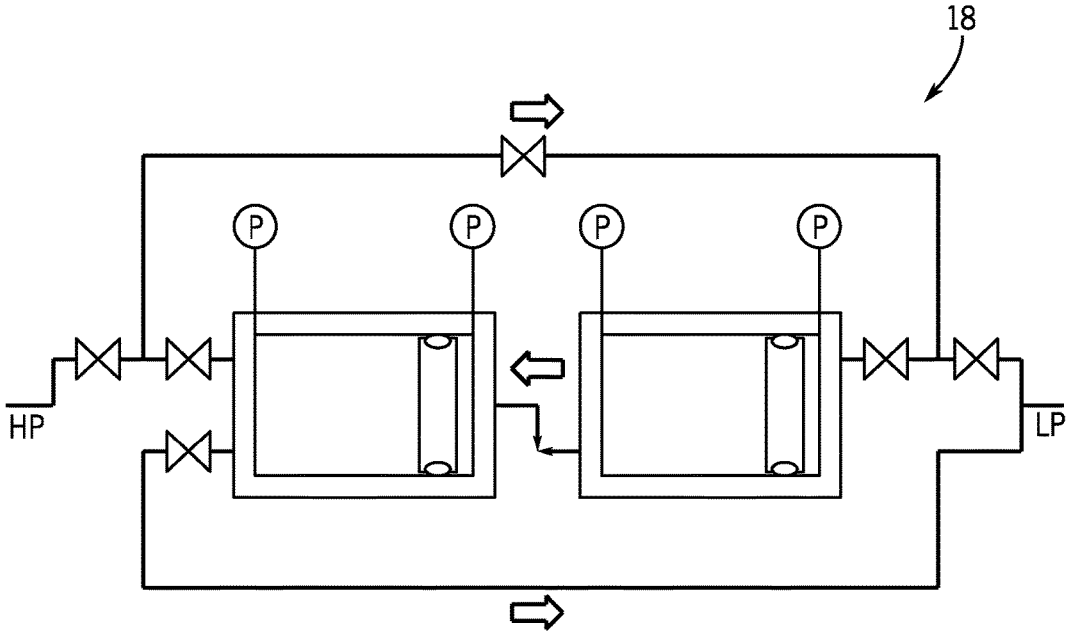
FIG. 36 is a schematic of an embodiment of a low shear choke trim, in accordance with aspects of the present disclosure.

FIGS. 34-37 illustrate an embodiment of a system configured to reduce shear forces on a polymer or other fluid for injection into a well bore and mineral formation. Specifically, the embodiment illustrated in FIG. 34 includes two hydraulic pistons or cylinders configured to effectuate a pressure drop in a polymer or other fluid flowing through the system. As shown in FIG. 35, high pressure fluid (e.g., polymer) may enter a first hydraulic cylinder having hydraulic fluid on an opposite side of a piston of the cylinder. As the first hydraulic cylinder fills with polymer, the hydraulic fluid in the first hydraulic cylinder is forced through a bidirectional choke valve into a second hydraulic cylinder. When the first hydraulic cylinder is filled with polymer, various valves may open and/or close to direct the polymer to the second hydraulic cylinder on a side of a piston opposite the hydraulic fluid, as shown in FIG. 36. As the second hydraulic cylinder is filled with polymer, the piston of the second hydraulic cylinder forces the hydraulic fluid back across the bidirectional choke valve and into the first hydraulic cylinder. As will be appreciated, the bidirectional choke valve may enable a pressure drop of the hydraulic fluid, which may be transferred to the polymer within the first hydraulic piston. As such, when the hydraulic fluid is forced into the first hydraulic cylinder, the polymer within the first hydraulic cylinder may be forced out at a lower pressure by the piston of the first hydraulic cylinder, as shown in FIG. 36. In this manner, the system may reduce the pressure of the polymer. Once the second hydraulic cylinder is filled with polymer, various valves may open and/or close to enable the polymer to be pumped into the first hydraulic cylinder again, and the process described above may be repeated, as shown in FIG. 37.

FIGS. 38-42 illustrate systems and components of a magnetic resistance fluid brake system, which may function to enable a pressure drop in a fluid (e.g., a polymer) prior to injection into a choke, well bore, or well formation. For example, FIG. 38 illustrates a flow tube with a recirculation circuit having a plurality of metallic spheres circulating therethrough. Specifically, the metallic spheres (e.g., aluminum or steel balls) flow partially through the flow tube and are then recirculated through the recirculation circuit. The flow tube also has a plurality of magnets (or coils) arranged about an outer diameter of the flow tube. For example, the plurality of magnets may be arranged in a Halbach array. In operation, the metallic spheres experience drag due to electromagnetic induction, which causes the spheres to heat up. As the spheres heat up, heat is transferred to the polymer flowing through the flow tube, which causes a pressure drop in the polymer. Additionally, the drag on the spheres may cause the flow of the polymer to slow down and/or drop in pressure. The system may include other features to enable improved operation. For example, the flow tube may include venturi contours to enable suction of the spheres from the recirculation circuit into the flow tube. Additionally, the spheres may have a diameter smaller than the flow tube and recirculation circuit to enable uninhibited movement of the spheres through the polymer. For example, the diameter of the spheres may be approximately 5 to 95, 10 to 90, 15 to 85, 20 to 80, 30 to 70, 40 to 60, or 50 percent of a diameter of the flow tube. The diameter of the spheres may be uniform or variable among the plurality of spheres. For example, the spheres may include a distribution of sphere diameters, wherein the larger spheres may be approximately 1.1 to 10 times the diameter of the smaller spheres. In certain embodiments, the spheres may be replaced or supplemented with particles or discrete structures of other shapes, such as oval, cubic, or randomly shaped structures.

Figure 39:
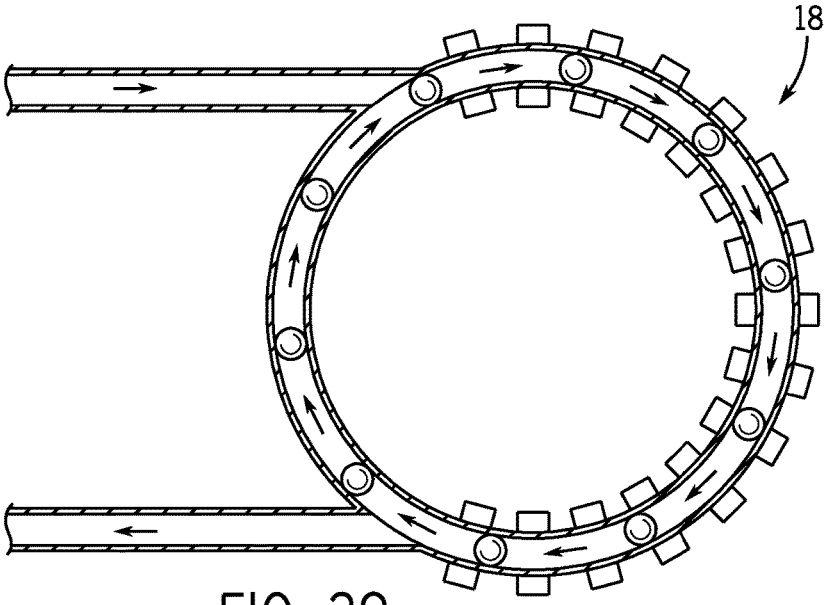
FIG. 39 is a schematic of an embodiment of a low shear choke trim, in accordance with aspects of the present disclosure.

FIG. 39 illustrates another embodiment of a magnetic resistance fluid brake system. In the embodiment shown in FIG. 39, polymer flows through an inlet line into a magnetic resistance fluid brake circuit. The brake circuit has a plurality of magnets or coils disposed about the brake circuit to cause the metallic spheres to heat up, and the heat may be transferred to the polymer to effectuate a pressure drop in the polymer. After the polymer flows through the brake circuit, the polymer may exit the brake circuit through an outlet line. As will be appreciated, the inlet line and the outlet line may have a smaller diameter than the metallic spheres to retain the metallic spheres within the brake circuit and block the metallic spheres from entering the inlet line and/or the outlet line.

Figure 40:
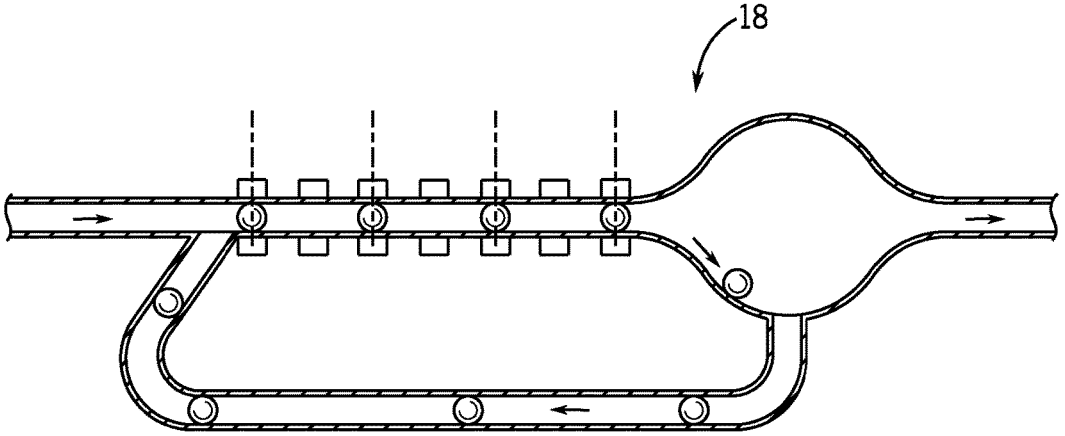
FIG. 40 is a schematic of an embodiment of a low shear choke trim, in accordance with aspects of the present disclosure.

FIG. 40 illustrates another embodiment of a magnetic resistance fluid brake system. In FIG. 40, the system includes similar components as the embodiment shown in FIG. 38 (e.g., flow line, recirculation circuit, magnets, etc.). Additionally, the flow line in the illustrated embodiment includes an enlarged cavity downstream of the magnets. In certain embodiments, the enlarged cavity may enable further control of the pressure of the polymer flowing through the system. For example, the enlarged cavity may enable control or stabilization of a pressure drop in the polymer.

Figure 41:
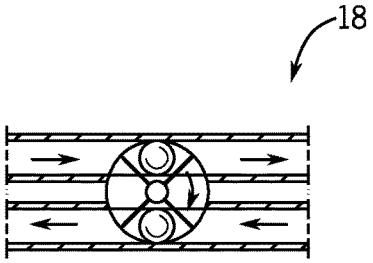
FIG. 41 is a schematic of a portion of an embodiment of a low shear choke trim, in accordance with aspects of the present disclosure.
Figure 42:
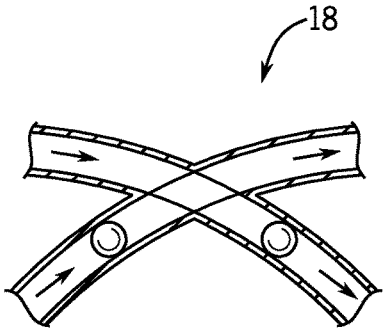
FIG. 42 is a schematic of a portion of an embodiment of a low shear choke trim, in accordance with aspects of the present disclosure.

FIGS. 41 and 42 illustrate various components or features that may be included in the magnetic resistance fluid brake system. For example, FIG. 41 illustrates a ball exchange wheel (e.g., sphere exchange wheel for the metallic spheres) that engages with two parallel flow lines that may flow polymer or other fluid. The exchange wheel may improve or regulate the rate at which the spheres flow through the flow lines to help keep the spheres from collecting together. Another embodiment of an exchange wheel is shown in FIG.

42. In the embodiment of FIG. 42, the exchange wheel exchanges spheres flowing through two flow lines that cross with one another.

Figure 43:
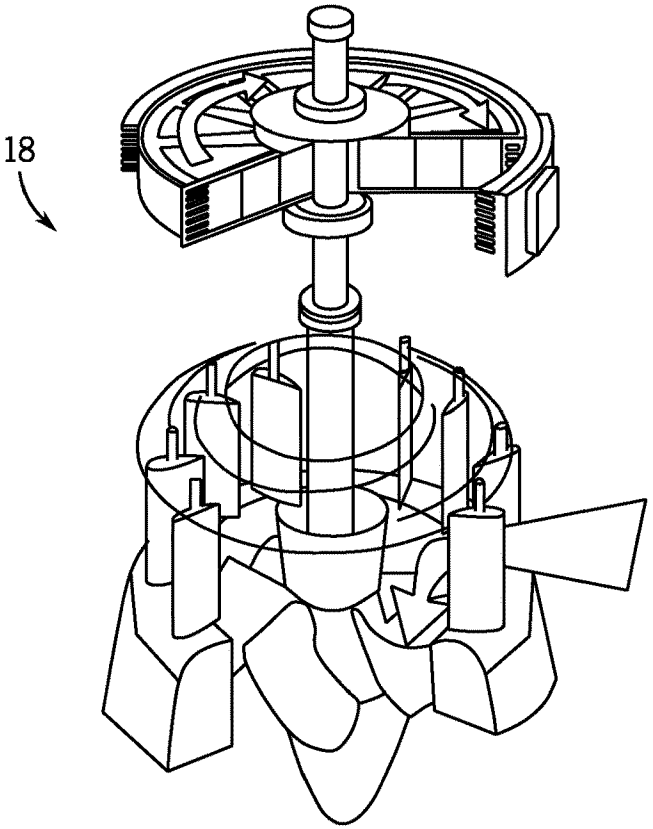
FIG. 43 is a perspective view of an embodiment of a low shear choke trim, in accordance with aspects of the present disclosure.

FIG. 43 illustrates an embodiment of system configured enable control of a flow rate and pressure drop of a fluid (e.g., polymer) flowing through the system. Specifically, the system of FIG. 43 includes a positive displacement pump combined with a brake to provide flow rate and injection pressure control of a fluid flowing through the pump. In certain embodiments, the brake may dissipate energy through heat and/or friction or the brake may be coupled to a generator that may generate power for other systems, such as subsea systems associated with mineral production.

Figure 44:
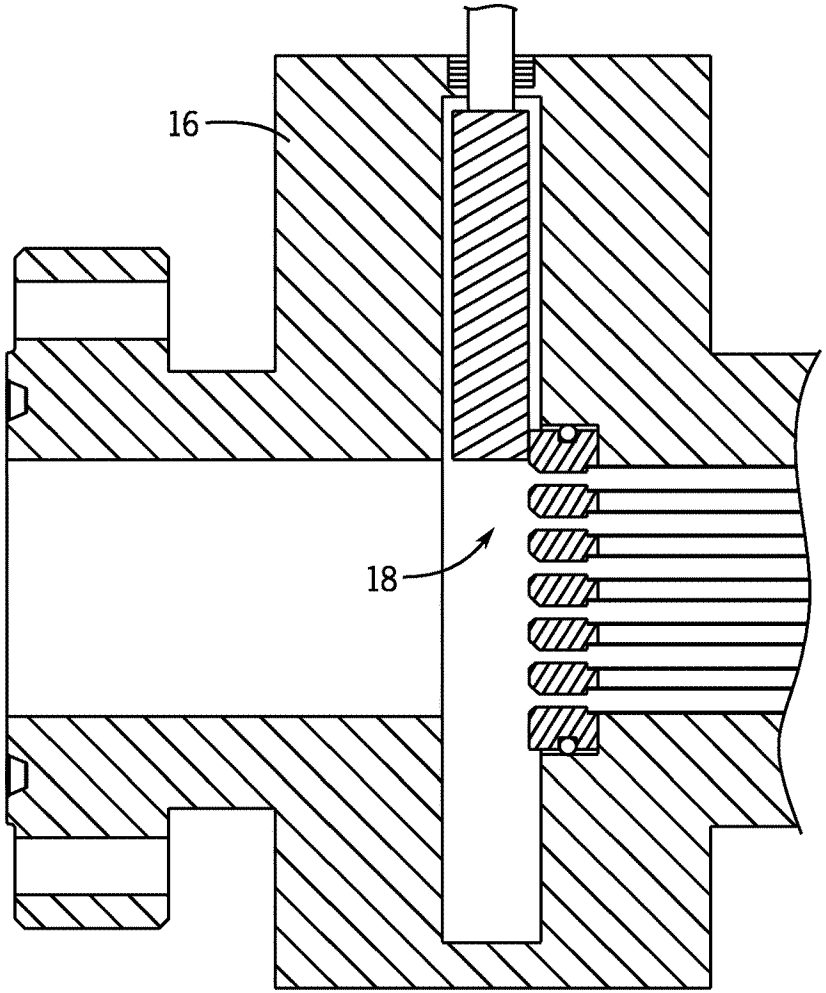
FIG. 44 is a schematic side view of an embodiment of a low shear choke trim, in accordance with aspects of the present disclosure.

FIG. 44 illustrates another embodiment of a choke trim, which may be used to vary the cross-sectional area of a flow path of a choke flowing a fluid, such as polymer. In the illustrated embodiment, the choke trim includes a multi-ported seat positioned within the choke. The multi-ported seat defines a plurality of flow paths in the choke through which polymer may flow. At the entrance section of each individual flow path, the cross-sectional area of the flow path is gradually tapered down (reduced) to allow for gradual acceleration of fluid flow (e.g., polymer solution). This gradual reduction in flow path cross-section allows for reduction in overall polymer degradation. A part of the flow path may have a gradual reduction in cross-section area and the remaining part may be of uniform cross-section. To adjust the total cross-sectional area of the flow path through the choke trim, the choke includes a slab valve, which may be actuated by an actuator (e.g., a mechanical or hydraulic actuator). The slab valve may be positioned within the choke to block polymer flow through one or more of the ports or flow paths, thereby adjusting the total cross-sectional flow area of the choke trim. Other methods such as using a multiple orifice valve or individual on/off valves on each individual flow paths to selectively open and close different flow paths can be also used. The flow paths may be straight channels or spiral flow paths or other forms.

Figure 45:
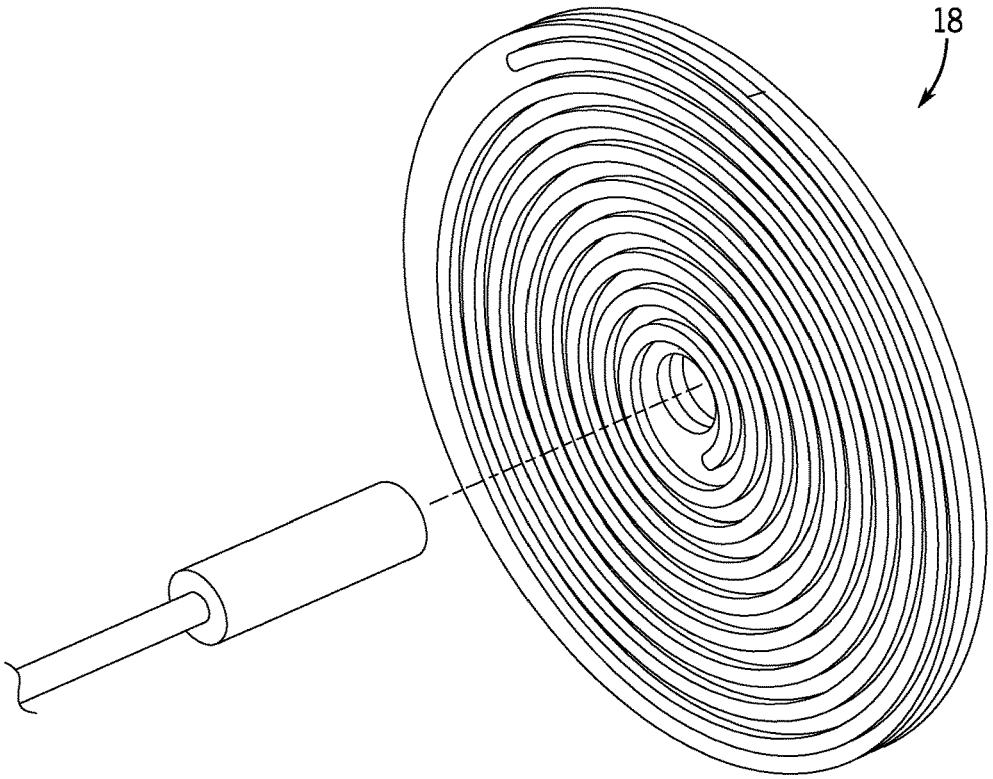
FIG. 45 is a perspective view of an embodiment of a low shear choke trim, in accordance with aspects of the present disclosure.

FIG. 45 is another embodiment of a choke trim, which may be configured to have an adjustable cross-sectional area of a flow path of the choke trim. In the illustrated embodiment, the choke trim includes a plate or disk having a plurality of spiral grooves formed in the plate. Each of the spiral grooves may have an inlet formed at an inner diameter of the plate and an outlet formed at an outer diameter of the plate or vice versa. Using a throttling element (e.g., a plunger) on the inner diameter or outer diameter, the number of flow paths (e.g., spiral grooves) that are open may be varied, thereby enabling adjustment of the total cross-sectional area of the flow path of the choke trim.

Figure 46:
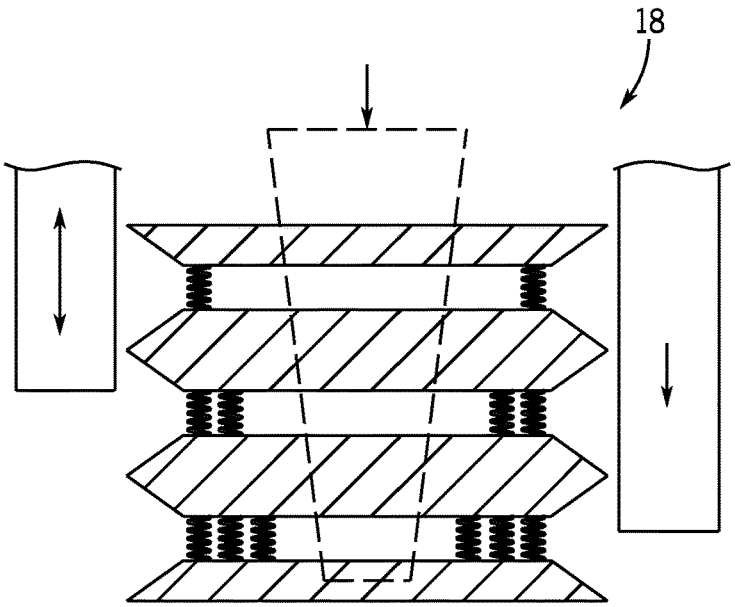
FIG. 46 is a schematic side view of an embodiment of a low shear choke trim, in accordance with aspects of the present disclosure.

FIG. 46 illustrates another embodiment of a choke trim, which may be configured to have an adjustable cross-sectional area of a flow path of the choke trim. In particular, the illustrated embodiment includes a stack of plates, which are separated and coupled to one another by springs. To adjust the cross-sectional area of the flow paths between the plates, weights may be positioned on top of the plates to compress the springs and reduce the gaps between the plates, thereby reducing the size (e.g., cross-sectional area) of the flow paths. In certain embodiments, an actuator or drive may be used to selectively compress the plates about the springs, thereby selectively reducing the gaps between the plates to reduce the size of the flow paths.

Figure 47:
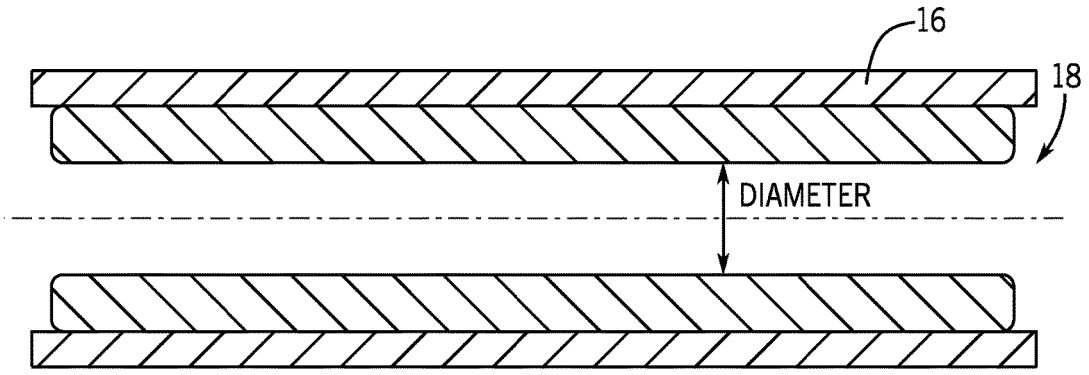
FIG. 47 is a schematic side view of an embodiment of a low shear choke trim, in accordance with aspects of the present disclosure.

FIG. 47 illustrates another embodiment of a choke trim, which may be configured to have an adjustable cross-sectional area of a flow path of the choke trim. Specifically, the illustrated embodiment includes a flow line (e.g., a jumper flow line) having a pressure filled annular bladder disposed within an interior of the flow line. The volume of the pressure filled bladder may be controlled via hydraulics to change an inner diameter of the bladder. In this manner, the cross-sectional area of the flow line (e.g., the flow path of the choke trim) may be adjusted.

Figure 48:
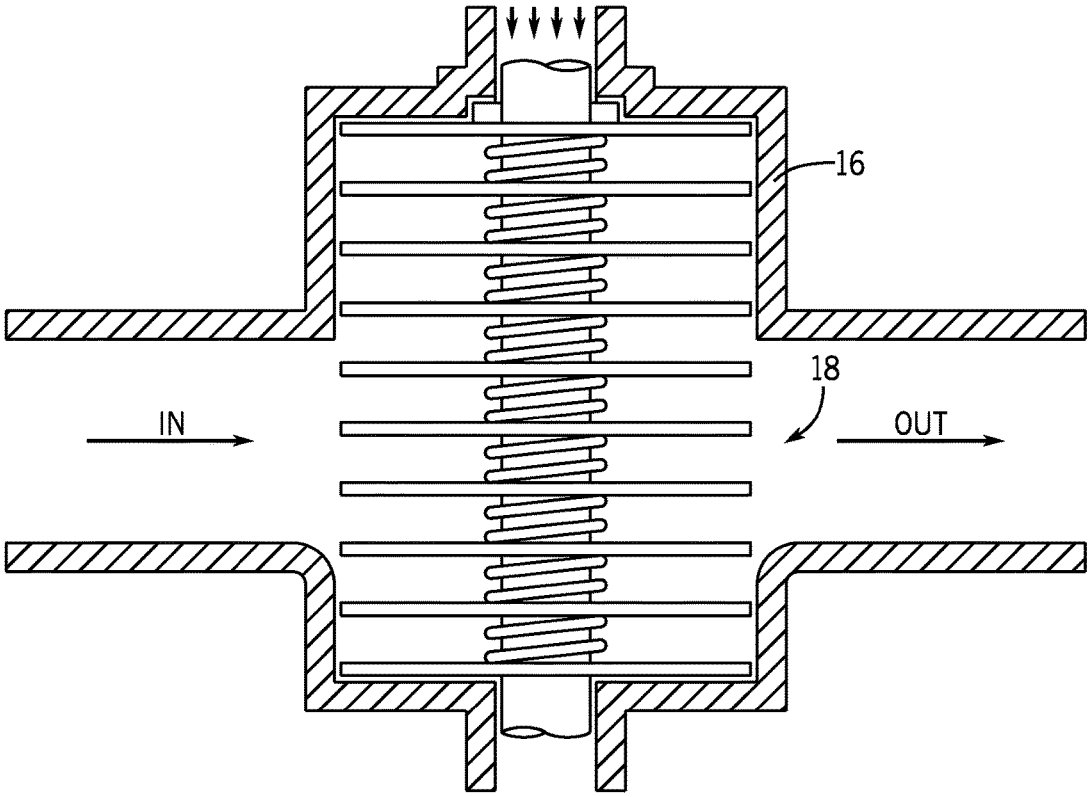
FIG. 48 is a schematic side view of an embodiment of a low shear choke trim, in accordance with aspects of the present disclosure.

FIG. 48 illustrates another embodiment of a choke trim, which may be configured to have an adjustable cross-sectional area of a flow path of the choke trim. In the illustrated embodiment, the choke trim includes a plurality of disks disposed about a shaft within the choke. Additionally, springs disposed about the shaft are positioned between each of the plates, causing the plates to be substantially evenly distributed within the flow path of the choke. To adjust the cross-sectional area of the flow path, the shaft may be actuated downward (e.g., mechanically or hydraulically), and a seat on an upper end of the shaft may engage with a top disk. As the shaft is actuated downward, the disks and the springs may compress toward one another to reduce the cross-sectional area of the flow paths between the disks, thereby reducing the total cross-sectional area of the flow path of the choke trim. The actuator used to compress the plates may include a hydraulic actuator, a pneumatic actuator, an electric actuator or drive, or any combination thereof.

Figure 50:
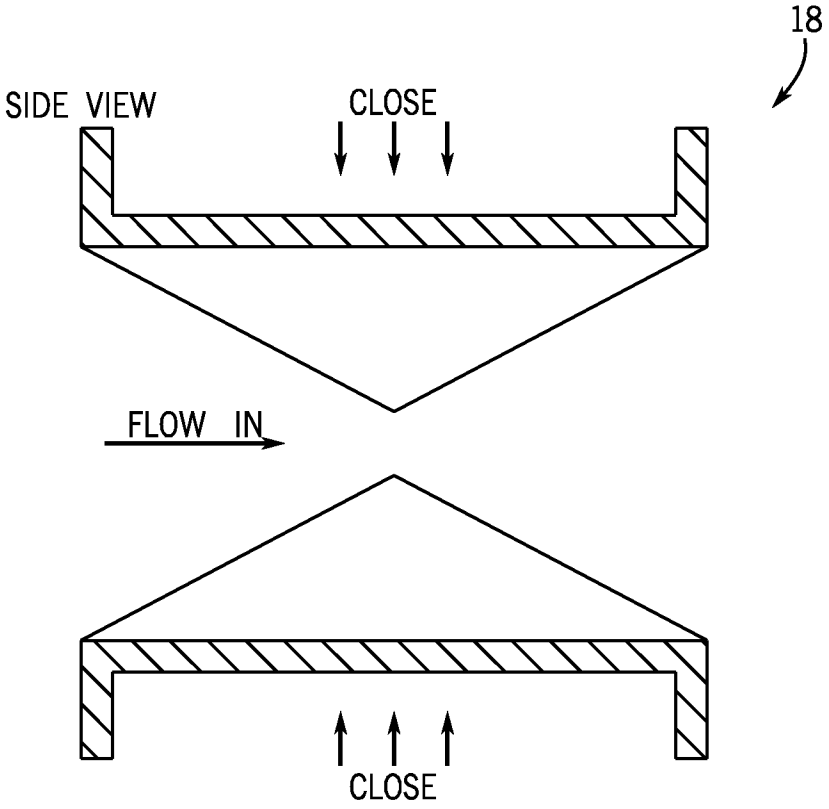
FIG. 50 is a schematic side view of an embodiment of a low shear choke trim, in accordance with aspects of the present disclosure.
Figure 49:
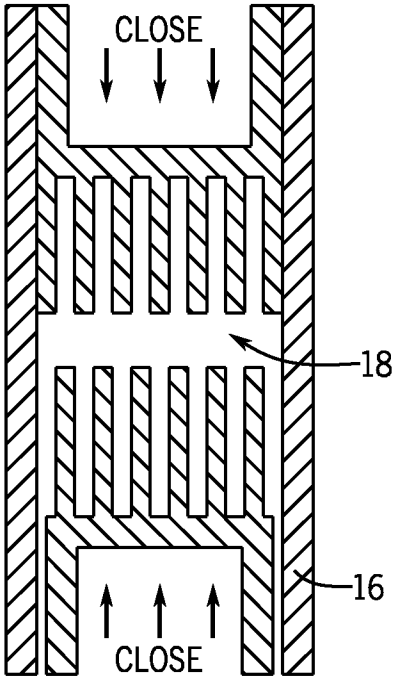
FIG. 49 is a schematic side view of an embodiment of a low shear choke trim, in accordance with aspects of the present disclosure.

FIGS. 49 and 50 illustrate another embodiment of a choke trim, which may be configured to have an adjustable cross-sectional area of a flow path of the choke trim. The illustrated embodiment includes a first set of teeth and a second set of teeth with a flow path therebetween. The two sets of teeth are configured to be biased towards one another and engage with one another to reduce the cross-sectional area of the flow path. For example, FIG. 50 shows a direction of flow through the sets of teeth.

Figure 51:
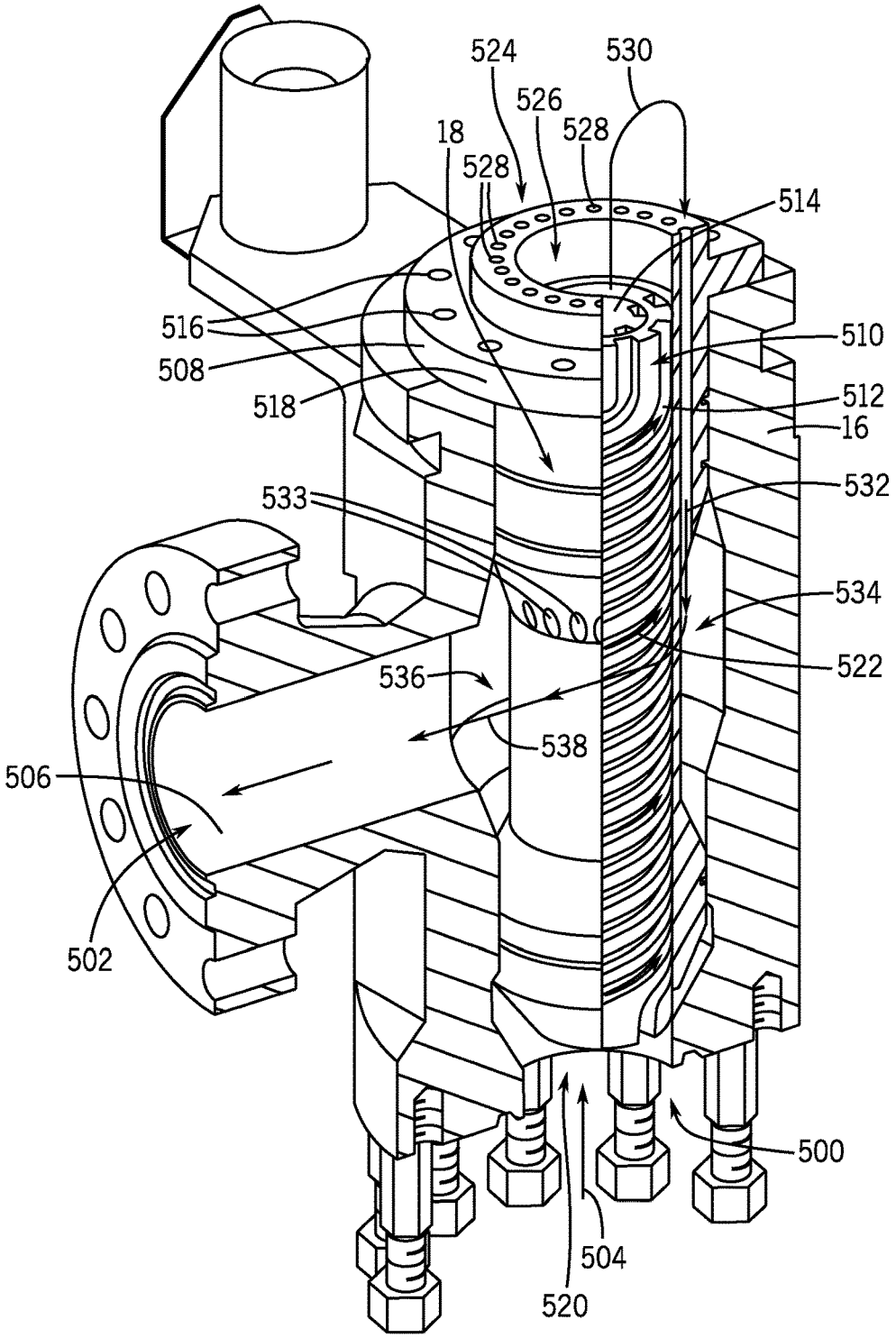
FIG. 51 is a partial cross-sectional perspective view of an embodiment of a low shear choke trim disposed within a choke body, in accordance with aspects of the present disclosure.

FIG. 51 is an embodiment of the low shear choke trim 18 disposed within the choke 16. The choke trim 18 is configured to reduce the overall acceleration (as compared to a standard choke) of a polymer or polymer solution (e.g., a fluid) flowing through the choke 16, thereby reducing degradation of the polymer or polymer solution as the polymer flows through the choke 16. Additionally, the illustrated embodiment of the choke trim 18 may be retrofitted into an existing choke 16 (e.g., an existing water injection choke body). As described in detail below, the illustrated choke trim 18 includes a plurality of spiral (e.g., helical) passages or flow paths, where each spiral passage has a gradual tapered cross-section. That is, the cross-section of each of the plurality of spiral passages may decrease along a length of the respective spiral passage. As a result, cumulative cross-sectional area of the choke trim 18 flow path (e.g., the sum of the cross-sections of the plurality of spiral passages) decreases along the length of the total flow path of the choke trim 18. The gradually decreasing overall cross-sectional area of the flow path of the choke trim 18 enables a reduction in the overall acceleration of a polymer or polymer solution (e.g., a fluid) flowing through the choke 16, which reduces degradation of the polymer or polymer solution as the polymer flows through the choke trim 18 and the choke 16. The cross-section of each flow path may be gradually tapered over the entire length or maybe over a certain length and the remaining flow path may have an uniform cross-section.

The choke 16 includes an inlet 500 and an outlet 502. Liquid (e.g., a polymer or polymer solution) enters the choke 16 through the inlet 500, as indicated by arrow 504, and subsequently flows through the choke trim 18 before exiting the choke 16 through the outlet 502, as indicated by arrow 506. The illustrated choke trim 18 includes an outer portion 508 and an inner portion 510, and the inner portion 510 has a first cylinder (e.g., pipe or tube) 512 and a second cylinder (e.g., pipe or tube) 514. The inner portion 510 of the choke trim 18 is positioned within the outer portion 508. Similarly, the second cylinder 514 of the inner portion 510 is positioned within the first cylinder 512 of the inner portion 510. In other words, the outer portion 508, the first cylinder 512, and the second cylinder 514 are all generally concentric and/or coaxial with one another. To secure the choke trim 18 within the choke 16 (e.g., the choke body), the outer portion 508 of the choke trim 18 may be secured to the choke 16. For example, fasteners (e.g., mechanical fasteners) may extend through apertures 516 formed in a flange 518 of the outer portion 508 to couple the choke trim 18 to the choke 16.

As mentioned above, a polymer or polymer solution enters the choke 16 through the inlet 500, as indicated by arrow 504. When the polymer flows through the inlet 500, the polymer will enter the choke trim 18 at a first axial end 520 of the choke trim 18. Specifically, the polymer enters spiral (e.g., helical) grooves, passages, or flow paths formed in the inner portion 510 of the choke trim 18. That is, the first cylinder 512 and the second cylinder 514 have spiral flow paths through which the polymer may flow. The polymer flows through the spiral flow paths, as indicated by arrow 522, from the first axial end 520 of the choke trim 18 to a second axial end 524 of the inner portion 510 of the choke trim 18. In certain embodiments, the choke 16 may include an actuator configured to selectively block or close one or more of the plurality of spiral flow paths. In this manner, the overall or total cross-sectional flow path area of the choke trim 18 may be controlled or adjusted, as desired. For example, a multiple orifice valve may be used to control the number of spiral flow paths exposed to a polymer or polymer solution flow. Alternatively, individual on/off valves can be used on each individual flow path to selectively open and close each flow paths. Additionally, as discussed below, a respective cross-section of each of the plurality of spiral flow paths may decrease along a length of the respective spiral flow path. The gradually decreasing overall cross-sectional area of each flow path of the choke trim 18 leads to gradual acceleration of polymer solution, which reduces overall shear and acceleration forces on the polymer solution and reduces degradation of the polymer as the polymer flows through the choke trim 18.

After the polymer exits the spiral flow paths of the first and second cylinders 512 and 514, the polymer enters a cavity 526 at the second axial end 524 of the choke trim 18. From the cavity 526, the polymer enters axial passages 528 formed in the outer portion 508 of the choke trim 18, as indicated by arrow 530. The polymer flows through the axial passages 528 from the second axial end 524 toward the first axial end 520 of the choke trim 18, as indicated by arrow 532. However, the axial passages 528 formed in the outer portion 508 do not extend an entire axial length of the choke trim 18. Rather, the axial passages 528 of the outer portion 508 terminate (e.g., at exit points 533) at an approximate midpoint 534 of the choke trim 18 near the outlet 502 of the choke 16. However, it will be appreciated that the axial passages 528 may terminate at other positions along the axial length of the choke trim 18. As the polymer exits the axial passages 528, the polymer enters an annular cavity 536 within the choke 16, as indicated by arrow 538, and thereafter flows through the outlet 502 of the choke 16.

In the illustrated embodiment, the outer portion 508 of the choke trim 18 includes 24 axial passages 528, but other embodiments may include other numbers of axial passages 528 formed in the outer portion 508. Additionally, each of the axial passages 528 may have a cross-section that is constant along the respective length of the axial passage 528, or the cross-section may vary. In certain embodiments, the cumulative cross-sectional area of the plurality of axial passages 528 may be greater than the cumulative cross-sectional area of the plurality of spiral flow paths of the first and second cylinders 512 and 514 at the second axial end 524 of the choke trim 18. As a result, the polymer flowing through the axial passages 528 of the outer portion 508 may not experience any additional acceleration or shear forces, and therefore may not experience any additional degradation.

Figure 52:
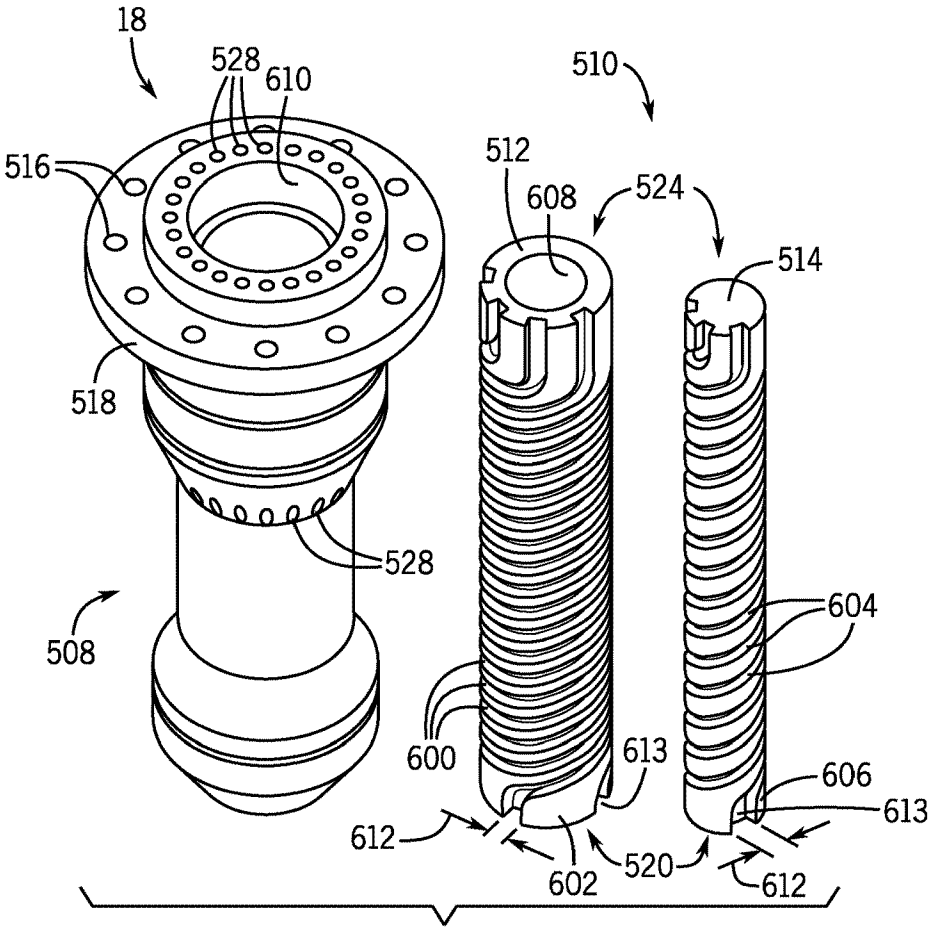
FIG. 52 is a perspective view of an embodiment of a disassembled low shear choke trim, in accordance with aspects of the present disclosure.

FIG. 52 is a perspective view of the choke trim 18 of FIG. 51, illustrated a disassembled arrangement of the components of the choke trim 18. That is, the outer portion 508 and the first and second cylinders 512 and 514 of the inner portion 510 of the choke trim 18 are disassembled from one another. As mentioned above, the inner portion 510 of the choke trim 18 includes a plurality of spiral grooves or flow paths. Specifically, the first cylinder 512 has a first plurality of spiral flow paths 600 formed in an outer diameter 602 of the first cylinder 512, and the second cylinder 514 has a second plurality of spiral flow paths 604 formed in an outer diameter 606 of the second cylinder 514.

When the second cylinder 514 is positioned within the first cylinder 512, the second plurality of spiral flow paths 604 becomes enclosed. In other words, when the second cylinder 514 is positioned within the first cylinder 512, the second plurality of spiral flow paths 604 will abut an inner diameter or bore 608 of the first cylinder 512. In this manner, the second plurality of spiral flow paths 604 will be enclosed and will enable fluid flow (e.g., polymer or polymer solution flow) from the first axial end 520 of the choke trim 18 to the second axial end 524 of the choke trim 18. In a similar manner, the first plurality of spiral flow paths 600 may be enclosed when the first cylinder 512 is positioned within the outer portion 508 of the choke trim 18. That is, when the first cylinder 512 is positioned within the outer portion 508, the first plurality of spiral flow paths 600 will abut an inner diameter or bore 610 of the outer portion 508, thereby enabling fluid flow (e.g., polymer or polymer solution flow) from the first axial end 520 of the choke trim 18 to the second axial end 524 of the choke trim 18.

As mentioned above, each of the first and second pluralities of spiral flow paths 600 and 604 may have a gradually decreasing cross-sectional area to enable a gradual reduction in the acceleration of a polymer flow through the choke trim 18. In the illustrated embodiment, the cross-section of each of the first and second pluralities of spiral flow paths 600 and 604 is largest at the first axial end 520 of the choke trim 18 and smallest at the second axial end 524 of the choke trim 18. For example, a width 612 of each of the first and second pluralities of spiral flow paths 600 and 604 may be largest at the first axial end 520 of the choke trim 18 and smallest at the second axial end 524 of the choke trim 18 (e.g., at an entry point 613 of each of the first and second pluralities of spiral flow paths 600 and 604). As discussed in more detail with reference to FIG. 54, the cross-section (e.g., width 612) of each of the first and second pluralities of spiral flow paths 600 and 604 may gradually taper along the respective length of the respective flow path. The gradual taper or decrease in cross-sectional area of the flow path may enable a reduction in overall acceleration (compared to a standard choke) of a polymer or polymer solution flowing through the choke trim 18. This gradual reduction in overall acceleration may enable a decrease in degradation of the polymer.

Figure 53:
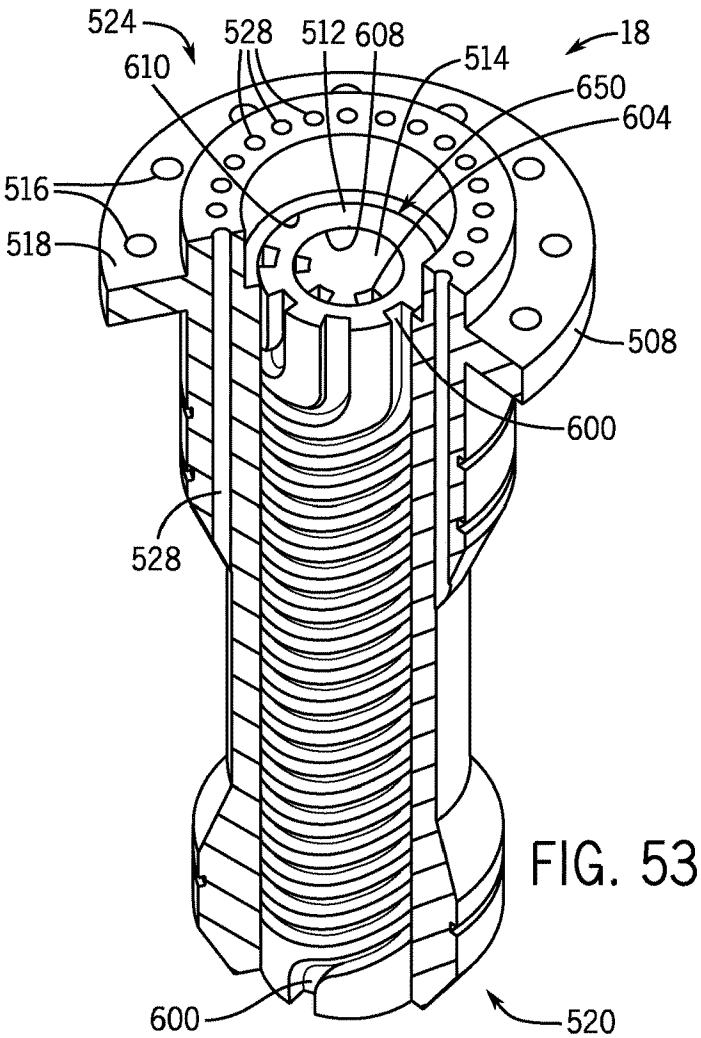
FIG. 53 is a partial cross-sectional perspective view of an embodiment of a low shear choke trim, in accordance with aspects of the present disclosure.

FIG. 53 is partial cross-sectional perspective view of the embodiment of the low shear choke trim 18 of FIG. 51 having the first and second pluralities of spiral flow paths 600 and 604. In the illustrated embodiment, the choke trim 18 components (e.g., the outer portion 508 and the first and second cylinders 512 and 514 of the inner portion 510) are assembled together. That is, the second cylinder 514 is positioned within the first cylinder 512, and the first cylinder 512 (with the second cylinder 514 positioned therein) is positioned within the outer portion 508.

With the components of the choke trim 18 assembled together, the second plurality of spiral flow paths 604 is enclosed by the inner bore 608 of the first cylinder 512, and the first plurality of spiral flow paths 600 is enclosed by the inner bore 610 of the outer portion 508 of the choke trim 18. As described above, the first and second pluralities of spiral flow paths 600 and 604 terminate at the second axial end 524 of the choke trim 18. In the illustrated embodiment, each of the first and second pluralities of spiral flow paths 600 and 604 terminate on the same circumferential half of the inner portion 510 of the choke trim 18. In other words, each of the first and second pluralities of spiral flow paths 600 and 604 terminate within 180 degrees of one another about a circumference 650 of the inner portion 510. In other embodiments, each of the first and second pluralities of spiral flow paths 600 and 604 terminate in other arrangements. For example, the termination point of each of the first plurality of spiral flow paths 600 may be spaced equidistantly about the first cylinder 512 at the second axial end 524 of the choke trim 18. In certain embodiments, the second plurality of spiral flow paths 504 may be spaced similarly or differently than the first plurality of spiral flow paths 600.

Figure 54:
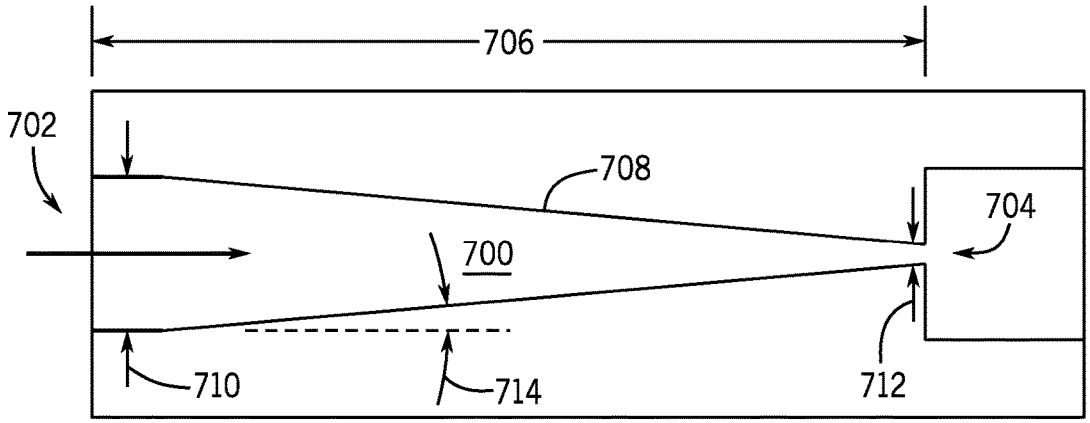
FIG. 54 is a schematic side view of an embodiment of a flow path of a low shear choke trim, in accordance with aspects of the present disclosure.

FIG. 54 is a cross-sectional schematic side view of an embodiment of a flow path 700 of a low shear choke trim 18. As discussed above, certain embodiments of the choke trim 18 may include one or more flow paths 700 that have a gradually reducing cross-sectional area. The gradually reducing cross-sectional area of the flow path may reduce the overall acceleration of a polymer or polymer solution (compared to a standard choke) flowing through the flow path 700, which may reduce degradation of the polymer. The gradual reduction in cross-section may be over a certain portion or length of the flow path 700. For example, the taper length may be 10 to 90, 20 to 80, 30 to 70, or 40 to 60 percent of the total flow path 700 length. As will be appreciated, the flow path 700 shown in FIG. 54 is a schematic that may represent any of the flow paths described above. For example, the flow path 700 may represent one of the spiral flow paths 600 or 604 described with respect to FIGS. 52 and 53. For further example, the flow path 700 may represent an inlet feature or flow path of any of the choke trims 18 described above.

In the illustrated embodiment, the flow path 700 includes and inlet 702 and an outlet 704. The flow path 700 extends a length 706 between the inlet 702 and the outlet 704. The flow path 700 includes a taper 708 extending along the length 706 of the flow path 700. The taper 708 of the flow path 708 gradually decreases the cross-sectional area (e.g., flow path area) of the flow path 700 from the inlet 702 to the outlet 704. At the inlet 702, the flow path 700 has a first cross-sectional area 710, which is the largest cross-sectional area of the flow path 700. At the outlet 704, the flow path 700 has a second cross-sectional area 712, which is the smallest cross-sectional area of the flow path 700. The gradual reduction in the cross-sectional area of the flow path 700 along the length of the flow path 700 may reduce the overall acceleration of a polymer or polymer solution flowing through the flow path 700. This gradual reduction may therefore reduce degradation of the polymer by reducing the acceleration and shear forces acting on the polymer molecules. In the illustrated embodiment, the taper 708 gradually reduces at an angle 714. In certain embodiments, the angle 714 may be approximately 0 to 10, 0.1 to 8, 0.2 to 6, 0.3 to 4, 0.4 to 2, or 0.1 to 1 degrees. In other embodiments, the taper 708 may have other angles. Additionally, the taper 708 may have constant angles or varying angles along the length 706. In certain other embodiments, the cross-sectional area of the flow path 700 may gradually reduce from the first cross-sectional area 710 to the second cross-sectional area 712 over a length which may be a portion of the overall length flow path 700. For example, the taper 708 may extend 10, 20, 30, 40, 50, 60, 70, 80, or 90 percent of the length 706 of the flow path 700. The remaining portion of the flow path 700 may have a uniform cross-sectional area which may be equal to the second cross-sectional area 712. The taper 708 may have constant angles or varying angles over the taper 708 portion of the flow path 700.

Figure 55:
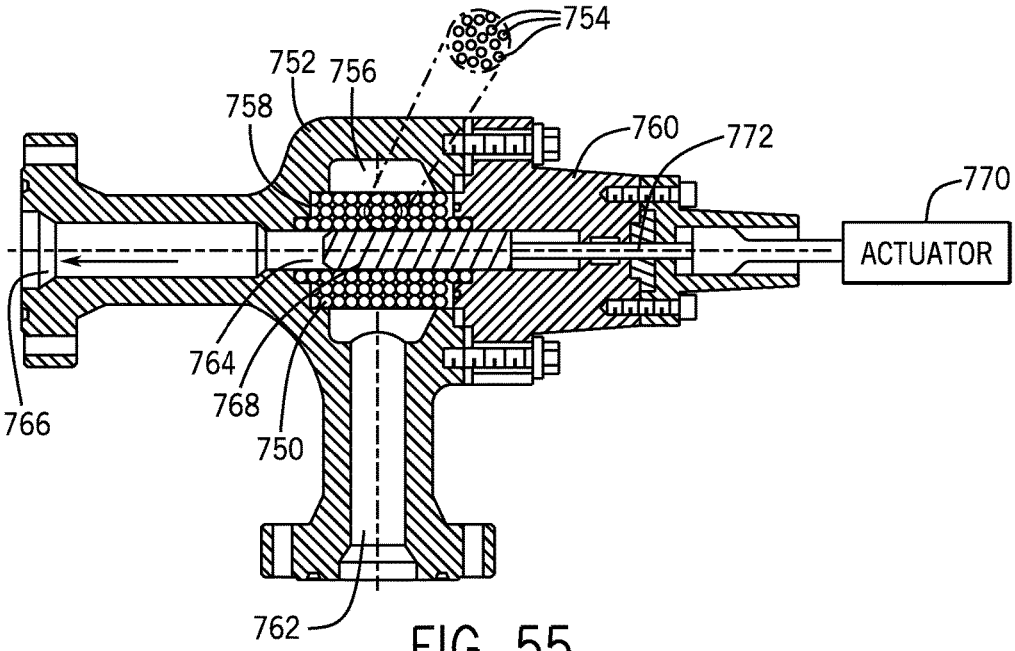
FIG. 55 is a cross-sectional side view of an embodiment of a choke having a choke trim with a porous element.

FIG. 55 is a cross-sectional side view of an embodiment of the choke 16 having a choke trim 18 with a porous element 750 (e.g., a cylindrical component). As discussed above, the porous element 750 of the choke trim 18 may be positioned within the choke 18 (e.g., a choke body 752), and the polymer may be forced through small openings or pores of the porous element 750. The porous characteristics (e.g., the porosity) of the choke trim 18 may be adjusted by adjusting the materials and/or processes used to form the porous element 750. For example, in certain embodiments, the porous element 750 may be formed by sintering metal or ceramic powders or particles 754 together. The size of the powders or particles 754, the pressure applied during a sintering process, the temperature applied during the sintering process, and/or other parameters may be selected to produce porous elements 750 having pores or openings of a desired size. In other words, various parameters may be selected or adjusted to produce porous elements 750 with a desired porosity. As will be appreciated, the porosity of the porous element 750 may be defined by the permeability of the porous element 750, the percentage of flow area relative to an overall surface area of the porous element 750, a fraction of the volume of void (e.g., flow area) in the porous element 750 relative to a total volume of the porous element 750, and so forth. In certain embodiments, the porous element 750 may have a porosity of approximately 10 to 80, 15 to 70, 20 to 60, 25 to 50, or 30 to 40 percent. In certain embodiments, the porous element 750 may be 316L stainless steel or other suitable porous metal.

In the illustrated embodiment, the porous element 750 of the choke trim 18 includes a cylindrical configuration. The porous element 750 is disposed within a trim cavity 756 of the choke 18, and the porous element 750 is retained against a choke trim recess 758 of the trim cavity 756 by a bonnet 760 of the choke 18. In operation, a fluid, such as a polymer or polymer solution, enters the choke 18 through an inlet 762 of the choke 18. The fluid flows through the choke 18 to contact the porous element 750 of the choke trim 18. As the fluid enters the pores of the porous element 750, the velocity of the fluid increases due to the porosity of the choke trim 18. Once the fluid passes through the porous element 750, the fluid may enter a central cavity 764 of the porous element 750, which is exposed to an outlet 766 of the choke 16. As a result, the fluid may flow from the central cavity 764 out of the choke 16. After the fluid passes through the porous element 750, the velocity of the fluid may drop. That is, the velocity of the fluid may drop once the fluid enters the central cavity 764 of the porous element 750.

As will be appreciated, the porosity of the porous element 750 may enable a reduction in polymer degradation of a polymer or polymer solution. For example, the porosity of the porous element 750 may enable a gradual reduction in the acceleration of the polymer or polymer solution as the polymer flows through the porous element 750 of the choke trim 18.

In certain embodiments, a flow rate of the polymer or polymer solution through the porous element 750 may be adjusted or controlled. For example, in the illustrated embodiment where the porous element 750 has a cylindrical configuration, the choke trim 18 may include a plug 768 disposed within the central cavity 764 of the porous element 750. The position (e.g., axial position) of the plug 768 within the central cavity 764 may be adjusted to control a flow rate of polymer or polymer solution through the porous element 750. For example, the plug 768 may be positioned entirely within the central cavity 764 to fully block flow through the porous element 750, and the plug 768 may be entirely removed from the central cavity 764 to enable full flow of the polymer or polymer solution through the choke trim 18. In the illustrated embodiment, the position of the plug 768 may be adjusted by an actuator 770. Specifically, the plug 768 is coupled to a shaft 772, which may be axially actuated by the actuator 770. The actuator 770 may be a mechanical (e.g., manual), electromechanical, electric, magnetic, pneumatic, hydraulic, or other type of actuator. Additionally, in certain embodiments, the actuator 770 may be controlled by a control system, such as the control system 300 described below with reference to FIG. 66.

Figure 56:
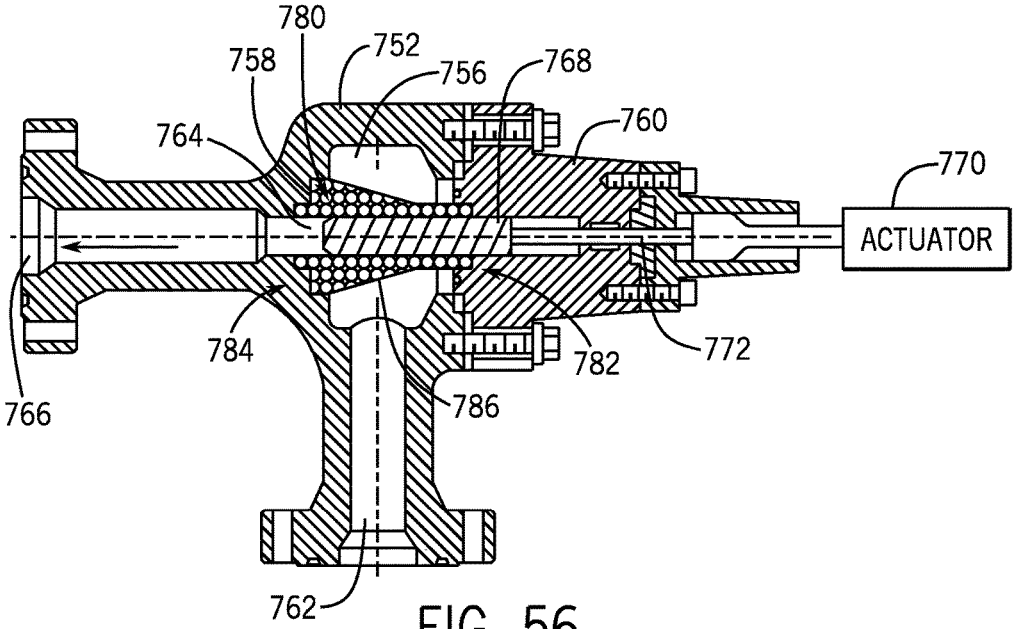
FIG. 56 is a cross-sectional side view of an embodiment of a choke having a choke trim with a porous element.

FIG. 56 is a cross-sectional side view of an embodiment of the choke 16 having a choke trim 18 with a porous element 780 (e.g., an annular component). The illustrated embodiment includes similar elements and element numbers as the embodiment described with reference to FIG. 55. In the illustrated embodiment the porous element 780 of the choke trim 18 includes a tapered configuration.

As similarly described above, the porous element 780 is retained by the bonnet 760 against the choke trim recess 758 of the choke body 752. Specifically, a first axial end 782 of the porous element 780 is retained by and against the bonnet 760, and a second axial end 784 of the porous element 780 is retained against the choke trim recess 758. Additionally, a tapered portion 786 of the porous element 780 extends from the second axial end 784 to the first axial end 782 of the porous element 780. Specifically, the second axial end 784 has a largest diameter of the porous element 780, the first axial end 782 has a smallest diameter of the porous element 780, and the tapered portion 786 extends between the first and second axial ends 782 and 784. The porous element 780 decreases in diameter from the second axial end 784 to the first axial end 782 along the tapered portion 786. In certain embodiments, the diameter of the first axial end 782 may be 2, 4, 6, 8, 10, 20, 30, 40, or 50 percent smaller than the diameter of the second axial end 784 of the porous element 780.

As will be appreciated, the tapered configuration of the porous element 780 may enable more fine-tuned adjustment of the flow rate of a polymer or polymer solution through the choke trim 18. For example, when choke trim 18 is in a fully opened position (e.g., when the plug 768 is removed from the central cavity 764 of the porous element 780), the choke trim 18 may enable a flow rate greater (e.g., higher capacity) than the choke trim 18 (e.g., the porous element 750) illustrated in FIG. 55 and having the cylindrical configuration. In other words, the decreased diameter at the first axial end 782 of the porous element 780 enables a greater flow rate when the polymer solution flows through the first axial end 782 (e.g., when the plug 768 is removed from the central cavity 764). Conversely, when the plug 768 is more fully positioned within the central cavity 764 (e.g., when the choke trim 18 is actuated towards a closed position), the increased diameter at the second axial end 784 of the choke trim 18 enables more fine-tuned or precise adjustment of the flow rate of the polymer solution through the porous element 780. In other words, while the porous element 750 in FIG. 55 may be a linear valve trim, the porous element 780 of FIG. 56 may be an equal percentage valve trim.

Figure 57:
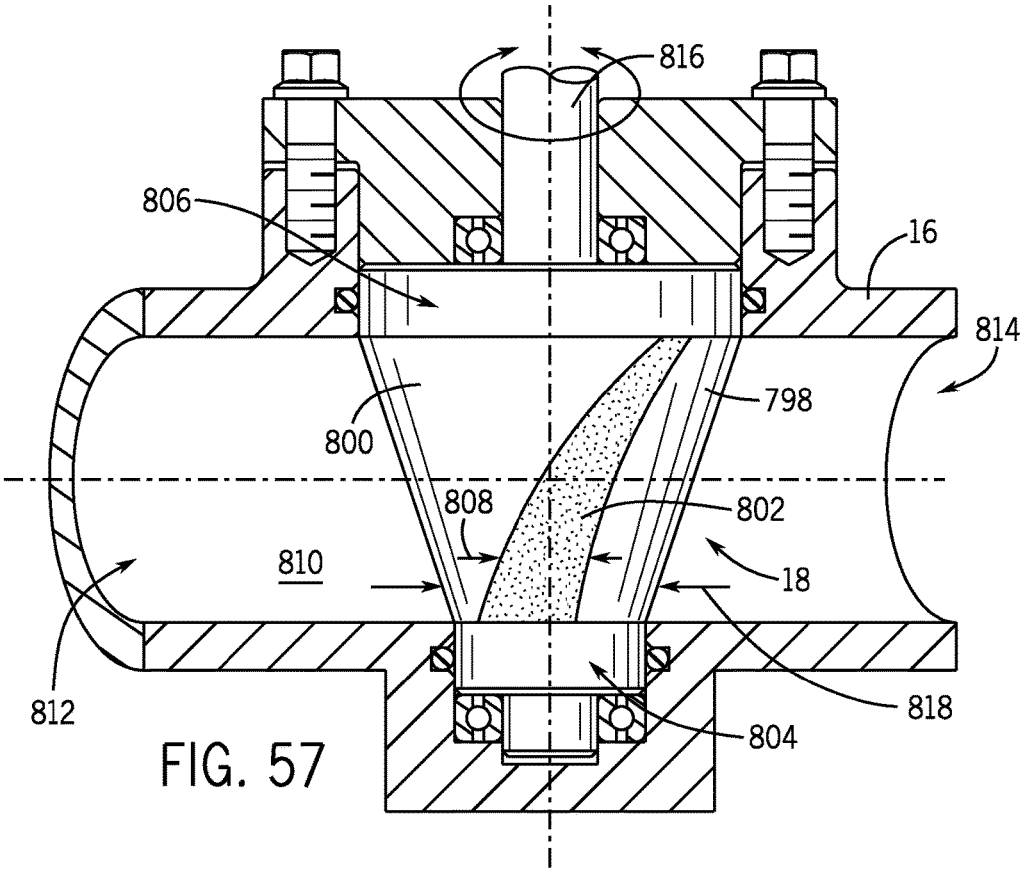
FIG. 57 is a cross-sectional side view of an embodiment of a choke having a choke trim with a porous element.

FIG. 57 is a cross-sectional side view of an embodiment of the choke 16 with the choke trim 18 having a porous component or element. As similarly discussed above, the porous component or element of the choke trim 18 may have small pores or openings through which a polymer or polymer solution may flow. The porous component or element may be formed from sintering metal or ceramic powders or particles together. The size of the powders or particles, the pressure applied during a sintering process, the temperature applied during the sintering process, and/or other parameters may be selected to produce a porous element or component having a desired porosity (e.g., 40 percent porosity).

In the illustrated embodiment, the choke trim 18 includes a conical trim component 800 with a body portion 798, which may be made from a solid metal, plastic, polymer, or other material, and a porous portion 802 extending through the body portion 798. Specifically, the porous portion 802 is a spiral or helical strip that extends from an axial bottom 804 of the conical trim component 800 to an axial top 806 of the conical trim component 800. Additionally, the porous portion 802 extends at least partially around a circumference of the conical trim component 800. In certain embodiments, the porous portion 802 may extend approximately 180, 170, 160, or 150 degrees about the circumference of the conical trim component 800. Furthermore, at the axial bottom 804 of the conical trim component 800, the porous portion 802 has a largest width 808, while the width 808 is smallest at the axial top 806 of the conical trim component 800. The width 808 of the porous portion 802 gradually decreases from the axial bottom 804 to the axial top 806. It should be noted that, in other embodiments, the body portion 798 may have other (e.g., non-linear and/or non-conical) configurations.

As shown, the conical trim component 800 is positioned within the choke 16 in a generally cross-wise arrangement relative to a flow path 810 of the choke 16. In other words, a fluid, such as a polymer or polymer solution, may flow from an inlet 812 of the flow path 810, across and/or through the conical trim component 800, and toward an outlet 814 of the flow path 810. To flow across the conical trim component 800, the fluid passes through the porous portion 802 of the conical trim component 800. As will be appreciated, the body portion 798 of the conical trim component 800 may be formed from a solid (i.e., non-porous) material, such as metal or plastic, and therefore may not enable flow therethrough.

To adjust a flow rate of fluid through the conical trim component 800, the conical trim component 800 may be rotated to adjust the amount or portion of the porous portion 802 that is exposed to the inlet 812 of the flow path 810. Because the porous portion 802 extends circumferentially about the half of the circumference of the conical trim component 800 or less, the amount of the porous portion 802 exposed to the inlet 812, and therefore the fluid flow resistance of the choke trim 18, may be adjusted. For example, a shaft 816 coupled to the conical trim component 800 may be rotated via an actuator to adjust the amount or portion of the porous portion 802 that is exposed to the inlet 812.

As will be appreciated, the flow resistance of the choke trim 18 may be lowest when the axial bottom 804 of the conical trim component 800 is exposed to the inlet 812 of the choke 16. Specifically, at the axial bottom 804 of the conical trim component 800, a width or length 818 of the conical trim component 800 is least. Additionally, the width or length 808 of the porous portion 802 is greatest at the axial bottom 802 of the conical trim component 800. Accordingly, the fluid flow (e.g., polymer or polymer solution) in the choke 16 may have the widest and shortest flow path through the choke trim 18, resulting in the lowest flow resistance of the choke trim 18. Conversely, at the axial top 806 of the conical trim component 800, the width or length 818 of the conical trim component 800 is greatest. Additionally, the width or length 808 of the porous portion 802 is least at the axial top 806 of the conical trim component 800. Therefore, the fluid flow (e.g., polymer or polymer solution) in the choke 16 may have the most narrow and longest flow path through the choke trim 18, resulting in the greatest flow resistance of the choke trim 18.

Figure 58:
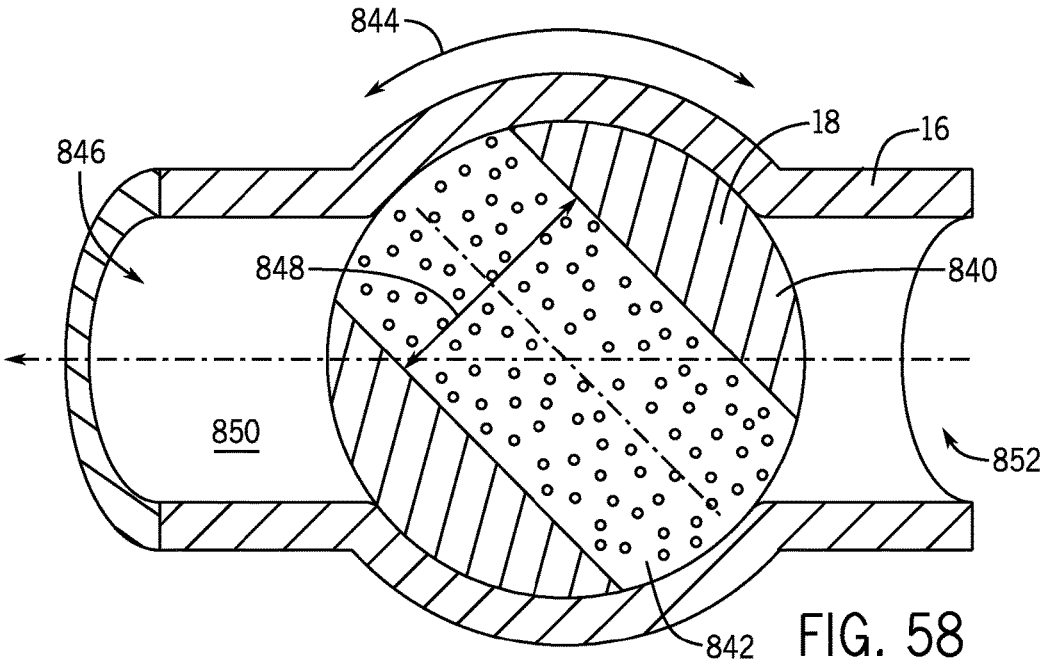
FIG. 58 is a cross-sectional side view of an embodiment of a choke having a choke trim with a porous element.

FIG. 58 is a cross-sectional side view of an embodiment of the choke 16 with the choke trim 18 having a porous component or element. In the illustrated embodiment, the choke trim 18 has a spherical or cylindrical body 840 with a porous portion 842 extending radially through the body 840. To adjust a flow resistance of the choke trim 18, the body 840 may be rotated, as indicated by arrow 844, to adjust the amount of the porous portion 842 exposed to an inlet 846 of the choke 16. To achieve at least flow resistance, the body 840 may be rotated such that the entire porous portion 842 (e.g., an entire height 848 of the porous portion 842) is exposed to the inlet 846 of the choke 16. In such a configuration, a fluid flow, such as a polymer or polymer solution, in a flow path 850 of the choke 16 may be exposed to an entire cross-sectional area of the porous portion 842. To increase the flow resistance of the choke trim 18, the body 840 may be rotated to block a portion or all of the height 848 of the porous portion 842 from exposure to the inlet 846 of the choke 16. In the illustrated embodiment, the body 840 may be rotated such that entire porous portion 842 is blocked from exposure to the inlet 846 (and an outlet 852) of the choke 16, thereby blocking all flow through the choke trim 18.

Figure 59:
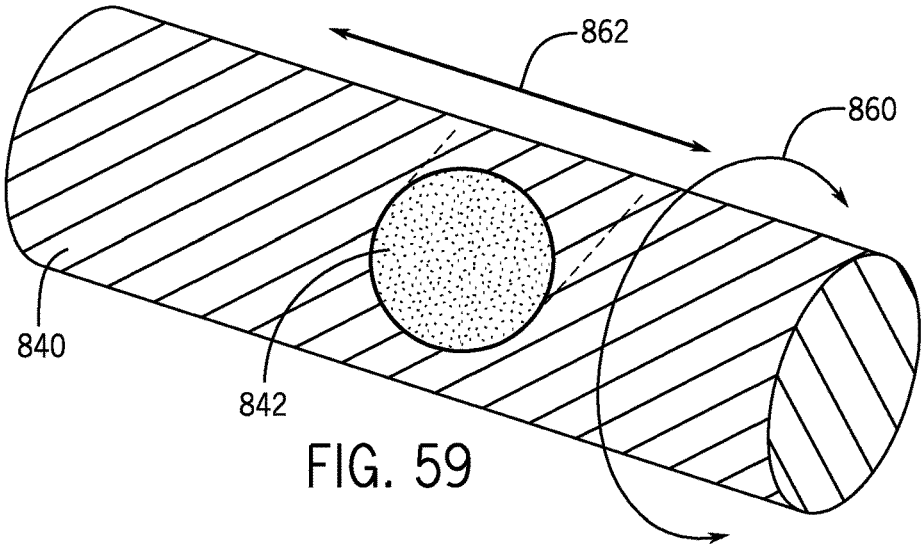
FIG. 59 is a perspective view of an embodiment of a choke trim with a porous element.

FIG. 59 is a perspective view of an embodiment of the body 840, which may be used with the choke 16 described with reference to FIG. 59. In the illustrated embodiment, the body 840 has a cylindrical configuration. As mentioned above, the body 840 of the choke trim 18 is disposed within the choke 16, and the porous portion 842 may be exposed to the inlet 846 of the choke 16. To adjust the flow resistance of the choke trim 18 (i.e., to adjust the amount of the porous portion 842 to that is exposed to the inlet 846), the body 840 of the choke trim 18 may be rotated, as indicated by arrow 860. Additionally, in embodiments where the body 840 is a cylinder, the body 840 may also be axially translated, as indicated by arrow 862. In this manner, the amount of the porous portion 842 exposed to the inlet 846 may be further adjusted or fine-tuned. In other words, the position of the body 860 may be axially adjusted relative to the choke 16 to further block or expose the porous portion 842 to the inlet 846, and thus a fluid flow.

Figure 60:
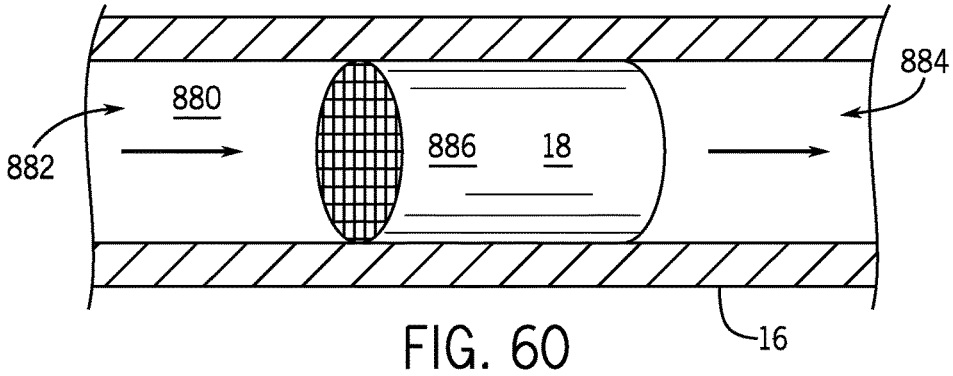
FIG. 60 is a cross-sectional schematic of an embodiment of a choke having a choke trim with a porous element.

FIG. 60 is a cross-sectional side schematic of an embodiment of the choke 16 having the choke trim 18, where the choke trim 18 is formed from a porous material. In the illustrated embodiment, the choke 16 includes a conduit or flow path 880 with an inlet 882 and an outlet 842. The choke trim 18 is has a generally cylindrical body 886 disposed within the flow path 880 of the choke 16. As similarly described above, the generally cylindrical body 886 may have small pores or openings through which a polymer or polymer solution may flow. The porous component or element may be formed from sintering metal or ceramic powders or particles together. The size of the powders or particles, the pressure applied during a sintering process, the temperature applied during the sintering process, and/or other parameters may be selected to produce a porous element or component having a desired porosity (e.g., 40 percent porosity).

Due to the porosity of the cylindrical body 886 causes a fluid (e.g., a polymer or polymer solution) flowing through the flow path 880 to increase in velocity as the fluid flows through the choke trim 18. For example, the fluid may flow at a first velocity at the inlet 882 and then at a second velocity greater than the first velocity as the fluid flows through the porous choke trim 18. After the fluid exits the porous choke trim 18, the fluid may return to the first velocity as the fluid flows through the outlet 884.

Figure 61:
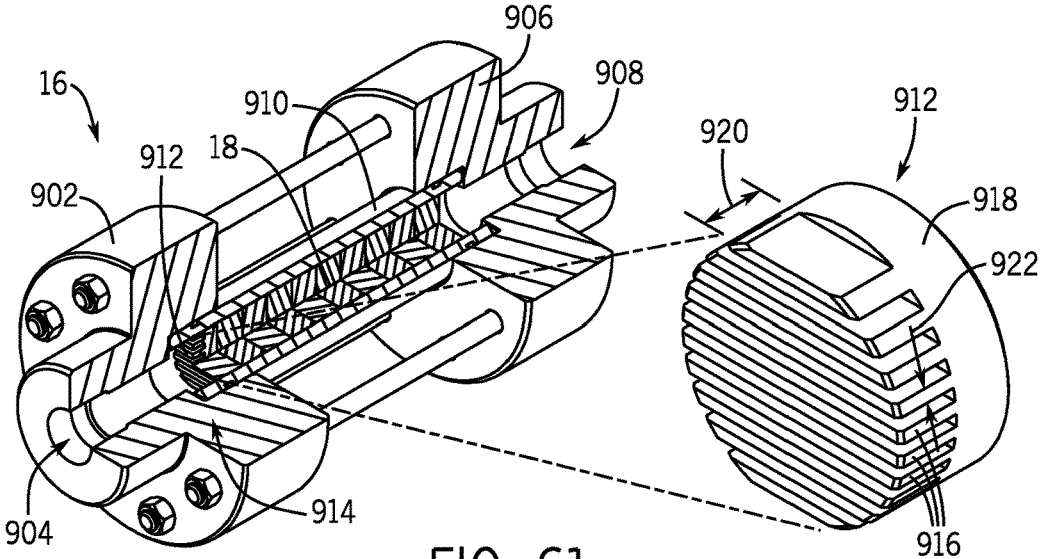
FIG. 61 is a cutaway perspective view of an embodiment of a choke having a choke trim with a porous element.

To reduce a sharp increase in acceleration of the fluid as the fluid enters the choke trim 18 from the inlet 882, the choke trim 18 may include an entrance portion having features to gradually expose the fluid flow to the porous choke trim 18. For example, FIG. 61 is a cutaway perspective view of a choke 16 having the choke trim 18, where the choke trim 18 is formed from a porous material, and the choke trim 18 includes an entrance portion 900 having feature to reduce fluid acceleration and/or fluid shear (extensional or elongational) on the fluid (e.g., polymer or polymer solution) when the fluid enters the choke trim 18.

The illustrated embodiment includes a front flange 902 having a flow path inlet 904 and a rear flange 906 having a flow path outlet 908. The front flange 902 and the rear flange 906 capture a flow path conduit 910 that contains the choke trim 18. As discussed in detail above, the choke trim 18 may be formed from a porous material having a plurality of small pores or openings to enable fluid flow through the choke trim 18. Additionally, the choke trim 18 includes an entrance portion 912 (e.g., an upstream entrance portion) positioned at an upstream end 914 of the choke trim 18 to reduce fluid acceleration and/or fluid shear (extensional or elongational) on the fluid (e.g., polymer or polymer solution) when the fluid enters the choke trim 18. The entrance portion 912 may also be formed from a porous material, such as the same porous material that forms the choke trim 18.

In the illustrated embodiment, the entrance portion 912 includes a plurality of horizontal fins 916 extending upstream from a base 918 of the entrance portion 912. Each of the horizontal fins 916 has a depth 920 and a thickness 922. In certain embodiments, the depth 920 and/or the thickness 922 may be approximately 1, 2, 3, 4, 5 centimeters, or more. Indeed, the depth 920, the thickness 922, and/or the number of horizontal fins 916 may be any suitable number or value. The horizontal fins 916 enable a gradual exposure of the fluid flow to the porous material, as compared to embodiments of the choke trim 18 which merely include a flat or planar surface that is cross-wise to the fluid flow path. In other words, the fluid flow may flow into and between the horizontal fins 916 and gradually enter the entrance portion 912. As a result, the fluid acceleration and/or fluid shear (e.g., extensional or elongational) on the fluid as the fluid flow enters the choke trim 18 may be decreased, thereby decreasing degradation of a polymer in the fluid flow.

Figure 62:
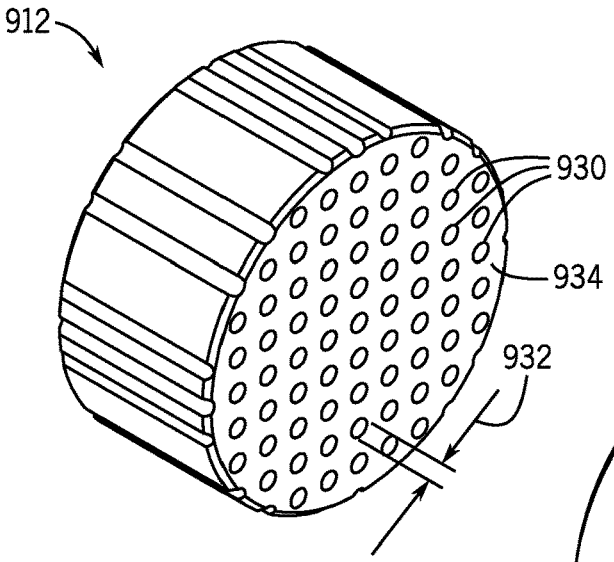
FIG. 62 is a perspective view of an embodiment of a portion of a choke trim having a porous element.

In other embodiments, the entrance portion 912 may have other configurations or features configured to enable a gradual exposure of the fluid flow to the porous material of the choke trim 18. Each of FIGS. 62-65 illustrates the entrance portion 912 with various features configured to enable a gradual exposure of the fluid flow to the porous material of the choke trim 18. For example, FIG. 62 illustrates the entrance portion 912 having a plurality of axial ports 930 formed therethrough. The axial ports 930 each have a diameter 932, which may be sized based on a design considerations, such as a desired total cross-sectional area of the axial ports 930 in the entrance portion 912. As the fluid flows toward the choke trim 18, the fluid may enter the axial ports 930 and also contact an upstream face 934 of the entrance portion 912. The variation in geometry of the entrance portion 912 enables a reduction in fluid acceleration and/or fluid shear (e.g., extensional or elongational) on the fluid as the fluid flow enters the choke trim 18, thereby decreasing degradation of a polymer in the fluid flow.

Figure 63:
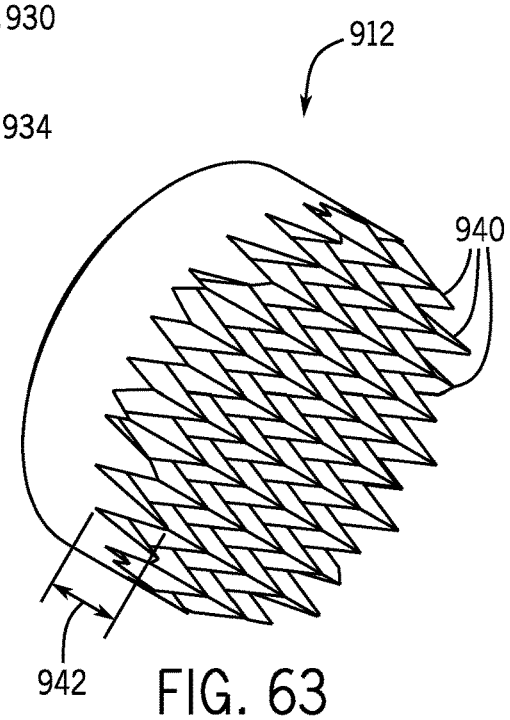
FIG. 63 is a perspective view of an embodiment of a portion of a choke trim having a porous element.

FIG. 63 illustrates an embodiment of the entrance portion 912 having a plurality of spikes 940 extending from a base 942 of the entrance portion 912. Each of the spikes 940 has a depth 942, which may be approximately 1, 2, 3, 4, 5 centimeters, or any other suitable length. As the fluid flow approaches the entrance portion 912, the fluid flow gradually contacts the spikes 940, and thus the porous choke trim 18. In this manner, fluid acceleration and/or fluid shear (e.g., extensional or elongational) on the fluid may be decreased as the fluid flow enters the choke trim 18, thereby decreasing degradation of a polymer in the fluid flow.

Figure 64:
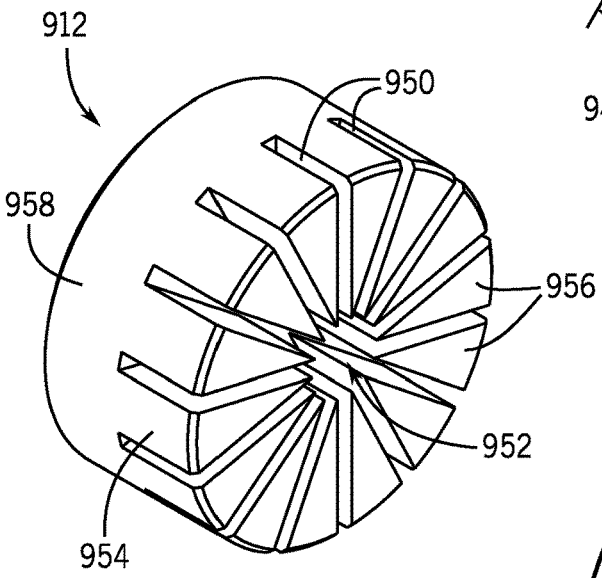
FIG. 64 is a perspective view of an embodiment of a portion of a choke trim having a porous element.

FIG. 64 illustrates an embodiment of the entrance portion 912 having a plurality of radial slots 950 formed therein. The radial slots 950 extend from a central cavity 952 in the entrance portion 912 toward an outer diameter 954 of the entrance portion. As shown, the radial slots 950 cooperatively form a plurality of wedge-shaped extrusions 956 extending upstream from a base 958 of the entrance portion 912. As the fluid flow approaches the entrance portion 912, the fluid may enter the radial slots 950 and also contact the wedge-shaped extrusions 956 of the entrance portion 912. The variation in geometry of the entrance portion 912 enables a reduction in fluid acceleration and/or fluid shear (e.g., extensional or elongational) on the fluid as the fluid flow enters the choke trim 18, thereby decreasing degradation of a polymer in the fluid flow.

Figure 65:
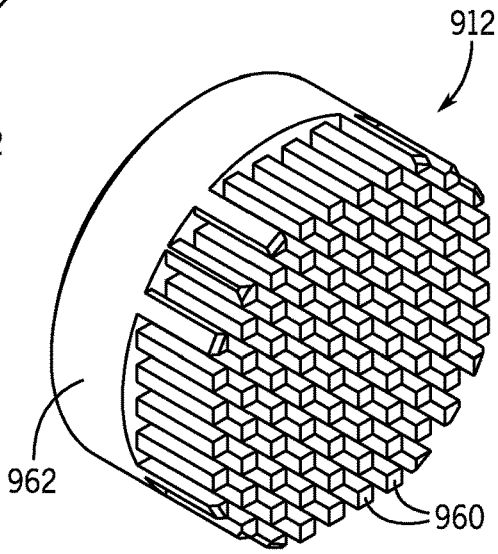
FIG. 65 is a perspective view of an embodiment of a portion of a choke trim having a porous element.

FIG. 65 illustrates an embodiment of the entrance portion 912 having a plurality of square or rectangular extrusions 960 extending upstream from a base 962 of the entrance portion 912. The extrusions 960 may have any suitable number or dimensions based on a design considerations, such as a desired total surface area of the extrusions 960. As with the entrance portion 912 features described above, the extrusions 960 enable a gradual exposure of the fluid flow to the porous material of the choke trim 18. The variation in geometry of the entrance portion 912 enables a reduction in overall fluid acceleration and/or fluid shear (e.g., extensional or elongational) on the fluid as the fluid flow enters the choke trim 18, thereby decreasing degradation of a polymer in the fluid flow.

Figure 66:
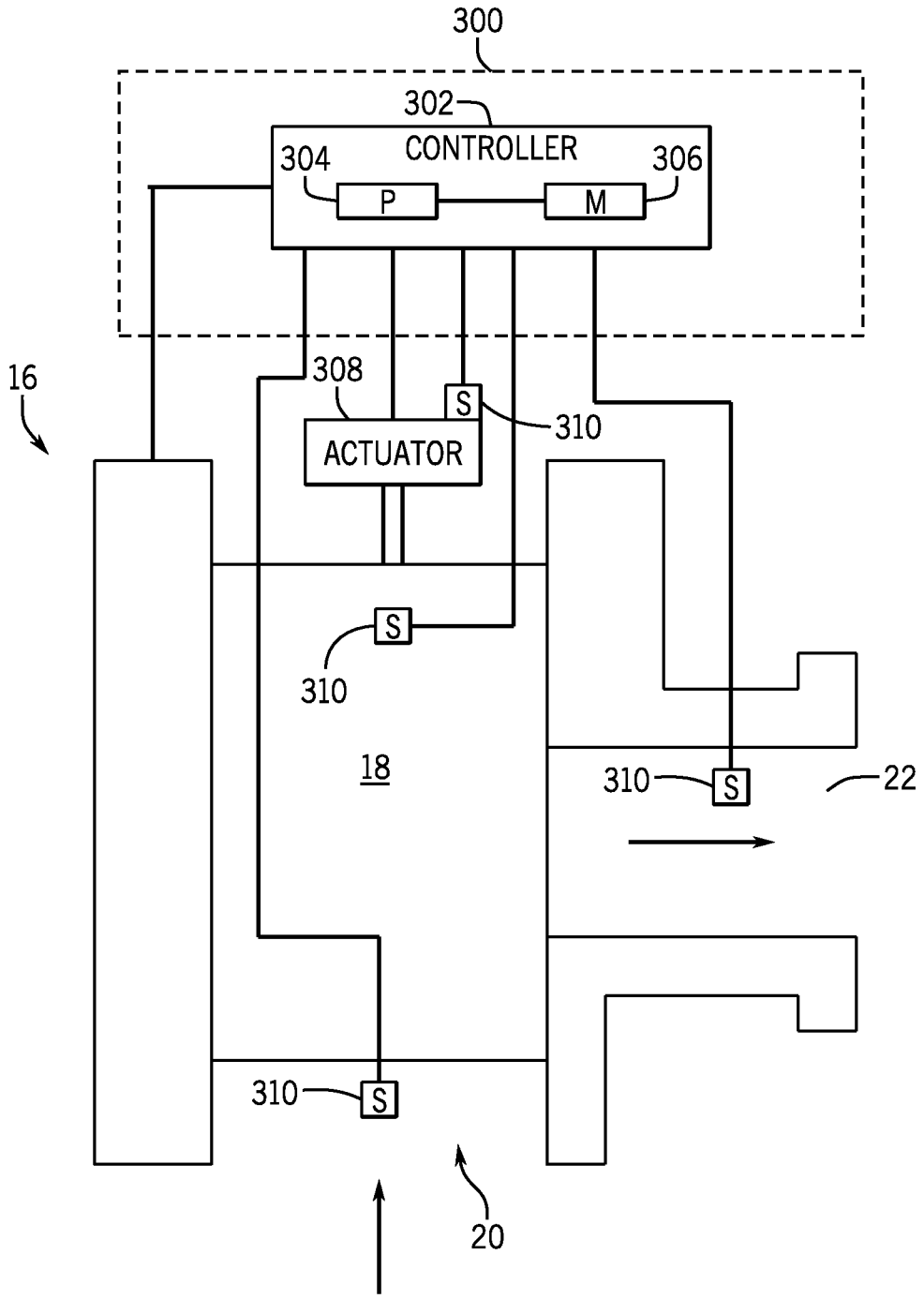
FIG. 66 is a schematic of an embodiment of a choke having a low shear choke trim and a control system, in accordance with aspects of the present disclosure.

Each of the embodiments described in detail above may be partially or entirely controlled by a control system, such as the control system 300 shown in FIG. 66. The control system 300 may include one or more controllers 302, where each controller 302 may include a processor 304, memory 306, and instructions stored on the memory 306 and executable by the processor 304 to control an actuator 308 (e.g., actuator 56 shown in FIG. 2) or drive to vary the length and/or cross-sectional area of the flow path through the choke trim 18. In certain embodiments, the actuator 308 may be configured to open or close one or more flow paths of the choke trim 18. For example, the actuator 308 may be a multiple orifice valve configured to open or close one or more of the first and second pluralities of spiral flow paths 600 and 604 described with respect to FIGS. 52 and 53. For example, the controller 302 may be responsive to feedback from one or more sensors 310, such as flow rate sensors, temperature sensors, pressure sensors, viscosity sensors, distance sensors, chemical composition sensors, or any combination thereof, associated with the flow of polymer through the choke trim 18. In this manner, the controller 302 may help to adjust the length and/or cross-sectional area of the flow path through the choke trim 18 to provide a suitable flow rate, pressure drop, shear forces, and properties of the polymer. For example, the controller 302 may control one or more operating parameters of the choke 16 or other components of the chemical injection system 10 to achieve a desired amount of polymer inversion.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a subsea chemical injection system configured to inject a chemical into a well, wherein the subsea chemical injection system comprises:

a subsea choke configured to flow the chemical, wherein the subsea choke comprises a trim cavity;

a choke trim of the subsea choke, wherein the choke trim comprises a sintered, porous material, and wherein an outermost surface of the sintered, porous material is directly adjacent to the trim cavity.

2. The system of claim 1, wherein the sintered, porous material is formed by sintering a plurality of metallic particles.

3. The system of claim 2, wherein the sintered, porous material comprises a porosity of at least 30 percent.

4. The system of claim 1, wherein the choke trim comprises a cylindrical component, and the cylindrical component comprises the sintered, porous material.

5. The system of claim 1, wherein the choke trim comprises an annular component, and the annular component comprises a taper extending from a first axial end of the annular component to a second axial end of the annular component.

6. The system of claim 1, wherein the choke trim comprises a conical trim component, comprising:

a body portion comprising a non-porous material; and a spiral strip extending through the body portion, wherein the spiral strip comprises the sintered, porous material.

7. The system of claim 6, wherein the spiral strip comprises a gradually decreasing width from a first axial end of the body portion to a second axial end of the body portion.

8. The system of claim 6, wherein the conical trim component is disposed within the subsea choke axially cross-wise to a flow path of the subsea choke.

9. The system of claim 1, wherein the choke trim comprises an upstream entrance portion comprising at least one physical feature extending upstream from a base of the upstream entrance portion.

10. A method, comprising:

directing a flow of a polymer solution through an inlet of a choke body into a trim cavity of the choke body;

directing the flow of the polymer solution from the trim cavity of the choke body directly into a sintered, porous element of a choke trim disposed within the choke body;

directing the flow of the polymer solution through the sintered, porous element of the choke trim;

directing the flow of the polymer solution through an outlet of the choke body; and adjusting a position of the sintered, porous element within the choke body to adjust a flow resistance of the choke trim, wherein adjusting the position of the sintered, porous element within the choke body comprises rotating a sphere or cylinder comprising the sintered, porous element within the choke body to adjust a portion of the sintered, porous element exposed to the inlet of the choke body.

11. The method of claim 10, comprising adjusting a position of a plug disposed within the sintered, porous element to adjust a flow resistance of the choke trim.

12. A system, comprising:

a choke trim of a subsea choke configured to flow a chemical for injection into a subsea well, wherein the choke trim comprises a sintered, porous material; and a plug extending into a central cavity of the sintered, porous material, wherein the plug is in direct contact with an inner surface of the central cavity.

13. The system of claim 12, wherein the choke trim comprises a cylindrical component formed from the sintered, porous material and wherein adjustment of an axial position of the plug within the central cavity adjusts a flow resistance of the choke trim.

14. The system of claim 12, wherein the choke trim comprises an annular component, the annular component comprises a taper extending from a first axial end of the annular component to a second axial end of the annular component, the annular component is formed from the sintered, porous material, and adjustment of an axial position of the plug within the central cavity adjusts a flow resistance of the choke trim.

15. The system of claim 12, wherein the choke trim comprises an entrance portion comprising at least one physical feature extending from a base of the entrance portion, wherein the entrance portion is formed entirely from the sintered, porous material.

* * * * *